US012258204B2

(12) United States Patent
Freilich et al.

(10) Patent No.: US 12,258,204 B2
(45) Date of Patent: Mar. 25, 2025

(54) CONTAINER FOR FLOWERS AND METHOD OF OPERATION THEREOF

(71) Applicants: David Freilich, Englewood, NJ (US); Elisa Freilich, Englewood, NJ (US)

(72) Inventors: David Freilich, Englewood, NJ (US); Elisa Freilich, Englewood, NJ (US)

( * ) Notice: Subject to any disclaimer, the term of this patent is extended or adjusted under 35 U.S.C. 154(b) by 15 days.

(21) Appl. No.: 18/197,682

(22) Filed: May 15, 2023

(65) Prior Publication Data

US 2023/0331465 A1 Oct. 19, 2023

Related U.S. Application Data

(63) Continuation-in-part of application No. 17/644,814, filed on Dec. 17, 2021, now Pat. No. 11,649,107, which is a continuation of application No. 16/564,041, filed on Sep. 9, 2019, now Pat. No. 11,214,434.

(60) Provisional application No. 62/817,917, filed on Mar. 13, 2019.

(51) Int. Cl.
*B65D 85/50* (2006.01)
*A47G 7/02* (2006.01)

(52) U.S. Cl.
CPC ..... *B65D 85/505* (2013.01); *A47G 7/02* (2013.01)

(58) Field of Classification Search
CPC ..... A01G 5/00; A47G 7/00; A47G 7/0078; A47G 7/02; A47G 7/03; B65D 85/50; B65D 85/505; B65D 85/52
See application file for complete search history.

(56) References Cited

U.S. PATENT DOCUMENTS

| | | | | |
|---|---|---|---|---|
| 5,758,472 A * | 6/1998 | Weder | B65D 75/04 53/399 |
| 6,305,540 B1 * | 10/2001 | Crawford | A45C 13/02 206/320 |
| 9,096,366 B2 * | 8/2015 | Sabogal | B65D 85/505 |
| 9,359,125 B2 * | 6/2016 | Pavlu, Jr. | B65D 85/505 |
| 2005/0150802 A1 * | 7/2005 | Davies | B65D 81/365 206/457 |

* cited by examiner

*Primary Examiner* — Bryon P Gehman
(74) *Attorney, Agent, or Firm* — Zaretsky Group PC; Howard Zaretsky

(57) ABSTRACT

A novel and useful container suitable for holding objects such as flowers and which may include a platform configured to be coupled to at least one flower. A body may include at least one wall that may extend between top and bottom edges and may define at least a portion of a cavity configured to receive the platform. The top edge may define a first opening leading to the cavity. A bottom wall may be located at or near the bottom edge of the body and may define a second opening leading to the cavity. A tensioner may be coupled to the platform and may form a tab that may partially extend from the platform towards the bottom wall and may be configured to be grasped by a user to urge at least a portion of the platform from the cavity towards the second opening when the tab is pulled.

20 Claims, 39 Drawing Sheets

CONTAINER FOR FLOWERS AND METHOD OF OPERATION THEREOF

REFERENCE TO PRIORITY APPLICATION

This application is a continuation-in-part of U.S. application Ser. No. 17/644,814, filed Dec. 17, 2021, entitled "Container for Flowers and Method of Operation Thereof," now U.S. Pat. No. 11,649,107, which is a continuation of U.S. application Ser. No. 16/564,041, filed Sep. 9, 2019, entitled "Container for Flowers and Method of Operation Thereof," now U.S. Pat. No. 11,214,434, which claims priority to U.S. Provisional Application Ser. No. 62/817,917, filed Mar. 13, 2019, entitled "Container for Flowers and Method of Operation Thereof," the contents of all of which are incorporated herein by reference in their entirety.

FIELD OF THE DISCLOSURE

The present system relates to a container for flowers and, more particularly, to a container system for flowers with an interchangeable and elevatable platform for positioning at least one flower and a system of operation thereof.

BACKGROUND OF THE INVENTION

Flowers are typically given as a gift and may be wrapped in a cellophane or paper wrapper or enclosed in a container such as a box typically made from cardboard or the like. Wrapped flowers may be easily bruised, damaged, and/or difficult to ship economically. Boxed flowers may protect the flower contained within but may be bulky and drab and not particularly attractive or aesthetically pleasing to a recipient. After flowers are removed from their conventional wrapping, they must be promptly placed in a liquid such as water to enhance their appearance and extend their useful life. This may require a recipient of the flower to perform additional tasks and may result in a lower price for the flower. Moreover, this may require a user have a vase or the like ready for receiving the flower. Accordingly, the present system and methods overcome these deficiencies of the above-mentioned prior art systems.

SUMMARY OF THE INVENTION

The systems, devices, methods, user interfaces, arrangements, computer programs, processes, etc. (hereinafter each of which will be referred to as system, unless the context indicates otherwise), described herein address and/or overcome problems in prior art systems.

In accordance with embodiments of the present system, there is disclosed a container suitable for holding objects such as flowers and which may include a body having at least one wall defining a cavity. The at least one wall may include openings separated apart from each other. A tensioner (e.g., an operating member) may pass through the openings. A platform may be situated within the cavity and coupled to the tensioner so as to receive a force from the tensioner when a tension is applied to the tensioner. This force may be operative to lift the platform and the flower coupled thereto so that the flower partially or fully extends from the cavity while at least a portion of the platform remains in the cavity.

In accordance with embodiments of the present system, there is disclosed a container which may include one or more of a flexible tensioner; a platform may be configured to be coupled to the tensioner and at least one flower; and/or a body may include at least one wall which may define at least a portion of a cavity that may be configured to receive the platform, and a first opening leading to the cavity; a plurality of opposed openings may be situated in the at least one wall and may be configured to receive the tensioner such that a portion of the tensioner may extend through the plurality of openings and may be situated in the cavity.

It is envisioned that the tensioner may be coupled to the platform to form a loop therewith. A portion of the of the loop may be situated in the cavity and a portion of the loop may be situated outside of the cavity. It is further envisioned that at least one coupler may be configured to secure the at least one flower to the platform. In accordance with embodiments of the present system, the platform may be configured to telescopically travel within the cavity and may be held in a desired position relative to the body using an interference fit. The container may further include at least one flower. It is envisioned that this flower may include a real flower, a preserved flower, and/or an artificial flower and/or combinations thereof. Flowers of varying types, colors, hues, and/or sizes may be provided. Flowers of different colors may form a desired pattern such as a textual pattern and/or a graphical pattern.

In accordance with embodiments of the present system, it is envisioned that at least one bead may be coupled to the tensioner. It is further envisioned that the tensioner may be configured to lift the platform when tensioned across the cavity. The container may further include a container such as ring container which may be coupled to at least one of the platform and the at least one flower. The container may include a cavity suitable for containing a desired object such as a piece of jewelry (e.g., a ring, an earing(s), a necklace, a bracelet, etc.) It is envisioned that least one bow may be coupled to the tensioner. It is further envisioned that at least one charm may be coupled to the at least one bow or to the tensioner. In accordance with embodiments of the present system, at least one of a cover and an inner cover may be configured to cover at least a portion of the cavity.

In accordance with embodiments of the present system, there is provided a container which may include: a platform configured to be coupled to a tensioner and at least one flower; a body having at least one wall extending between top and bottom edges and defining at least a portion of a cavity configured to receive the platform, the top edges defining a first opening leading to the cavity; a plurality of opposed openings situated in the at least one wall between the top and bottom edges; and/or a tensioner extending through the opposed openings such that at least a portion of the tensioner is situated in the cavity.

It is envisioned that the tensioner may be fixedly or slidably coupled to the platform. A coupler may be provided to couple the tensioner into a loop. At least one coupler may be provided and may be configured to secure the at least one flower to the platform. It is envisioned that the platform may be configured to telescopically travel within the cavity. It is envisioned that the at least one flower may include a real flower, an artificial, and/or a preserved flower and/or combinations thereof. It is further envisioned that at least one tab suitable for grasping by a user or at least one bead may be coupled to the tensioner.

In accordance with embodiments of the present system, there may be provided a ring container coupled to at least one of the platform and the at least one flower. At least one bow may be provided and may be coupled to the tensioner. It is envisioned that at least one charm may be coupled to at least one of the tensioner and the at least one bow. It is also envisioned that at least one of a cover and an inner cover each of which may be configured to cover at least a portion of the cavity may be provided.

In accordance with embodiments of the present system, there is provided a container which may include: a platform configured to be coupled to at least one flower; a body having at least one wall extending between top and bottom edges and which may define at least a portion of a cavity which may be configured to receive the platform, the top edge which may define a first opening leading to the cavity, the body may further include a bottom wall at the bottom edge; at least one opening situated in the at least one wall between the top and bottom edges; and/or a tensioner which may extend across the cavity and through the at least one opening such that the tensioner may be configured to be pulled through the at least one opening.

A coupler may be provided and configured to couple at least a portion of the tensioner to the body. It is further envisioned that at least a portion of the tensioner may be situated between at least a portion of the platform and at least one of the bottom wall and the at least one wall. At least one of a cover and inner cover may be provided and may be configured to cover at least a portion of the cavity. It is envisioned that at least one of a bow and a charm may be provided and may be coupled each other and/or the tensioner. A ring container may be provided and may be coupled to at least one of the platform and the at least one flower.

In accordance with embodiments of the present system, there is disclosed a container which may include a platform that may be configured to be coupled to at least one flower, a body which may have at least one wall that may extend between a top edge and a bottom edge and may define at least a portion of a cavity that may be configured to receive the platform, the top edge may define a first opening leading to the cavity, a bottom wall at or near the bottom edge of the body and defining a second opening leading to the cavity, and at least one tensioner that may be coupled to the platform and may form a tab that may be configured to be grasped by a user to urge at least a portion of the platform from the cavity towards the second opening when the tab is pulled.

In accordance with embodiments of the present system, the tab may be configured to be grasped by a user through the second opening when the platform is in a fully or substantially raised position. It is further envisioned that platform may be configured to receive a force from the second opening to urge the platform towards or through the first opening. It is envisioned that the tab may be configured to urge the platform towards the second opening when pulled from the cavity towards or through the second opening. In some embodiments, the bottom wall may be configured to limit travel of the platform when the platform is urged towards the second opening. It is envisioned that the second opening may be smaller in area than the first opening and/or may have a similar shape. It is envisioned that the bottom wall may be configured to limit travel of the platform when the platform is urged from the cavity towards the second opening. In some embodiments, at least one limiter may be provided and may be coupled to the at least one wall at the first opening and may be configured to limit travel of the platform towards or through the first opening.

In accordance with embodiments of the present system, the at least one opening may be situated in the at least one wall between the top and bottom edges. In some embodiments, the at least one tensioner may extend through a corresponding one of the at least one opening such that at least a portion of the at least one tensioner may be situated in the cavity and may be configured to be pulled from the cavity through the corresponding one of the at least one opening to urge at least a portion of the platform from the cavity towards or through the first opening.

In accordance with embodiments of the present system, there is disclosed a container which may include a platform that may be configured to be coupled to at least one flower. A body may include at least one wall that may extend between a top edge and a bottom edge. The one wall may define at least a portion of a cavity that may be configured to receive the platform. It is envisioned that the top edge may define a first opening leading to the cavity. A bottom wall may be provided at or near the bottom edge of the body and may define a second opening leading to the cavity. At least one tensioner may be provided and may be coupled to the platform. The at least one tensioner may form at least one tab that may partially extend from platform towards the bottom wall. It is envisioned that the at least one tab may be configured to be grasped by a user to urge at least a portion of the platform from the cavity towards the second opening when the at least one tab is pulled.

In accordance with embodiments of the present system, it is envisioned the at least one tab may be configured to be grasped by a user through the second opening when the platform is in a fully or substantially raised position. It is envisioned that the at least one tab may be configured to be pulled from the cavity towards or through the second opening. It is further envisioned that the at least one tab may be configured to urge the platform towards the second opening as the tab is pulled towards or through the second opening. In some embodiments, a coupler may be provided and may be configured to releasably couple the at least one tab to at least one of the bottom wall and the at least one wall.

In accordance with embodiments of the present system, there is disclosed a container which may include a platform configured to be coupled to at least one flower, and a body that may have at least one wall that may extend between a top edge and a bottom edge and may define at least a portion of a cavity that may be configured to receive the platform. It is envisioned that the top edge may define a first opening leading to the cavity. A bottom wall may be provided and be located at or near the bottom edge of the body and may define at least one opening that may be opposite the first opening. It is envisioned that at least one tensioner may be provided and coupled to the platform. The at least one tensioner may be configured to pass through the at least one opening of the bottom wall and may form a tab configured be grasped by a user to urge at least a portion of the platform from the cavity towards the bottom wall when the tab is pulled.

In some embodiments, the tab may be configured to be grasped by a user to pull at least a portion of the at least one tensioner through a corresponding one of the at least one opening of the bottom wall. It is envisioned that the bottom wall may be configured to limit travel of the platform when the platform is urged towards bottom wall. In some embodiments, the at least one tensioner may be configured to limit travel of the platform towards or through the first opening. In some embodiments, a releasable fastener may be provided and may be configured to releasably couple portions of the at least one tensioner to each other and/or to the bottom wall when the platform is in a fully or substantially recessed position in the cavity.

BRIEF DESCRIPTION OF THE DRAWINGS

The present invention is explained in further detail in the following exemplary embodiments and with reference to the figures, where identical or similar elements may be partly indicated by the same or similar reference numerals, and the features of various exemplary embodiments being combinable. The invention is herein described, by way of example only, with reference to the accompanying drawings, wherein.

DETAILED DESCRIPTION

Figure 1A:
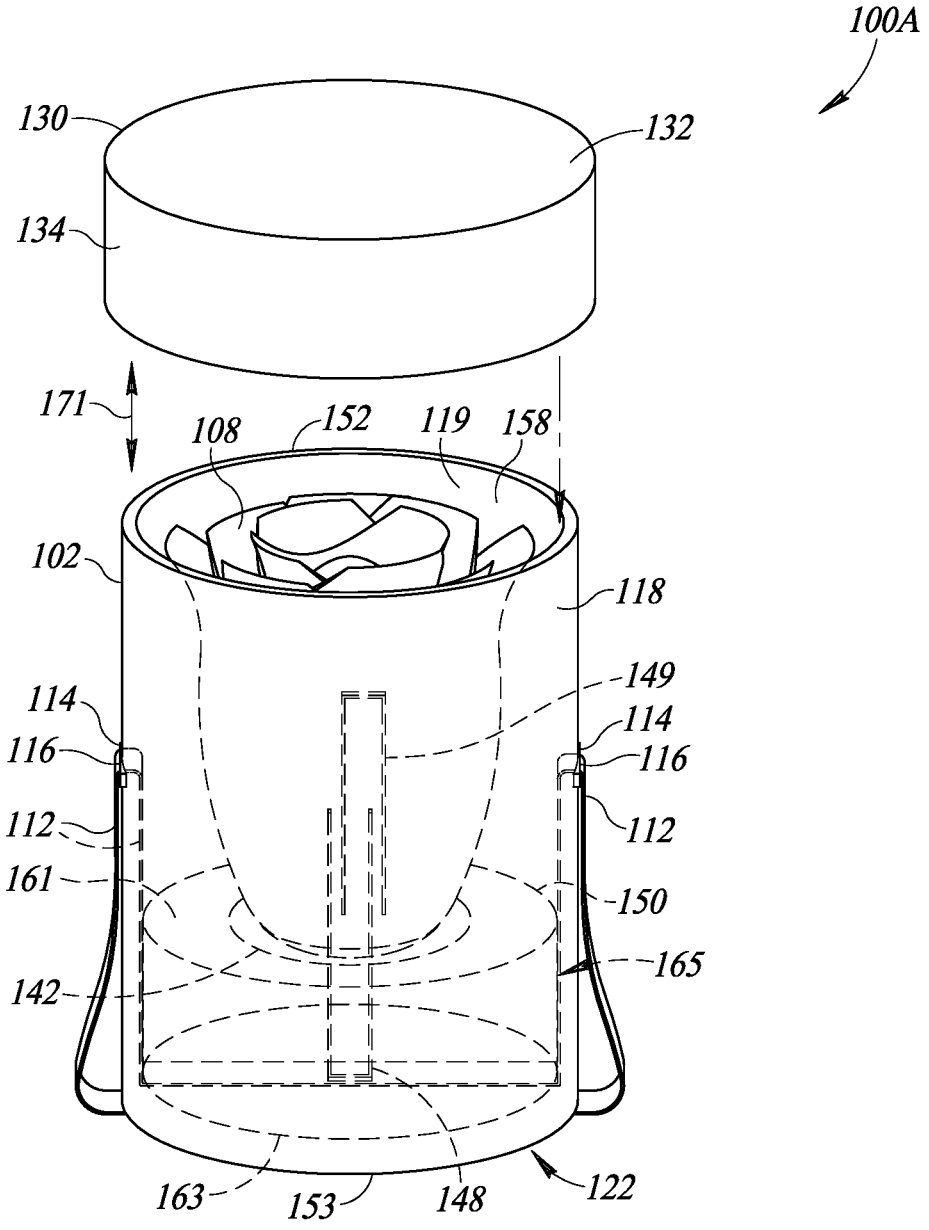
FIG. 1A is a diagram illustrating a partially exploded perspective front view of a portion of an example flower container system of the present invention according to a first embodiment.

In the following detailed description, numerous specific details are set forth in order to provide a thorough understanding of the invention. It will be understood by those skilled in the art, however, that the present invention may be practiced without these specific details. In other instances, well-known methods, procedures, and components have not been described in detail so as not to obscure the present invention.

Among those benefits and improvements that have been disclosed, other objects and advantages of this invention will become apparent from the following description taken in conjunction with the accompanying figures. Detailed embodiments of the present invention are disclosed herein; however, it is to be understood that the disclosed embodiments are merely illustrative of the invention that may be embodied in various forms. In addition, each of the examples given in connection with the various embodiments of the invention which are intended to be illustrative, and not restrictive.

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings.

The figures constitute a part of this specification and include illustrative embodiments of the present invention and illustrate various objects and features thereof. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention. Further, where considered appropriate, reference numerals may be repeated among the figures to indicate corresponding or analogous elements.

Because the illustrated embodiments of the present invention may for the most part, be implemented using electronic components and circuits known to those skilled in the art, details will not be explained in any greater extent than that considered necessary, for the understanding and appreciation of the underlying concepts of the present invention and in order not to obfuscate or distract from the teachings of the present invention.

Any reference in the specification to a method should be applied mutatis mutandis to a system capable of executing the method. Any reference in the specification to a system should be applied mutatis mutandis to a method that may be executed by the system.

Throughout the specification and claims, the following terms take the meanings explicitly associated herein, unless the context clearly dictates otherwise. The phrases "in one embodiment," "in an example embodiment," and "in some embodiments" as used herein do not necessarily refer to the same embodiment(s), though it may. Furthermore, the phrases "in another embodiment," "in an alternative embodiment," and "in some other embodiments" as used herein do not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

FIG. 1A is a diagram illustrating a partially exploded perspective front view of a portion of an example flower container system (hereinafter system 100A for the sake of clarity) of the present invention according to a first embodiment. The system 100A may include one or more of a body 102, a flower 108, a platform 150, a tensioner 112 (e.g., an operating member) and a cover 130. The rear view may be similar.

The body 102 may include one or more walls such as a side wall 118 which may extend between a top wall 152 (or top edge) and a bottom wall 153 (or bottom edge) of the side wall 118 and may define at least a portion of a cavity 158 which may be configured to receive the platform 150 and the flower 108 coupled thereto. The side wall 118 may include one or more openings such as openings 116 which may be configured to receive and or to provide passage of corresponding portions of the tensioner 112 which may pass therethrough. One or more of the openings 116 may include a grommet 114 or the like (e.g., a cringle, an eyelet, etc.) through which the tensioner 112 may pass.

The grommet 114 may include a low friction surface in contact with the tensioner so as to reduce friction between the tensioner 112 and the grommet 114. In some embodiments, it is envisioned that the grommet 114 may be configured to provide a desired amount of resistance when the tensioner 112 passes therethrough so as to provide an interference fit or the like to prevent or restrict movement of the tensioner 112 through the grommet 114 in one or more desired directions. The grommet 114 may be continuous or discontinuous about a periphery of the corresponding opening 116 and may be configured to reduce or otherwise prevent abrasion of the tensioner 112 during use. In some embodiments at least a portion of the grommet may be formed from a snap fit type grommet which may be snap fit into a corresponding opening and which may be suitable to receive the tensioner 112. In some embodiments, the grommet may be formed integrally with the side wall 118 of the body 102.

The tensioner 112 may include any suitable flexible member or members such as a ribbon, a film, a tape, a string, a braid, a cord, a rope, a cable, a chain, a band, a belt, a cable tie or the like (e.g., a zip-tie or portion thereof) and/or the like and/or combinations thereof. For example, in some embodiments it is envisioned that the tensioner 112 may be formed from a ribbon or other suitable material or materials as may be desired. It is further envisioned that the tensioner 112 may be formed from any suitable material such as polymers, plastic, cloth, metal, and/or the like and/or combinations thereof. The tensioner 112 may be configured to pass through one or more of the openings 116 and/or the grommet 114 with a desired amount of friction as may be desired. Generally, the tensioner 112 may be configured to be tensioned (e.g., by a user) in at least that portion that lies within the cavity 158 and is supported by one or more walls of the body 102 such as the side wall 118. For example, the tensioner 112 may pass through the side wall 118 at openings 116 such that the tensioner 112 may be supported by the side wall 118 at the openings 116 (e.g., via optional grommets 114). It is further envisioned that when the platform is substantially or fully recessed within the body 102, tensioner 112 may support an optional bow, charm, or the like, at a desired position relative to the side wall 118 of the body 102.

In some embodiments, the tensioner 112 may extend about and/or wrap around a portion of the body 102 and/or cover 130. For example, the tensioner 112 may extend about the bottom wall 122 of the body 102. In some embodiments, the tensioner 112 may be coupled to the platform 150 and/or body 102 using any suitable method or methods.

For example, any suitable coupler may be provided to couple the tensioner 112 to the body 102 such as an adhesive (e.g., see, 111 FIG. 3) or the like. For example, a coupler such as an adhesive or tape may releasably attach at least a portion of the tensioner 112 to the bottom wall 122 of the body 102 as may be desired. It is further envisioned that the tensioner 112 may be folded (or otherwise wrapped) and/or knotted one or more times, or may form at least a portion of a bow, as may be desired to enhance aesthetics. For example, a portion of the tensioner may be tied or otherwise configured to form a bow or other type of knot as may be desired. The knot may further restrict or prevent travel of any beads through which the tensioner 112 may pass as may be desired.

The tensioner 112 may further include one or more pull tabs suitable for grasping by a user as may be desired. For example, the one or more pull tabs may be coupled to and/or situated at a portion of the tensioner 112 that is situated at an exterior portion of the body 102.

It is envisioned that the tensioner 112 may be fixedly or slidably coupled to the platform 150. It is envisioned that when the tensioner 112 includes a cable tie or the like (e.g., a ribbon with teeth, etc.) or a portion thereof (e.g., a flexible toothed ribbon), one or more of the grommets 114 may include a coupler such as a ratchet or pawl which may be configured to engage a corresponding portion of the cable tie such a tooth and lock the cable tie in a desired position relative to the grommet 114. This may lock the platform 150 attached to the tensioner 112 in a desired position (e.g., fully or partially raised, etc.). It is envisioned that the tensioner 112 may be configured to engage the ratchet or pawl of the grommet 114.

In accordance with some embodiments it is envisioned that the tensioner may pass through openings of one or more beads. Thus, one or more portions of the tensioner 112 may include beads (e.g., be beaded). For example, one or more portions of the tensioner 112 that may be situated outside of the cavity 158 may include beads or be beaded (e.g., using pearls, stone beads, glass beads, and/or the like). It is also envisioned that the tensioner 112 may pass through on or more charms including openings through which the tensioner 112 may pass. The tensioner 112 may be knotted on one or both sides of the beads to lock the beads into a desired position relative to the tensioner 112. The beads may include natural beads (e.g., pearls, gems, stones, glass, etc.) and/or artificial beads (e.g., plastic, glass, epoxy, synthetic, etc.). Each of the beads may include an opening through which the tensioner may pass so as to be coupled thereto. In some embodiments, it is envisioned that portions of the tensioner may be coupled using a clasp or the like. For example, the clasp may be coupled to one or more portions of the tensioner that may be situated outside of the cavity. It is further envisioned that the beaded portion(s) of the tensioner may form a tab suitable for a user to grasp. It is envisioned that the beads may be formed integrally with, or separately from, the tensioner 112.

The platform 150 may include one or more receiving areas to receive the flower 102 such as a well 142, an opening, a notch, a cutout, and/or the like configured to receive and/or position at least a portion the flower 108. The platform 150 may further include couplers such as slots or openings in which a desired object such as a piece of jewelry, a jewelry box, an ornament, and/or the like, may be inserted. Accordingly, one or more pieces of jewelry (e.g. an engagement ring) may be coupled to the platform 150. For example, a ring may be coupled to the platform 150 adjacent to the flower 108 as may be desired.

An optional coupler 140 may be provided to couple the flower 108 to the platform 150 using any suitable method. For example, the optional coupler 140 may include one or more of an adhesive (e.g., see 146, FIG. 4A), one or more staples (148, 149), a nail, a pin, a tape, a string, a ribbon, and/or the like or other suitable fasteners which may be provided to couple at least a portion of the flower 108 to the platform 150 for use. With regard to the receiving areas, these areas may include a well which may be configured to receive, position, and/or stabilize, at least a portion of the flower 108. With regard to the adhesive, this adhesive may be selected such that it may be compatible for use with the flower 108 and/or a material of the platform 150.

The platform 150 may be formed from any suitable material such as a foam (e.g., floral foam and/or the like), cardboard, polymers, plastic, and/or the like, and/or combinations thereof. A rigidity enhancing member may be situated within, or attached to, the platform 150 to increase rigidity of the platform 150. In accordance with some embodiments, the adhesive may be optional and may provide a sufficient bond to couple the flower 108 to the platform 150. It is further envisioned that an orientation of one or more of the staples 148 and 149 may be positioned in an orientation other than vertical as shown.

The platform 150 may be shaped and/or sized such that it may be slidably received within the cavity 158 and may include one or more of a top wall 161, a bottom wall, and a side wall. The top wall may be configured to receive the flower 108. For example, the top wall 161 may include the receiving area such as an opening or the well 142 to receive the flower 108. During use, the platform 150 may telescope relative to one or more portions of the body 102 such as an interior portion 119 of the side wall 118 as illustrated by arrow 171.

The flower 108 may include one or more flowers and may include a natural flower which may be preserved, if desired, using any suitable preservation method or methods. However, it is also envisioned that one or more of the flowers 108 may include an artificial flower.

Although only a single flower 108 is shown, it is envisioned that a plurality of flowers of the same or of different types, species, varieties, parts and/or portions thereof may be provided. For example, the flower 108 may include any suitable flower such as a rose, a rose bud, a marigold, etc. Thus, it is envisioned that the flower 108 may include portions of any suitable plant(s) and/or flowers thereof. For example, a rose or rose bud is shown.

In some embodiments, the flower 108 may include other portions of a corresponding plant such as leaves (e.g., the leaflets), stems, hips, etc., as may be desired. For example, if the flower 108 includes a rose, it may include other portions of the rose plant such as the rose hip, stem, and/or leaflets as may be desired. Further, it is envisioned that the flower 108 may include portions of ornamental plants as may be desired with or without a flower. For example, the flower 108 may include a floral arrangement and/or an arrangement of one or more flowers, grasses, succulents, trees, brushes, and/or shrubs.

In accordance with some embodiments, it is envisioned that portions of the flower 108 such as a stem (if provided) or the like may pierce and/or be embedded in the platform 150 so as to be coupled to the platform 150. For example, ornamental stems and/or leaves may be situated about the flower 108 so as to form a floral arrangement.

The cavity 158 and/or the platform 150 may be shaped and/or sized such that a desired amount of friction may be provided to prevent undesirable movement of the platform 150 during use, storage, and/or shipping. Accordingly, friction (e.g., asperity, etc.) between the platform 150 and/or the side wall 118 (or interior portion 119 thereof) may be varied to control position and/or movement of the platform 150 relative to the body 102. This may provide for an interference fit between the platform 150 and an adjacent portion of interior portion 119 of the side wall 118 within the cavity 158. In some embodiments, it is envisioned that other portions of the system such as the tensioner 112 and the corresponding opening 116 or grommet 114 may provide a desired amount of friction to maintain a position of the platform 150.

It is envisioned that the side wall 118 may include an indentation such as a notch or protrusion such as a tab or flange or other type of embossing which may couple to a corresponding protrusion or indentation on the platform 150 so as to hold the platform 150 in a desired position relative to the body 102 such as a in a fully or substantially raised or recessed positions when desired.

It is further envisioned that a guide such as a rail, a bracket (e.g., an "L" shaped bracket, etc.), a tube, or the like may be located within the cavity 158 of the body 102 and may be configured to guide the platform 150 and/or prevent rotation of the platform 150 along one or more axes within the cavity 158 as may be desired. For example, the guide may be coupled to, and may extend along a height of side wall 118 (e.g., from the top wall 152 to the bottom wall 153 of the side wall 118) such that it extends along a path of travel of the platform 150 (e.g.; in a direction indicated by arrow 171) and may act as a guide which may guide the platform 150 as it is raised or lowered within the cavity 158. The platform 150 may include one or more corresponding areas which may be shaped and/or sized to receive the guide.

The cover 130 may be shaped and sized so as to cover at least a portion of the cavity 158 of the body 102 and may be removably attached to the body 102. The cover 130 may include one or more of a top wall 132 and at least one side wall 134. The cover 130 may be removed prior to raising the flower 108 from the cavity 158. The cover 130 may be secured to the body 102 using any suitable method or methods such as an interference fit, tabs, notches, tapes, etc.

A holding mechanism may be provided to hold the platform 150 and/or the flower 108 attached thereto in a desired position relative to the side wall 118 of the body 102 when the platform 150 is raised such as when it is in a display position (e.g., when the platform 150 is fully or substantially raised relative to the body 102). The holding mechanism may employ any suitable holding mechanism such as an interference fit (e.g., a friction fit), a latch, a detent or detents, dimples, magnetic couplers, and/or the like and/or combinations thereof. For example, the holding mechanism may employ an interference fit between adjacent portions of the platform 150 (e.g., a side wall of the platform 150) and the side wall 118 of the body 102. It is envisioned that the holding mechanism may further include one or more protrusions (e.g., dimples, studs, flanges, etc.) and/or pawls at the side wall 118 of the body 102 which may engage corresponding portions on the platform 150, and/or vice versa. For example, a protrusion in the side wall 118 of the body 102 may engage a depression or dimple in an adjacent portion of the platform 150 so as to lock the platform 150 in a desired position relative to the side wall 118 of the body 102. It should be appreciated that an interior portion of the grommet 114 may form at least a portion of a dimple or protrusion which may engage a corresponding portion of the platform 150 to hold the platform 150 in a desired position or positions relative to the body 102 as may be desired. In yet other embodiments, it is envisioned that one or more magnetic couplers may be provided to couple the platform 150 in one or more positions (e.g., fully or substantially recessed and/or raised) relative to the body 102.

Figure 1B:
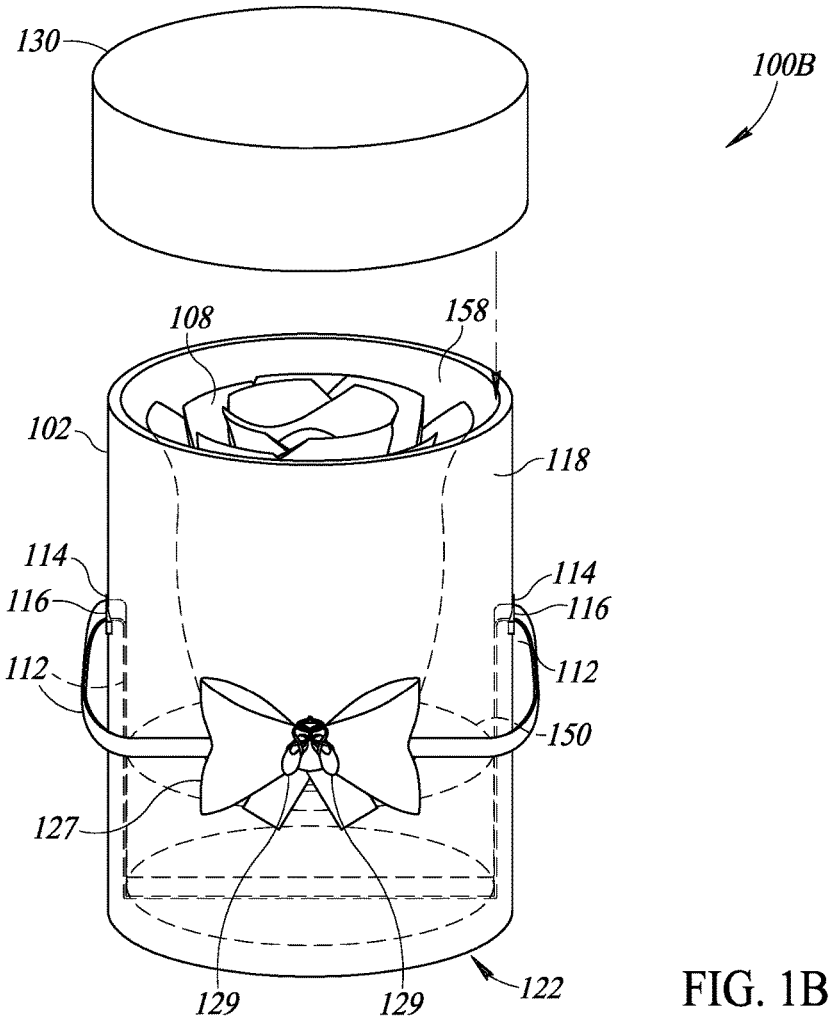
FIG. 1B is a diagram illustrating a partially exploded perspective front view of a portion of an example flower container system of the present invention according to a second embodiment.

In accordance with embodiments of the invention, the tensioner 112 may be configured to extend at least partially across the side wall 118 rather than the bottom wall 122 of the body 102 as illustrated with reference to FIG. 1A. This is illustrated with reference to FIG. 1B which is a diagram illustrating a partially exploded perspective front view of a portion of an example flower container system (hereinafter system 100B for the sake of clarity) of the present invention according to a second embodiment.

The system 100B may be similar to the system 100A and may include one or more of the body 102, the flower 108, the platform 150, the tensioner 112, and the cover 130 as discussed with reference to the system 100A. The tensioner 112 may be configured such that it may pass along the side wall 118 of the body 102 rather than under the bottom wall 122 of the body 102.

It is envisioned that ornamentation such as one or more of a bow, a charm, a trinket, a pendant, a ring, a buckle, and/or the like and/or combinations thereof (which may hereinafter be commonly referred to as a charm for the sake of clarity unless the context indicates otherwise) may be attached to, or formed integrally with, the tensioner 112. For example, a bow 127 may be coupled to the tensioner 112 using any suitable coupler. For example, the bow 127 may be coupled to the tensioner 112 using an adhesive (e.g., double sided tape or the like, a thermo adhesive, a magnetic coupling, etc.), a thread, a staple, an interference fit, a loop, a pin, etc.

It is envisioned that portions of the tensioner 112 may be configured to form at least a portion of the bow or the like. It is further envisioned that ornamentation may be attached to the tensioner 112 or to each other. For example, it is envisioned that a charm 129 (or charms) may be coupled to the bow 127. The charm 129 may include one or more of a ring (e.g., an engagement ring, etc.), a jewel, an animal, a letter, a name, a word, a shoe (e.g., baby shoes, etc.), a graduation cap, etc. (hereinafter each of which may be commonly referred to as a charm).

Figure 2:
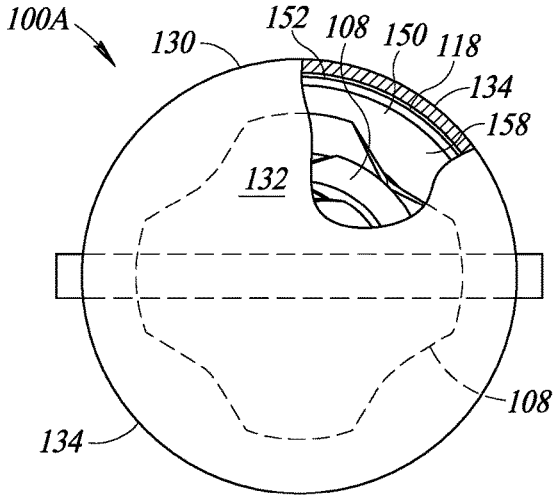
FIG. 2 is a diagram illustrating a partially cutaway top view of a portion of the system of the present invention.

The charm 129 may be coupled to one or more portions of the tensioner 112 and/or bow 127 using any suitable method such as an adhesive (e.g., double sided tape, a thermo adhesive, etc.), a thread, a staple, an interference fit, a loop, a pin, etc. When attaching a bow to the tensioner 112, it may be desirable to situate portions of the tensioner 112 on the side 118 of the body 102 between the openings 116 rather than under the bottom wall 122 of the body 102. FIG. 2 is a diagram illustrating a partially cutaway top view of a portion of the system 100A of the present invention. The cover 130 is seen releasably attached to the body 102 so as to cover at least a portion of the flower 108 situated within the cavity 158 of the body 102.

Figure 3:
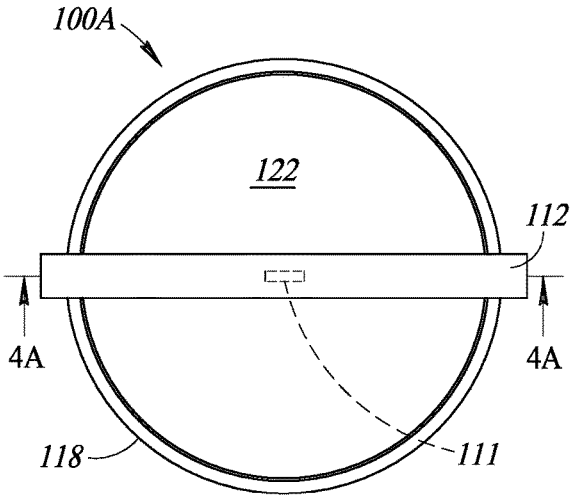
FIG. 3 is a diagram illustrating a bottom view of a portion of the system of the present invention.

FIG. 3 is a diagram illustrating a bottom view of a portion of the system 100A of the present invention. The tensioner 112 may extend about and couple to the bottom wall 122 of the body 102 using any suitable coupler such as an adhesive 111. Thus, the tensioner 112 may continuously extend between the openings 116.

In some embodiments it is envisioned that the tensioner may be discontinuous between the openings 116 within the cavity 158 and/or externally of the body 102. In yet other embodiments, it is envisioned that the tensioner may be formed from one or more discrete portions as opposed to a single portion of a suitable material (e.g., ribbon, etc.). For example, in some embodiments the tensioner may include first and second tensioners each extending between proximal and distal ends. The first and second tensioners may extend through corresponding openings 116 of the body 102 such that the proximal ends may be situated within the cavity 158 and may be coupled to the platform 158. The distal ends may be situated externally of the body 102 and may have a size and a shape such that they are suitable for grasping by a user to raise the platform 150 coupled thereto. In yet other embodiments, it is envisioned that the distal ends may be coupled to each other.

Figure 4A:
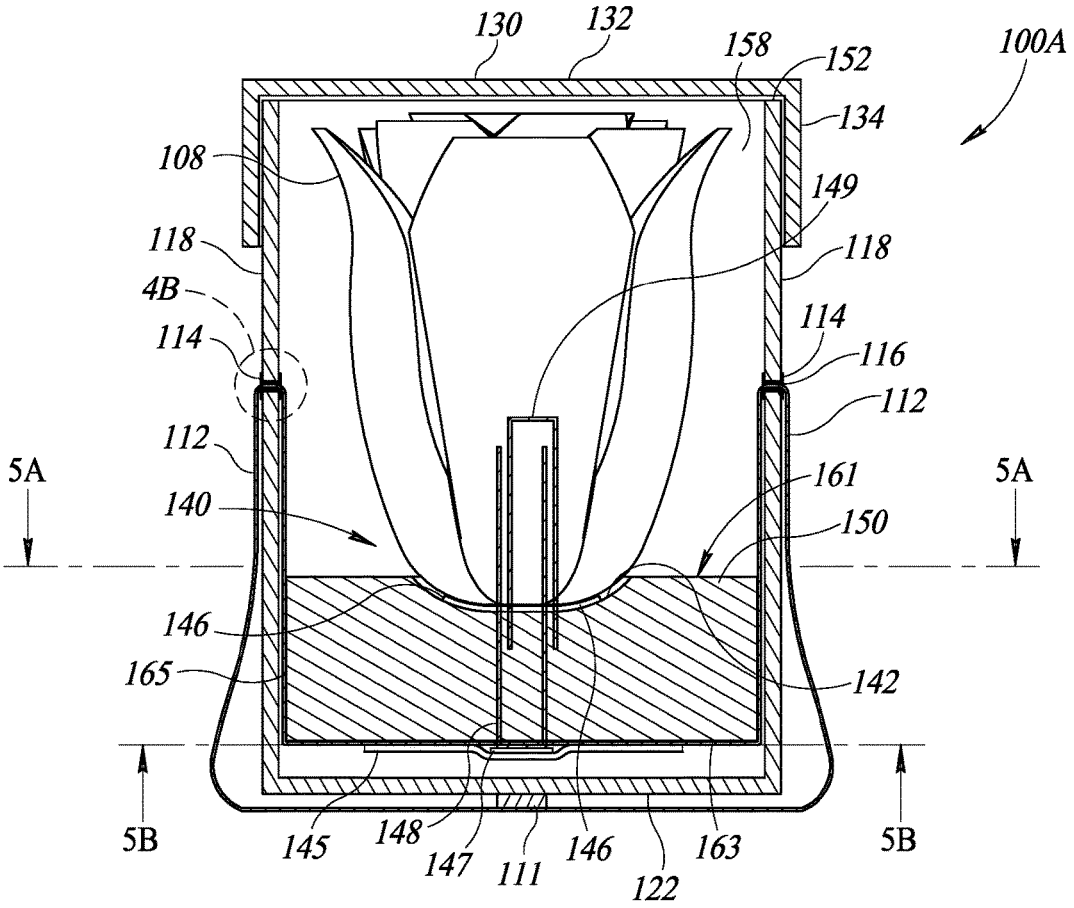
FIG. 4A is a diagram illustrating a cross-sectional view of a portion of the system of the present invention taken along lines 4A-4A of FIG. 3.

FIG. 4A is a diagram illustrating a cross-sectional view of a portion of the system 100A of the present invention taken along lines 4A-4A of FIG. 3. The cover 130 may be removably attached to the body 102 using any suitable coupling such as an interference fit. The platform 150 is shown in a lowered (e.g., stored or fully or substantially recessed) position in which the flower 108 is situated partially or fully within the cavity 158 of the body 102. The tensioner 112 may extend through the grommets 114 of the openings 116 and may be coupled to body 102 outside of the cavity 158 using any suitable method such as the adhesive 111.

The grommets 114 may be formed from any suitable material such as plastic, metal, and/or the like and may be coupled to the body 102 using any suitable method such as interference fits, adhesives, compression fits, etc.

The well 142 of the platform 150 may be shaped and sized to position and/or couple the flower 108 to the platform 150.

The tensioner 112 may be coupled to the platform 150 using any suitable method. For example, the staples 148, 149 or other suitable fastener(s) (e.g. a nail, a pin, etc.) may couple the tensioner 112 to the platform 150. The staples 148, 149 may extend through the flower 108 to fasten it to the platform 150. In some embodiments, a coupler such as a cap 145 which may be configured to couple the tensioner 112 to the platform 150 and/or may raise a height of the platform 150 coupled thereto when the platform is inserted within the cavity 158 of the body 102. The diameter of the cap 145 may be the same as or may be smaller than a diameter of the platform.

In some embodiments, it is envisioned that any suitable coupling method such as an adhesive 147, a fastener, a bond (e.g., a friction weld, etc.), etc. may fixedly secure the tensioner 112 to the platform 150.

Figure 4B:
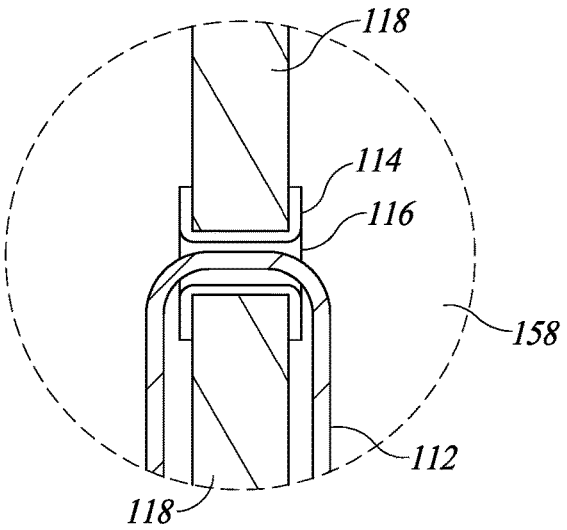
FIG. 4B is a diagram illustrating an enlarged view of a portion of region 4B of FIG. 4A in accordance with embodiments of the present system.

FIG. 4B is a diagram illustrating an enlarged view of a portion of region 4B of FIG. 4A in accordance with embodiments of the present system. One or more of the openings 116 may include the grommet 114 or the like (e.g., a cringle, an eyelet, etc.) through which the tensioner 112 may pass.

The grommet 114 may be configured to provide a desired amount of friction when the tensioner 112 passes therethrough. The grommet 114 may be continuous or discontinuous about a periphery of the corresponding opening 116 and may be configured to reduce or otherwise prevent abrasion of the tensioner 112 during use. The grommet 114 may be formed from any suitable material such as metal, plastic, a polymer, etc. For example, it is envisioned that the grommet 114 may be formed from one or more metal rings or collars which may be press fit, or otherwise deformed (e.g., by applying pressure thereto), to couple to adjacent portions of the side wall 118. After the grommet 114 is inserted into a corresponding opening 116, pressure may be applied across opposed faces of the grommet 114 such that a portion of the grommet 114 may be deformed or otherwise crushed such that it may be fully or substantially flush with an adjacent portion of one or more of an outer or inner surface of the side wall 118 and may be firmly held in place relative to the side wall 118. For example, it is envisioned that the grommet 114 may be formed from one or more materials which may be coupled to each other. In yet other embodiments at least a portion of the grommet 114 may be thermoformed.

In accordance with some embodiments, it is envisioned that a coupler may hold the grommet 114 in place relative to the body 102. Suitable couplers may include adhesives, tapes, glues, interference fits, tabs, and/or the like.

It is further envisioned that the grommet 114 may be of a snap-fit type in which it may be inserted into a corresponding opening 116 and may lock into place automatically using, for example, one or more deformable tabs which may lock into place against an adjacent portion or portions of the side wall 118 when the grommet 114 is placed into the corresponding opening 116.

Figure 4C:
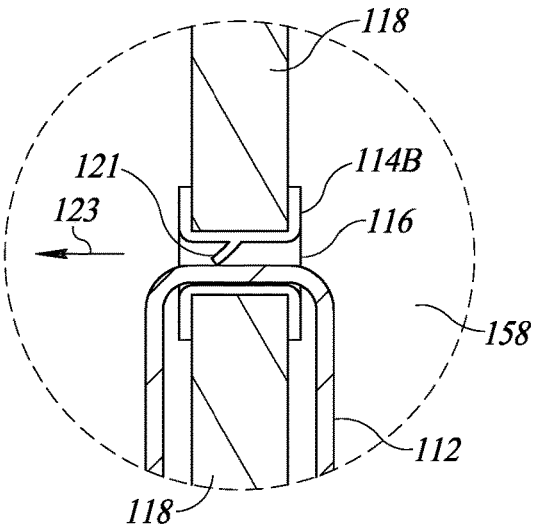
FIG. 4C shows a cross-sectional view of a portion of the grommet of FIG. 4B including at least one pawl.

It is envisioned that the grommets may include a holding mechanism which may provide for motion of the tensioner 112 in a single direction relative to the grommet 114. For example, FIG. 4C shows a cross-sectional view of a portion of the grommet 114 of FIG. 4B including at least one pawl 121. The pawl 121 may be configured to engage tensioner 112 so as to provide for motion of the tensioner 112 relative to the grommet 114 in a direction away from the cavity 158 as indicated by arrow 123 and may restrict, or entirely prevent travel of, the tensioner 112 in the opposite direction. This may lock the platform 150 in a raised position when desired such as after use by an end user. The pawl 121 may include a release tab which may be depressed to release the pawl 121 from the tensioner 112. This may provide for movement of the tensioner 112 in an opposite direction. It is further envisioned that the tensioner 112 may include teeth which may engage the pawl 121. It is further envisioned that pawls may be located on both sides of the tensioner 112. The orientation of the pawl with regard to the grommet 114 on the other side of the body 102 may be reversed with regard to the body 102 so as to provide for motion of the tensioner 112 relative to the corresponding grommet 114 in a direction away from the cavity 158 and may restrict or entirely prevent travel of the tensioner 112 in the opposite direction.

Figure 5A:
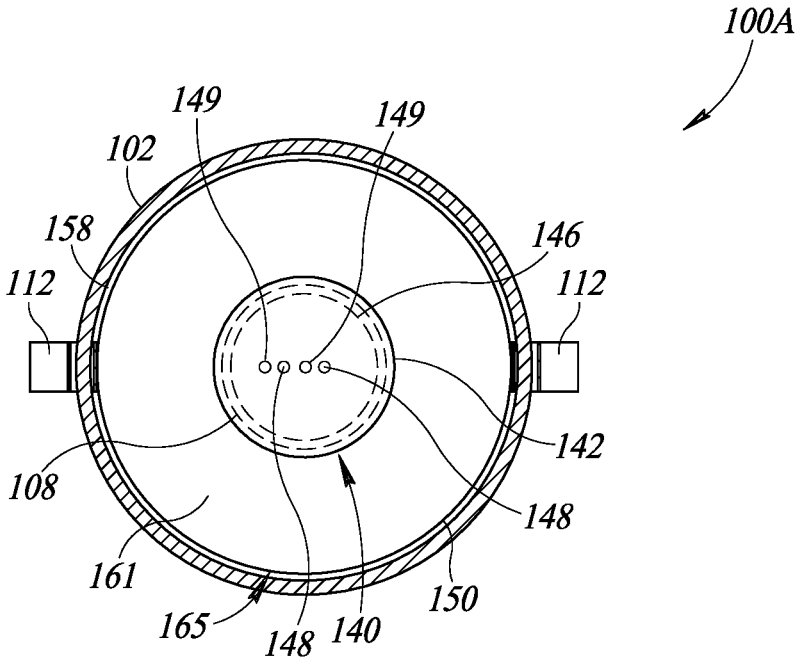
FIG. 5A is a diagram illustrating a cross-sectional view of a portion of the system of the present invention taken along lines 5A-5A of FIG. 4A.

FIG. 5A is a diagram illustrating a cross-sectional view of a portion of the system 100A of the present invention taken along lines 5A-5A of FIG. 4. The coupler 140 may include one or more of the adhesive 146 situated in the well 142 of the platform 150 and/or one or more of the staples 148, 149 which may extend through the platform 150. The platform 150 may be shaped and sized such that its side wall 165 may be configured to stabilize the platform 150 within the cavity 158 of the body 102. In yet other embodiments it is envisioned that the coupler 140 may include one or more pins.

Figure 5B:
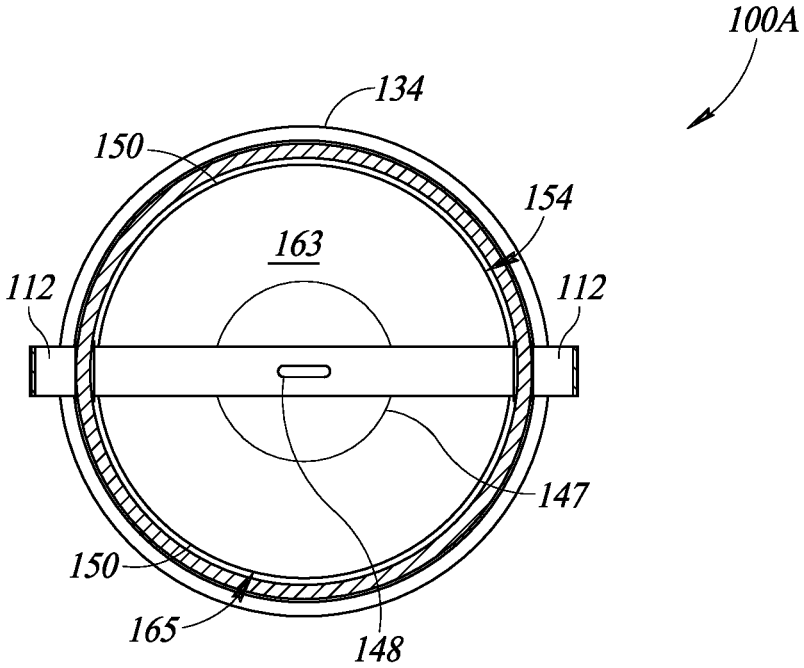
FIG. 5B is a diagram illustrating a cross-sectional view of a portion of the system of the present invention taken along lines 5B-5B of FIG. 4A.

FIG. 5B is a diagram illustrating a cross-sectional view of a portion of the system 100A of the present invention taken along lines 5B-5B of FIG. 4A. The staple 148 and/or the adehsive 147 may couple the tensioner 112 to the platform 150. It is envisioned that the staple 148 may extend through the tensioner 112 so as to couple the tensioner 112 to the platform 150. In yet other embodiments, it is envisioned that the tensioner 112 may be tied to the platform 150 or may be slidably coupled to the platform 150. In some embodiments the tensioner 112 may pass through a loop of the staple 148 such that it may be slidably coupled to the platform 150 by the staple 148. For example, it is envisioned that the platform 150 may include one or more of a notch, an opening, or a channel through which the tensioner 112 or portions thereof may pass so as to be fixedly or slidably coupled to the platform 150.

Figure 6A:
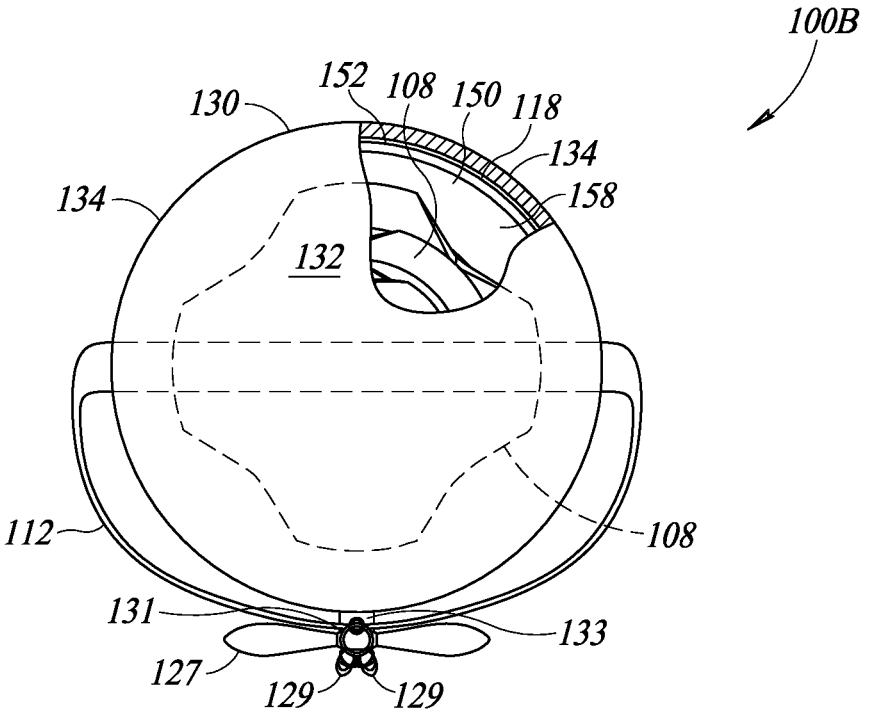
FIG. 6A is a diagram illustrating a partially cutaway top view of a portion of the system of the present invention.

FIG. 6A is a diagram illustrating a partially cutaway top view of a portion of the system 100B of the present invention. The cover 130 is seen releasably attached to the body 102 so as to cover at least a portion of the flower 108 situated within the cavity 158 of the body 102. The tensioner 112 may extend about the side wall 118 of the body 102 and may optionally include the bow 127 and one or more charms 129 attached thereto. The bow 127 may be coupled to the tensioner 112 using any suitable fastener. For example, the bow 127 may be coupled to the tensioner 112 using an adhesive 131 (e.g., double sided tape, a thermo adhesive, etc.), a thread, a staple, an interference fit, a loop, a pin, etc.

The one or more charms 129 may be coupled to the bow 127 using any suitable fastener. For example, the one or more charms 129 may be coupled to the tensioner 112 using an adhesive (e.g., double sided tape, a thermo adhesive, etc.), a thread, a staple, an interference fit, a loop, a pin, etc. It is envisioned the tensioner 112 may be coupled to side wall 118 of the body 102 using a coupler 133 such as an adhesive or the like. In some embodiments it is envisioned that the coupler 133 may include any other suitable coupler such as a magnetic coupler, an interference fit coupler, etc. The coupler 133 may be releasable and/or repositionable. For example, after the platform 150 is positioned in a raised position, the coupler 133 may position the tensioner 112 and/or the bow 127 in a desired position along the side wall 118. Such positioning, for example, may place couple at least a portion of the tensioner 112 such that a portion of the bow 127 may be situated at a level which may be even with the bottom wall 122 (or portions thereof) of the body 102 or between the top wall 152 (or top edge) and the bottom wall (e.g., 153) of the side wall 118 when the platform 150 is fully or substantially raised relative to the body 102.

Figure 6B:
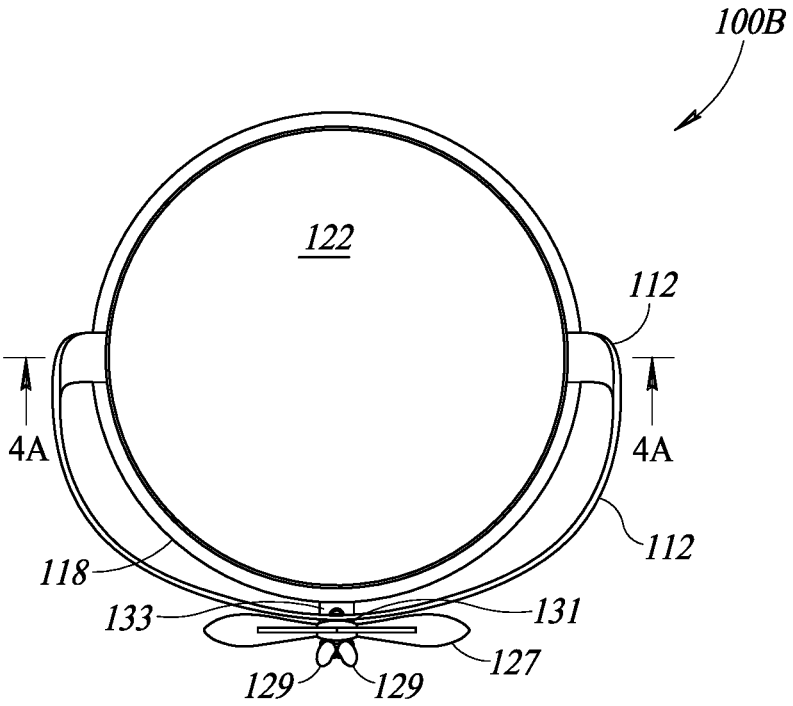
FIG. 6B is a diagram illustrating a bottom view of a portion of the system of the present invention.

FIG. 6B is a diagram illustrating a bottom view of a portion of the system 100B of the present invention. The tensioner 112 may extend about and may be coupled to the side wall 118 of the body 102.

Figure 7:
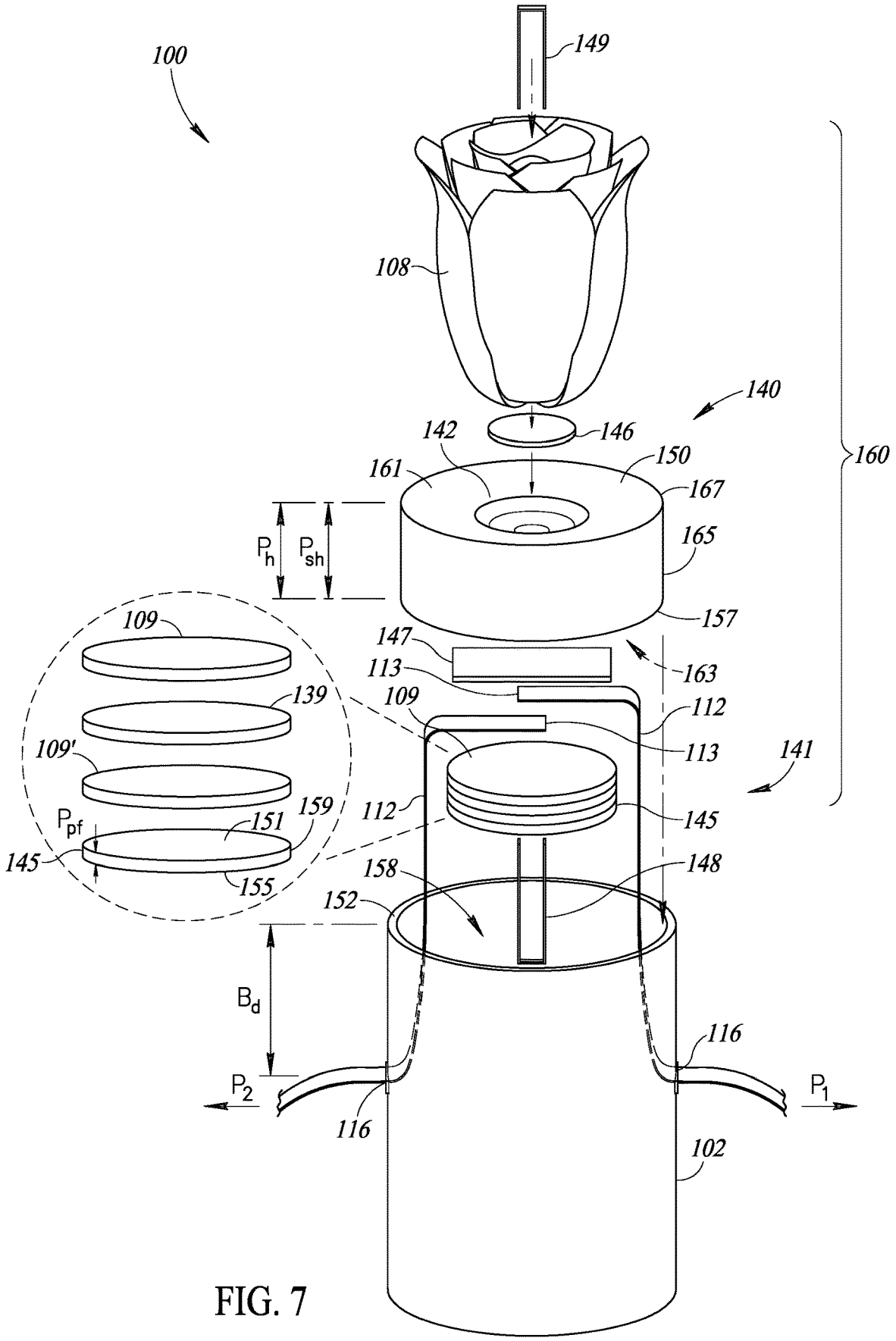
FIG. 7 is a diagram illustrating a partially exploded perspective front view of a portion of the system of the present invention.

FIG. 7 is a diagram illustrating a partially exploded perspective front view of a portion of the system 100A of the present invention. Portions of the tensioner 112 may extend through corresponding openings 116 of the openings 116. A coupler 141 may couple the tensioner 112 to the platform 150 and may include any suitable coupling method. The coupler 140 may couple the flower 108 to the platform 150 using any suitable coupling method. An assembly including the platform 150, the attached flower 108, and/or the tensioner 112 may be formed and thereafter portions thereof may be situated within or inserted into the cavity 158 of the body 102.

The coupler 140 may include one or more of the adhesive 146 and/or the staples 148, 149 which may couple the flower 108 to the platform 150. In some embodiments, the coupler 140 may include an opening in the platform 150 which may receive the flower or portions thereof such as an optional stem. For example, in some embodiments the optional stem of the flower 108 may be inserted into the platform 150.

It is envisioned that the coupler 141 may include any suitable method of coupling the tensioner to the platform 150 such as one or more of the staple 148, a bond, a weld, the adhesive 147 or the like, and/or the cap 145. For example, the tensioner 112 may be situated between the platform 150 and the cap 145 and may be secured to the platform 150 by the adhesive 147. It is further envisioned that the adhesive 147 may secure the cap 145 to the platform 150. In some embodiments it is envisioned that one or more of the tensioner 112 and/or the cap 145 may be secured to the platform 150 using any suitable bonding method such as an interference fit, a friction weld and/or the like. It is also envisioned that that the staple 148 may pass through and/or secure one or more of the cap 145, the tensioner 112, the adhesive 147, the platform 150, the adhesive 146, and the flower 108 to each other.

The cap 145 may have a diameter that may be similar to, or smaller than, the diameter of the platform 150. It is envisioned that the cap 145 may include a top wall 151, a bottom wall 155, and a side wall 159 situated between the top wall 151 and the bottom wall 163. The cap 145 may have a height ($P_{pf}$) which may be configured to set a height of the platform 150 and the flower 108 attached thereto to a desired height. For example, this height may be set such that a top of the flower 108 may be at or below the top wall 152 (or top edge) of the body 102. It would be appreciated that other heights are also envisioned. For example, it is envisioned that the height $P_{pf}$ may be sufficiently small such that the cap 145 may be a thin film or the like. It is envisioned that the side wall may optionally contact the side wall 118 of the body 102. The cap 145 may include one or more edges situated between the side wall and one or more of the top and bottom walls 151 and 155, respectively, that may include a chamfer or round or the like to enhance ease of insertion of the platform 150 into the cavity 158. The cap 145 may be formed from any suitable material such as a foam or the like. In some embodiments, it is envisioned that the cap 145 may be formed from other suitable materials such as cardboard, foam, polymers (e.g., plastic), wood, metal, etc.

The cap 145 may be shaped and/or sized similarly to the platform 150 with the same or a different thickness such that it may fit within the cavity 158 of the body 102. It would be appreciated that other shapes and/or sizes are also envisioned for the cap 145. For example, it is envisioned that the cap 145 may be formed from a strip (e.g., a foam strip, a plastic strip, etc.) or may be shaped and/or sized like a figure "X," etc.

In some embodiments, an optional rigidity enhancing member 139 may be provided to increase rigidity of the platform 150 or portions thereof as may desired. The rigidity enhancing member 139 may sandwiched between, and coupled to, the platform 150 and the cap 145 using any suitable method or methods such as adhesive layers 109 and 109', etc. In yet other embodiments, it is envisioned that the rigidity enhancing member 139 may be formed integrally with the cap 145. In some embodiments it is envisioned that the rigidity enhancing member 139 may be situated at other locations such as within the platform 150, between the tensioner 112 and the platform 150, etc. In yet other embodiments, the cap 145 may be coupled to the platform 150 using a single adhesive layer (e.g., layer 109).

It would be further appreciated that the coupler 141 may secure optional ends 113 of the tensioner 112 to each other and/or to the platform 150. For example, the adhesive 147 and/or an adhesive 109 may secure the optional ends 113 of the tensioner to each other. Although a lap-type joint is shown joining ends 113 of the tensioner 112 other types of joints may be employed such as a but-type joint, etc. It is further envisioned that the ends 113 of the tensioner 112 may be coupled to platform 150 such that they may be separated from each other. For example, in some embodiments the ends 113 of the tensioner may be situated and/or coupled to a bottom wall 163 or a side wall 165 of the platform 150.

In some embodiments, it is envisioned that ends of the tensioner 112 may be situated outside of the cavity 158 and secured to each other using any suitable method such as a friction bond, a thermal bond, an adhesive, a stitch, a rivet, a screw, a clasp, a ring, etc. It is further envisioned that the tensioner 112 may be formed in a loop without ends. Although the optional ends 113 of the tensioner 112 are shown overlapping to form a lap-type join, other types of joins are also envisioned. In some embodiments, it is envisioned that ends of the tensioner may be situated apart from each other and coupled to the platform 150 such that the assembly including the platform 150 and the tensioner 112 attached thereto forms at least a portion of the loop. For example, ends of the tensioner 112 may be coupled to the side wall of the platform 150.

The platform 150 may include a top wall 161, the bottom wall 163 and the side wall 165 situated between the top wall 161 and the bottom wall 163. The side wall 165 may have a height $P_h$ and may be configured to contact the side wall 118 of the body 102. The platform 150 may include edges 157, 167 between one or more of the side wall 165, and the top or bottom walls 161 and 163, respectively. The edges 157, 167 may include a chamfer or round which may enhance ease of insertion of the platform 150 into the cavity 158. It would be further appreciated that one or more of the side wall 165 and/or the chamfered edges 157, 167, may be configured to reduce or prevent friction such as static friction (e.g., stiction) between the platform 150 and the side wall 118 of the body 102 when moving the platform 150 relative to the body 102. For the sake of clarity, it will be assumed that the height of the side wall 165 that may contact the side wall 118 of the body 102 between the edges 157 and 167 may be defined as the platform skirt height ($P_{sh}$). Increasing a length of $P_{sh}$ may increase stability of the platform 150 within the cavity 158 of the body 102. For the sake of clarity, it will be assumed that $P_{sh}$ may be equal to, $P_h$. In yet other embodiments, it should be understood that $P_h$ may be smaller than $P_{sh}$ when the edges 157 and/or 167 include a round or a chamfer as may be desired.

The openings 116 may be positioned substantially opposite each other at a distance $B_d$ from the top wall 104 of the body 102 such that $B_d$ may be greater than, or equal to, $P_h$. For example, $B_d$ may be substantially equal to $P_h$ such that the top wall 161 of the platform 150 may be raised to about the top wall 104 of the body 102 when the tensioner 112 is tensioned by pulling portions of the tensioner 112 which extend from corresponding openings 116 in opposite directions as illustrated by arrows P1 and P2. This may shorten that length of the tensioner 112 that is in the cavity 158 so as to raise the platform 150. In some embodiments, it is envisioned that $B_d$ may be less than $P_h$ which may raise the height of the platform 150 relative to the body 102 when fully raised as opposed to embodiments in which $B_d$ may be substantially equal to $P_h$. It would be appreciated that other relationships and/or values of $B_d$ and $P_h$ are also envisioned.

Figure 8A:
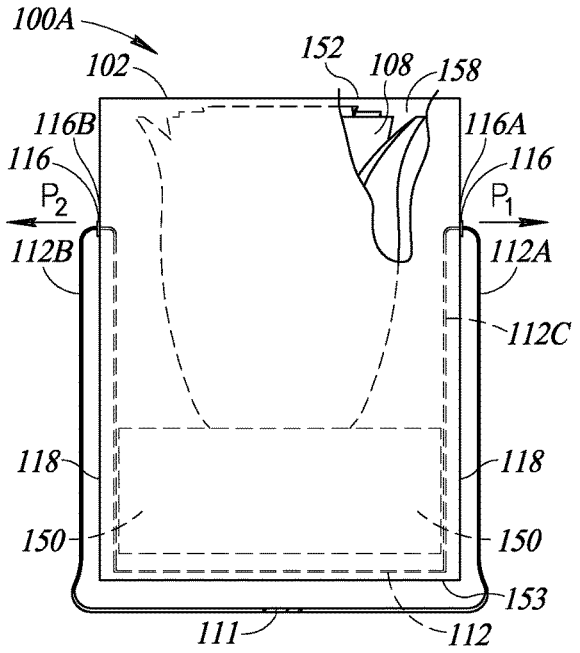
FIG. 8A is a diagram illustrating a partially cutaway front view of the body of the system of the present invention with the cover removed and the platform in a fully recessed position.
Figure 9:
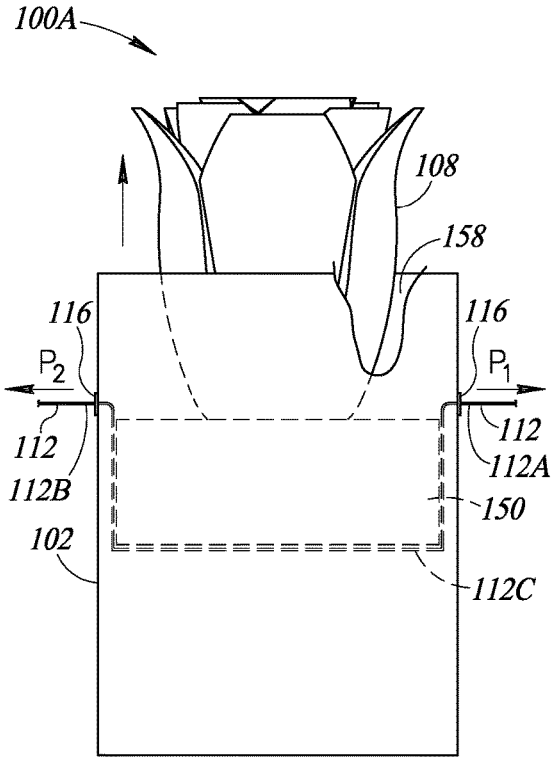
FIG. 9 is a diagram illustrating a partially cutaway front view of the body of the present system of the present invention with the cover removed and the platform in a partially raised position.
Figure 10:
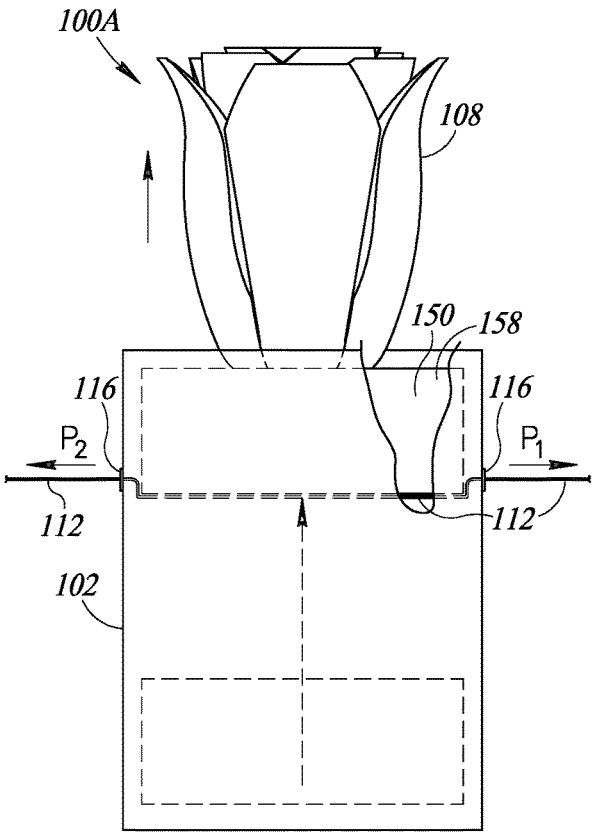
FIG. 10 is a diagram illustrating a partially cutaway front view of the body of the present system of the present invention with the cover removed and the platform in a substantially raised position.

A process of raising the platform of the system 100A will now be described with reference to FIGS. 8A and 9 through 10 below wherein FIG. 8A is a diagram illustrating a partially cutaway front view of the body 102 of the system 100A of the present invention with the cover 130 removed and the platform 150 in a fully recessed position; FIG. 9 is a diagram illustrating a partially cutaway front view of the body 102 of the system 100A of the present invention with the cover 130 removed and the platform 150 in a partially raised position; and FIG. 10 is a diagram illustrating a partially cutaway front view of the body 102 of the system 100A of the present invention with the cover 130 removed and the platform 150 in a substantially or fully raised position. The operation of the system 100B may be similar to the operation of system 100A. Accordingly, the operation of system 100A may be understood to apply to the operation of system 100B. With reference to FIG. 8A, a user may grasp portions of the tensioner 112 which extend outward from the openings 116 on either side of the body 102. The user may then pull the grasped portions of the tensioner 112 in opposite directions as illustrated by arrows P1 and P2 of FIG. 9. This may shorten a portion of the tensioner that is within the cavity 158 and at the same time be operative to cause the tensioner 112 to apply a force which may raise the platform 150 and the flower 108 attached thereto as illustrated in FIG. 9. With reference to FIG. 10, continued pulling of the tensioner 112 in opposite directions as illustrated by arrows P1 and P2 may cause the tensioner 112 to continue to apply a force which may raise or otherwise elevate the platform 150 and the flower 108 attached thereto to a fully raised position as illustrated. The shape and/or size of the platform 150 and the body 102 may be configured such that an interference fit suitable to maintain the fully raised position of the platform 150 may be maintained. In some embodiments it is envisioned that an interference fit of the tensioner 112 and the corresponding openings 116 may establish sufficient friction to maintain the fully raised position of the platform 150 relative to the body 102. In some embodiments, it is envisioned that a locking member such as an interference fit, a mechanism such as a tab, and/or a notch may be provided to lock the platform 150 in position relative to the body 102.

Figure 8B:
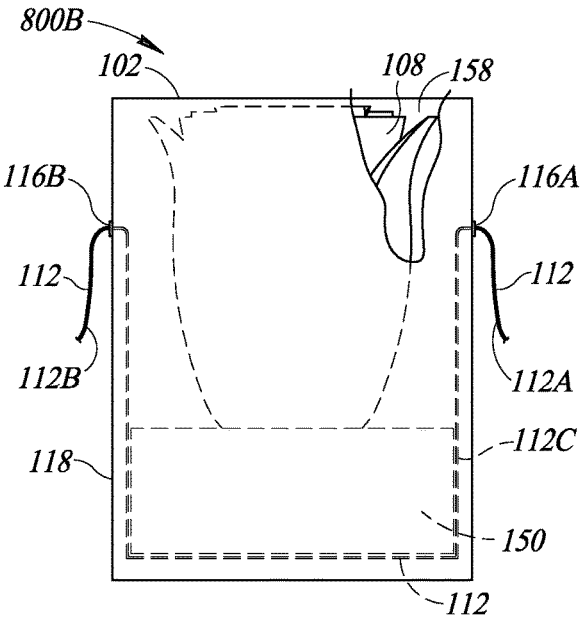
FIG. 8B is a diagram illustrating a partially cutaway front view of the body of the system of the present invention with the cover removed and the platform in a fully recessed position.

Depending upon embodiments, the tensioner may be fixedly or slidably secured to the platform. In accordance with some embodiments of the present system, the tensioner may be slidably secured to the platform. This configuration may enable the platform to be raised or substantially raised relative to the body by pulling on one or both sides of the tensioner. Embodiments in which it will be assumed that only a single side of the tensioner will be pulled and the other side of the tensioner may remain in position relative to the body will now be discussed with reference to FIG. 8B which is a diagram illustrating a partially cutaway front view of the body 102 of a system 800B of the present invention with the cover 130 removed and the platform 150 in a fully or substantially recessed position. The system 800B may be similar to the system 100A shown in FIG. 8A with a tensioner 112 that may be slidably secured to the platform 150 rather than fixedly secured. A coupler such as the adhesive 111 may couple a portion of the tensioner 112 to the body 102. Portions of the tensioner 112 that are on the outside of the body 102 and on either side of the adhesive 111 (or coupler) may be denoted as tensioners 112A and 112B as shown. That portion of the tensioner 112 that is within the cavity 158 may be referred to as portion 112C. Sizes of portions of the tensioner (e.g., 112A, 112B, and 112C) may change as portions of the tensioner 112 are pulled through a corresponding opening such as an opening 116A in the present embodiment, For example, when a portion 112A of the tensioner 112 is pulled (e.g., by a user) in the direction of arrow P1, this pulling may cause portions of the tensioner 112 that are situated within the cavity 158 to pass through the opening 116A thus shortening portion 112C that is situated within the cavity 158. Continued pulling and resultant travel of the tensioner 112A in the direction of arrow P1 may further shorten section 112C (or sections 112C) within the cavity 158 and may raise the platform 150 to the fully or substantially raised position such that the flower 108 attached thereto may be situated in a display position. Thus, the platform 150 may be elevated and/or suspended by that portion of the tensioner 112 that is situated within the cavity 158 (e.g., 112C) and may be supported by the side wall 118 of the body 102 between the openings 116 (e.g., 116A and 116B). During this operation, the coupler 111 may maintain (or substantially maintain) a position of that portion 112B of the tensioner 112 such that there is little or no movement of the tensioner 112 through the opening 116B. An interference fit between the platform 150 and adjacent portions of the body 102 may secure the platform 150 in position relative to the body 102 once raised.

Figure 8C:
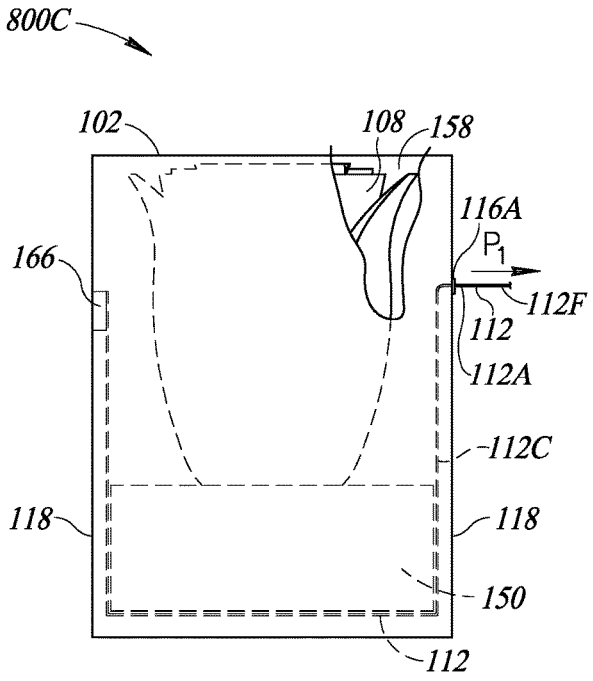
FIG. 8C is a diagram illustrating a partially cutaway front view of the body of a system of the present invention with the cover removed and the platform in a fully recessed position.

As there is little or no movement of the tensioner 112 through the opening 116B, a portion of the tensioner 112 may be secured to the wall 118 of the body 102 and the tensioner 112 may only need to pass through a single opening. This is illustrated with reference to FIG. 8C which is a diagram illustrating a partially cutaway front view of the body 102 of a system 100C of the present invention with the cover 130 removed and the platform 150 in a fully recessed position. The system 800C may be similar to the system 800B shown in FIG. 8B with a tensioner 112 that may be slidably secured to the platform 150. The tensioner 112 may be secured to the wall 118 at a location that is opposite opening 116A through which the tensioner 112 may pass. The tensioner 112 may be secured to the wall 118 of the body 102 at a location that is inside (as shown) or outside of the cavity 158 using any suitable coupler, such as an adhesive 166, a bond, a weld, a screw, a stud, a rivet, a stitch, etc. Operation of raising the platform 150 by pulling on the tensioner 112 (at its free end 112F) in the direction of arrow P1 may be similar to that described above with reference to FIG. 8B. For example, a user may grasp a free end 112F of the tensioner 112 and pull it in the direction of arrow P1 to raise the platform 150.

Figure 11:
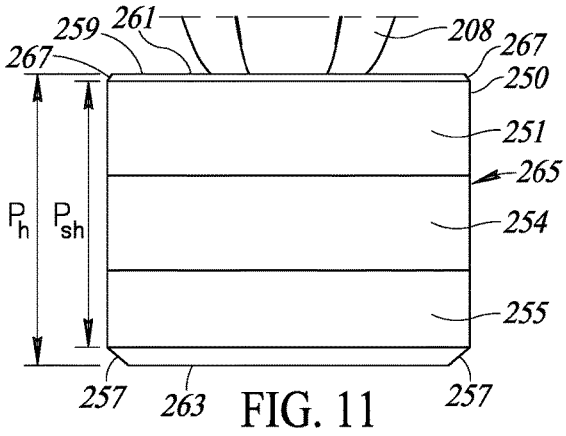
FIG. 11 is a diagram illustrating a front view of a portion of an example platform of the present invention.

FIG. 11 is a diagram illustrating a front view of a portion of an example platform 250 of the present invention. The platform 250 may be coupled to at least one flower 208 and may be similar to the platform 150. The platform 250 may include a top wall 261, a bottom wall 263, and a side wall 265 and may be formed from a plurality of layers superimposed upon and coupled or laminated to each other such as layers 251, 254, 255, and 259. The layers 251, 254, 255, and 259 may be formed from the same or different materials. These materials may have the same or different characteristics (e.g., rigidity, density, weight, firmness, etc.) and may be coupled to each other using any suitable method or methods such as adhesive bonding, chemical bonding, electrostatic bonding, heat bonding, friction welding, friction fitting, nailing, screwing, pegs, magnetic bonding, etc. Adding layers may enhance characteristics of the platform 250 and/or may increase a height $P_h$ (e.g., a total height) and/or a skirt height $P_{sh}$ of the platform 250 as shown. Edge 267 may be situated between the top wall 261 and the side wall 265, and edge 257 may be situated between the bottom wall 263 and the side wall 265.

One or more of the edges 257 and 267 may be chamfered, rounded, filleted, or square as may be desired and may be the same as or different (e.g., in size, angle, round, etc.) from each other. For example, edge 257 may be square and edge 267 may be chamfered as shown. In accordance with some embodiments, one or more of layers may include a foam and/or rigidity enhancing layer.

In some embodiments, one or more of the layers (e.g., 251, 254, 255, and/or 259), may include foam, cardboard, plastic, foil, fabric, leather, ceramic, glass, etc. A thickness (e.g., as measured in relation to the height of the platform 250) of one or more of the layers 251, 254, 255, and 259 may be varied to increase and/or decrease the height $P_h$ of the platform 250. This may be desirable to match the height of the platform to a height of a corresponding flower 208 and/or body such that when the platform 250 is fully recessed in the body the top of the flower may be at a desired height relative to the top of the body as may be desired. This may enhance aesthetics of the package. One or more of the edges 257 and 267 may be chamfered to aid in alignment and/or insertion of the platform 250 within the body.

With regard layer 259, this layer may be a finishing layer which may provide desired aesthetics and may be formed from any suitable material such as leather, fabric (e.g., velvet which may be electrostatically deposited, etc.), plastic, metal (e.g., aluminum, stainless steel, etc.), ceramic, cardboard, paper, glass (e.g., mirrored glass, etc.), and/or the like and may form at least part of the top wall 261 of the platform 250. With regard to one or more of the layers 254, 255, and 259 these layers may be selected as desired. For example, layers closer to the bottom wall 263 may be firmer than those closer to the top wall 261. This may maintain a shape of the platform 250 as tension is applied to the tensioner when the platform 250 is raised in the body. A low-friction surface may be applied to one or more of the layers 251, 254, 255, and 259. For example, the edge 257 may include a low friction layer to reduce friction between the platform 250 and a tensioner in contact with the platform 250. This may reduce a force necessary to be applied to the tensioner when raising the platform 250 situated within a body for display of the flower 208.

It should be appreciated that stability of the platform 250 within a body may be increased by increasing the length of the platform skirt height $P_{sh}$ which may prevent the rocking of the platform 250 when it is inserted within the cavity of the body according to embodiments of the present system. The platform 250 may be shaped and sized such that it may correspond with a shape and size of a receiving body in accordance with embodiments of the present system and may have a snug fit such that an interference fit may be maintained between the platform 250 and the body in which it is located.

In accordance with embodiments of the present system, it is envisioned that a platform may be formed from a cardboard material such as corrugated cardboard which may be rolled in a spiral to form the desired shape and may be coupled to a flower. In yet other embodiments, the platform may be formed using a plurality of layers of cardboard that may be laminated upon each other.

Figure 12:
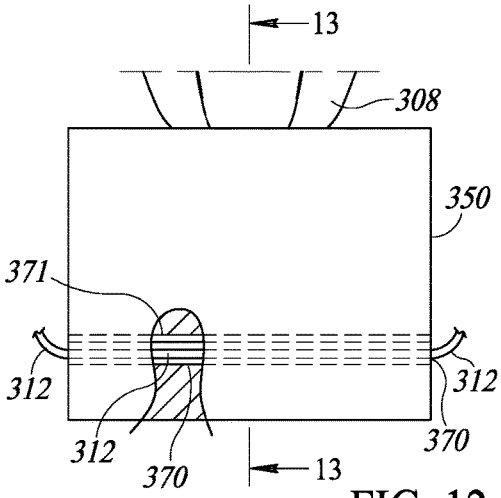
FIG. 12 is a diagram illustrating a partially cutaway front view of a portion of an example platform of the present invention.

FIG. 12 is a diagram illustrating a partially cutaway front view of a portion of an example platform 350 of the present invention. The platform 350 may include an opening or cutout such as a channel 370 which may be configured to receive a tensioner 312. Accordingly, the tensioner 312 may pass, entirely or partially, through the channel 370. The tensioner 312 may be fixedly or slidably located relative to the channel 370. For example, tensioner 350 may be secured within the channel 370 using any suitable coupling method such as an interference fit, an adhesive, a staple, and/or the like so as to be fixedly secured within the channel 370.

In some embodiments, the tensioner 312 may be slidably located within the channel 370. The channel 370 may include a low-friction surface to enhance movement of the tensioner 312 relative to the channel 370. It is envisioned that the low friction surface may be deposited upon one or more surfaces of the channel 370 in contact with the tensioner 312 or may be provided by a solid (e.g., a strip or strips) or a tubular member (e.g., a Teflon™ tube) situated within the channel 370. The tensioner 312 may pass through the tubular member. The tubular member may have a cross sectional shape which may correspond with a cross section of the channel 370. It is envisioned that this cross sectional shape may be any suitable shape such as square, round, oval, rectangular, etc. as may be desired.

Figure 13:
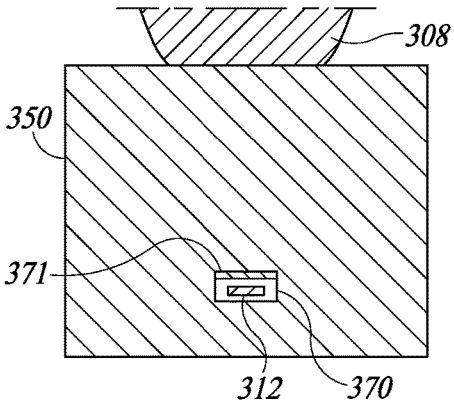
FIG. 13 is a diagram illustrating a cross-sectional view of a portion of the example platform the present invention taken along lines 13-13 of FIG. 12.

FIG. 13 is a diagram illustrating a cross-sectional view of a portion of example platform 350 the present invention taken along lines 13-13 of FIG. 12. The channel 370 may include a rigid layer 371 which may be configured to enhance rigidity of one or more walls of the channel 370 such as an upper wall 370. The rigid layer 371 may include a friction-reducing layer (e.g. a low friction surface). The tensioner 312 may be coupled to platform 350 using any suitable method (e.g., bonding, adhesives, fasteners (e.g., staples, pins, etc.), etc.) or may be slidably coupled to the platform 350. Ends of the channel 370 may be beveled (e.g., include a chamfered or rounded end) to enhance insertion, placement and/or travel of the tensioner 312 within the channel 370. In some embodiments, the tensioner may be coupled to the platform directly or indirectly.

In accordance with some embodiments the present system, it is envisioned that a platform may include one or more channels for receiving corresponding portions of one or more tensioners. It is also envisioned that the tensioner may pass one or more times through one of these channels. In accordance with embodiments of the present system, a platform may include a notched area which may form at least part of a channel for receiving a tensioner. This notched area may be situated on side and/or bottom walls of the platform. It is further envisioned that a platform may be formed integrally with a flower (e.g., a plastic platform and flower).

Figure 14:
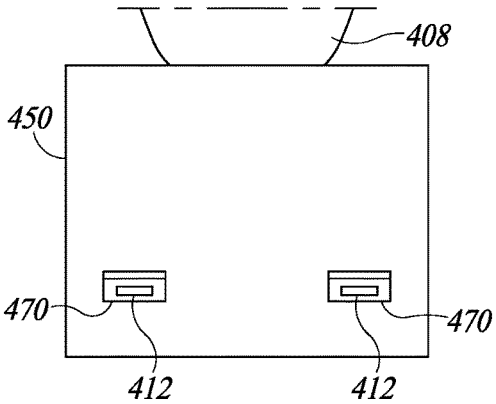
FIG. 14 is a diagram illustrating a side view of a portion of an example platform of the present invention.

FIG. 14 is a diagram illustrating a side view of a portion of an example platform 450 of the present invention. The platform 450 may include a plurality of openings or cutouts such as a channels 470 each of which may be configured to receive a corresponding portion of a tensioner 412. Accordingly, the corresponding portions of one or more tensioner 412 may pass, entirely or partially, through the corresponding channels 470. The channel 470 may include one or more rigid layers 471 which may include low friction surfaces if desired. The platform 450 may be configured to be coupled to a flower 408 in accordance with embodiments of the present system. In yet other embodiments, a channeled member having an opening through which a tensioner may pass fully or partially through may be situated within the corresponding channel 470. For example, this channeled member may include a tube or the like and may include any suitable cross section configured to receive the tensioner.

It is envisioned that the ends of the tensioner may be secured at opposed sides of the platform. For example, free ends of the tensioner may pass through openings in the side of the body and may be fixedly secured to the sides or bottom of the platform.

Figure 15:
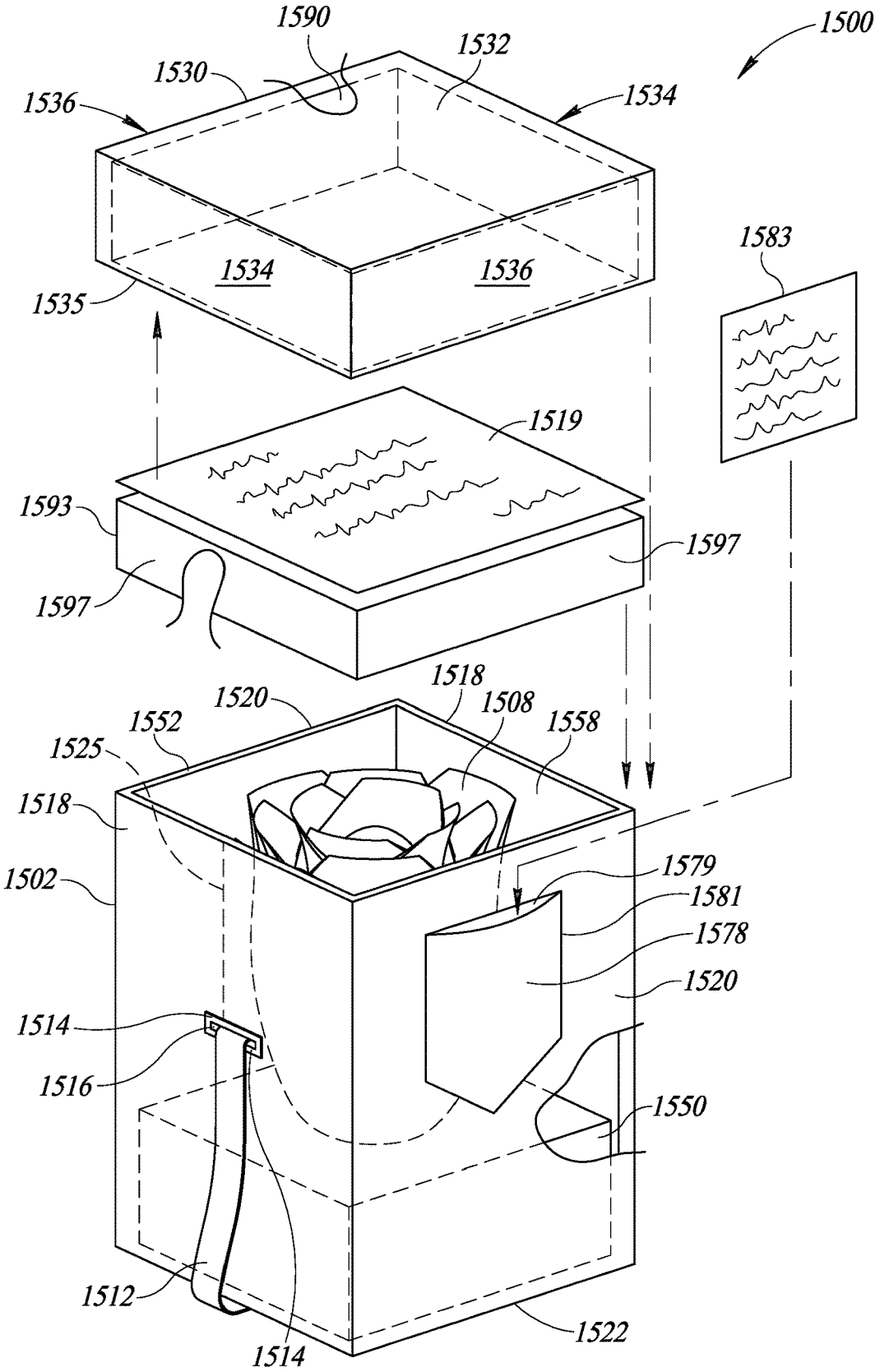
FIG. 15 is a diagram illustrating a partially cutaway and exploded perspective front view of a portion of an example flower container system of the present invention according to a third embodiment.

Embodiments of the present system may further employ bodies and/or corresponding covers having different shapes such as square, oval, rectangular, polygonal, etc. when viewed from the top. For example, FIG. 15 is a diagram illustrating a partially cutaway and exploded perspective front view of a portion of an example flower container system (hereinafter system 1500 for the sake of clarity) of the present invention according to a third embodiment. The system 1500 may include one or more of a body 1502, a flower 1508, a platform 1550, a tensioner 1512, and a cover 1530.

The body 1502 may include one or more walls such as side walls 1518, end walls 1520, and a bottom wall 1522 which may define at least a portion of a cavity 1558 which may be configured to receive the flower 1508 coupled to the platform 1550. One or more of the side walls 1518 and end walls 1520 may define at least a portion of a top wall 1552. The body 1502 may form a substantially square shape when viewed from the top (e.g., into the cavity 1558).

One or more of the side walls 1518 may include one or more openings such as openings 1516 which may be configured to receive, and or to provide passage of, corresponding portions of the tensioner 1512 which may pass therethrough. One or more of the openings 1516 may include a grommet 1514 or the like (e.g., a cringle, an eyelet, etc.) through which the tensioner 1512 may pass.

If desired, an optional insertion notch 1525 may be provided and may extend from one or more of the openings 1516 to the top wall 1552 (as shown) or the bottom wall 1522 so that the tensioner 1512 may be easily and conveniently be inserted into a corresponding opening 1516 via the insertion notch 1525. The insertion notch 1525 may be provided when, for example, the tensioner 1512 (and/or the platform 1550 coupled thereto) may form a loop prior to insertion of the tensioner 1512 into the openings 1516. After insertion of the tensioner 1512, the insertion notch 1525 may be sealed using any suitable method such as adhesives, tapes, staples, grommets, a biasing force, etc. It is envisioned that the optional insertion notch 1525 may be straight or may include other shapes which may prevent accidental removal of the tensioner 1550 once the tensioner is inserted into the openings 1516. An insertion notch may be provided for each respective opening 1516 of the openings 1516.

The cover 1530 may include one or more of a body having side walls 1534, end walls 1536, and a top wall 1532 which define at least a portion of a cavity 1590. One or more of the side walls 1534 and the end walls 1536 may have an edge 1535 defining an opening leading to the cavity 1590. The cover 1530 may be removed prior to raising the flower 1508 from the cavity 1558. An insert 1519 may be inserted within the cavity 1590 of the cover 1530 and may be secured using any suitable coupling such as am interference fit, an adhesive, a magnetic coupling, a pocket, etc. The insert 1519 may include, for example, a card, a note, a letter, etc. It is also envisioned that a card, note, letter, etc., may be coupled to the tensioner 1512 or body 1502 as may be desired. The insert 1519 may be shaped and/or sized similarly to a shape and/or size of the cavity 1590 so as to form a friction fit as may be desired. In some embodiments the insert 1519 may be shaped and/or sized differently from the shape and size of size of the cavity 1590. The insert 1519 may include text and/or graphics which may be printed or otherwise rendered by the system in accordance with insert information. This insert may include information entered or otherwise generated in accordance with input of a user. For example, a user may select a type of card and/or information to be printed on or in the card using a graphical user interface (GUI) rendered by a controller of the system and which may interact with the user.

An optional inner cover 1593 may be situated between the cover 1530 and the body 1502. The inner cover 1593 may be formed from a film or the like (e.g., a plastic sheet which may be folded to form one or more sidewalls 1597 which may position it relative to the body 1502. The optional inner cover 1593 may be configured to prevent color bleeding (e.g., bleed-through) from the flower 1508 to the cover 1530 or parts thereof.

One or more portions of the system may include a covering which may be formed from a desired material such as a patterned, fabric, cloth, paper, film, etc. which may be coupled to (e.g., laminated upon) the body 1502 and/or the cover 1530, or portions thereof, using any suitable coupling (e.g., adhesives). For example, in some embodiments of the present system the covering may include a fabric material (e.g., a jean or denim material or the like) that may be laminated upon, and/or otherwise coupled to, at least an outer surface of the body 1502 and/or cover 1530. It is further envisioned that stitching and/or piping may be provided in one or more locations of the body and/or cover to reinforce the coupling of the fabric material and/or the body or cover and/or to enhance aesthetics.

It is also envisioned that one or more pockets may be coupled to one or more of the body 1502 and/or the cover 1530. For example, a pocket 1578 may be coupled to the one or of the side walls 1518 or end walls 1520 (as shown) so as to form a pocket having an opening 1579 leading to a cavity formed therein and which may be configured to retain a desired object such as a card 1583 or the like. Stitching 1581 may extend adjacent to a periphery of the pocket 1578. The card 1583 may include graphics or text and may be removed by a user. The pocket 1578 may include a flap as may be desired.

The cover 1530 may be shaped and sized so as to cover at least a portion of the cavity 1558 of the body 1502 and may be removably attached to the body 1502 using any suitable method such as an interference fit, a latch, a hinge, etc. Accordingly, the cover 1530 may snugly fit the body 1502 to prevent accidental or inadvertent removal. If desired, an adhesive, tape, seal, etc., may be applied to lock the cover 1530 to the body 1502.

Figure 16:
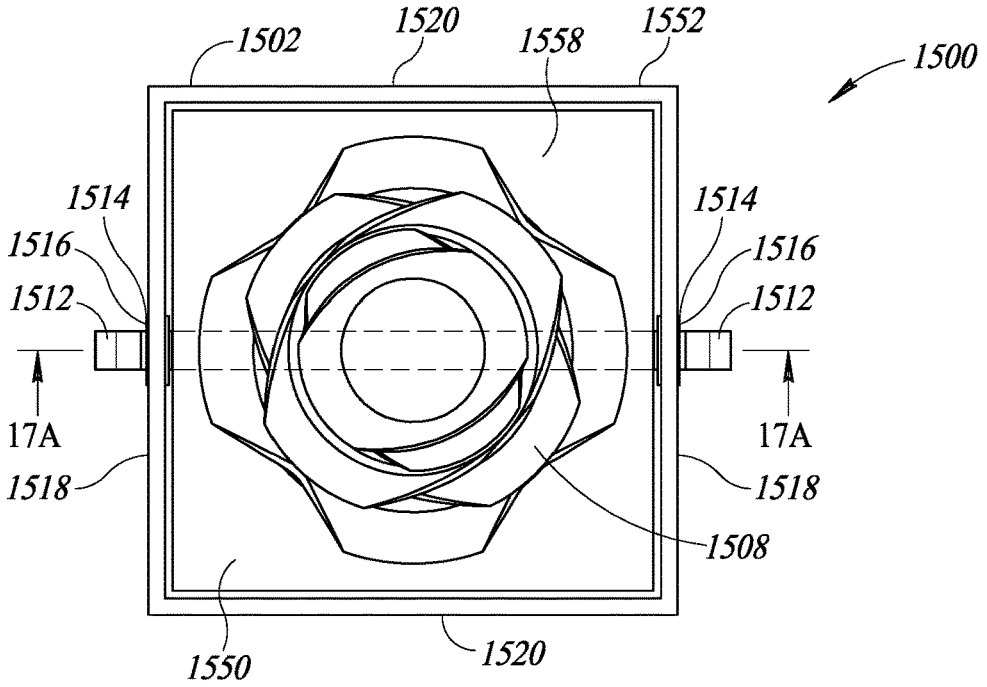
FIG. 16 is a diagram illustrating a top view of a portion of the system of the present invention with the cover removed.

FIG. 16 is a diagram illustrating a top view of a portion of the system 1500 of the present invention with the cover 1530 removed. The flower 1508 may be coupled to the platform 1550 which is situated within the cavity 1558 of the body 1502.

Figure 17A:
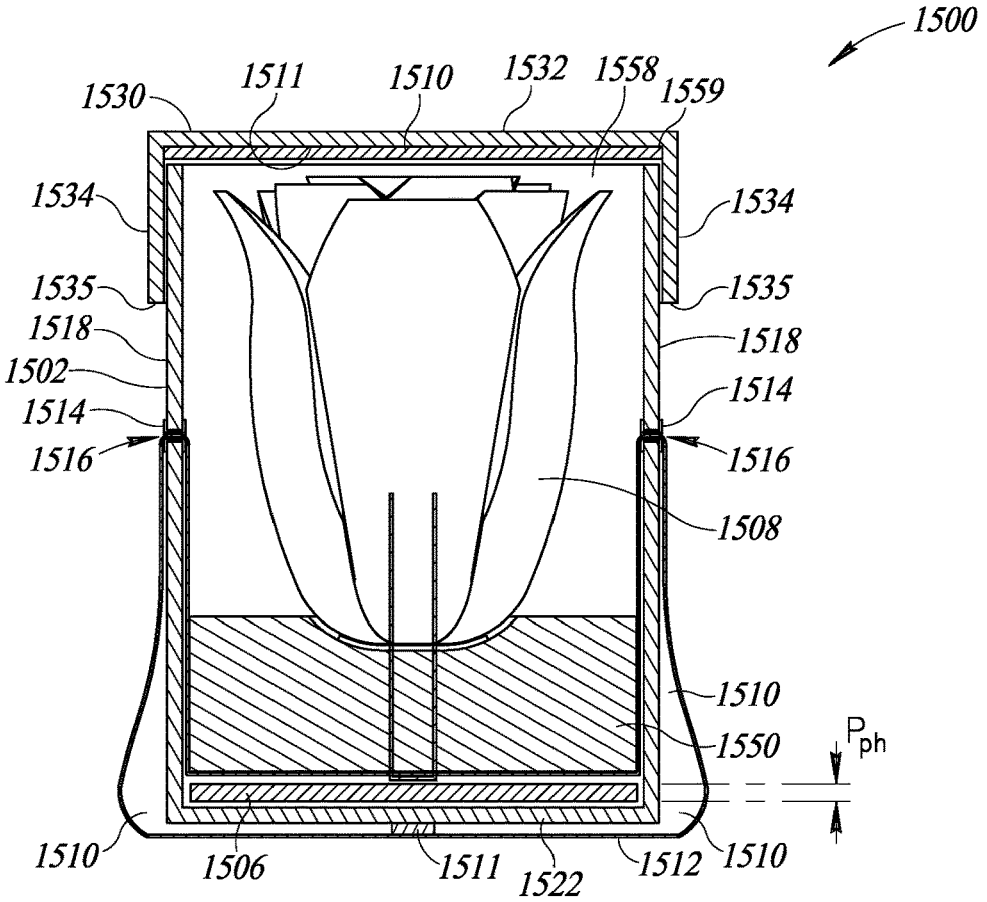
FIG. 17A is a diagram illustrating a cross-sectional view of a portion of the system of the present invention taken along lines 17A-17A of FIG. 16.

FIG. 17A is a diagram illustrating a cross-sectional view of a portion of the system 1500 of the present invention taken along lines 17A-17A of FIG. 16. The body 1502 may include grommets 1514 at corresponding openings 1516 through which the tensioner 1512 may pass. The platform 1550 may be inserted within the cavity 1558 and may be coupled to the tensioner 1512. Accordingly, portions of the tensioner 1512 that are situated within the cavity may be located at least in part between one or more of the platform 1550 and one or more walls (e.g., 1518 and/or 1522) of the body 1502.

The tensioner 1512 may form a loop and may be fixedly or releasably coupled to a wall of the body 1502 such as the bottom wall 1522 using any suitable coupler such as an adhesive 1511. Accordingly, the tensioner 1512 may form one or more exterior loops such as loops 1510 which may be configured to be grasped by user to pull on the tensioner 1512 and/or raise the platform 1550. It is also envisioned that the tensioner 1512 may be discontinuous and may include ends which may be situated outside of the body 1502. In some embodiments, tensioner 1512 may be released from the body 1502 at the adhesive 1511 before raising the platform 1550 as may be desired.

In some embodiments, the tensioner 1512 may be coupled to the platform 1550 similarly to the coupling shown in FIG. 7. For example, the tensioner 1512 may be situated between the platform 1550 and a cap which may be similar to the cap 145 of FIG. 7. One or more adhesive layers or the like may be provided to couple the cap to the platform 1550 and/or the tensioner 1512 directly or via one or more other layers or portions which may intervene.

In some embodiments, one or more pull tabs suitable for grasping by a user may be coupled to, or formed integrally with, the tensioner such that a user may easily grasp the tensioner. For example, the one or more pull tabs may be located at or near the ends of the tensioner or may be attached to other suitable portion or portions of the tensioner.

A puck 1506 may be shaped and sized to fit within the cavity 1558 and may have a height $P_{ph}$ which may be suitable to limit travel of the platform 1550 within the body 1502. Accordingly, the puck 1506 may raise the platform 1550 by the height $P_{ph}$ of the puck 1506 as may be desired. This may be useful for setting a height of the platform 1550 and/or one or more flowers coupled thereto when recessed within the body 1502. It is envisioned that the puck 1506 may be independent of, or may be coupled to, the platform 1550. For example, a coupler 1506 may be coupled to the platform 1550 using any suitable coupler such as an adhesive, a fastener (e.g., a staple, etc.) etc. For example, the puck 1506 may be coupled to the platform 1550 similarly to the method employed to couple the cap 145 to the platform 150 as discussed above. It is further envisioned that the puck 1506 may be independent of the platform 150 and may be optionally coupled to the bottom wall 1522 of the body 1502 using any suitable coupler such as an adhesive 1511.

The insert 1519 may be shaped and sized to fit within a cavity 1590 of the cover 1530 such that it may be placed adjacent to an interior surface 1511 of the top wall 1532 of the cover 1530. The insert 1519 may include one or more layers. For example, the insert 1519 may include a mirror or the like. In accordance with embodiments of the present system, the insert 1519 may include one or more folds such that it may be folded into a booklet or card. In accordance with embodiments of the present system, the insert 1519 may include a surface suitable for writing upon or printing upon.

Figure 17B:
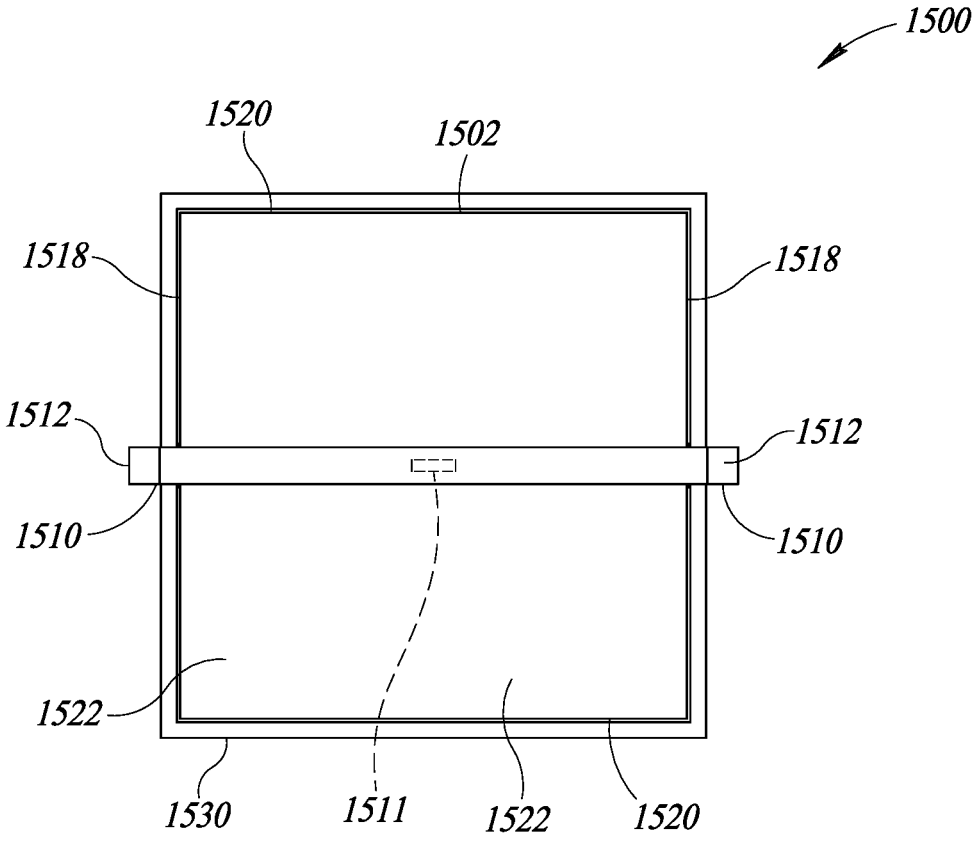
FIG. 17B is a diagram illustrating a bottom view of a portion of the system of the present invention.

FIG. 17B is a diagram illustrating a bottom view of a portion of the system 1500 of the present invention. The tensioner 1512 may extend about and couple to the bottom wall 1522 of the body 1502 using any suitable coupler such as an adhesive 1511.

Figure 18:
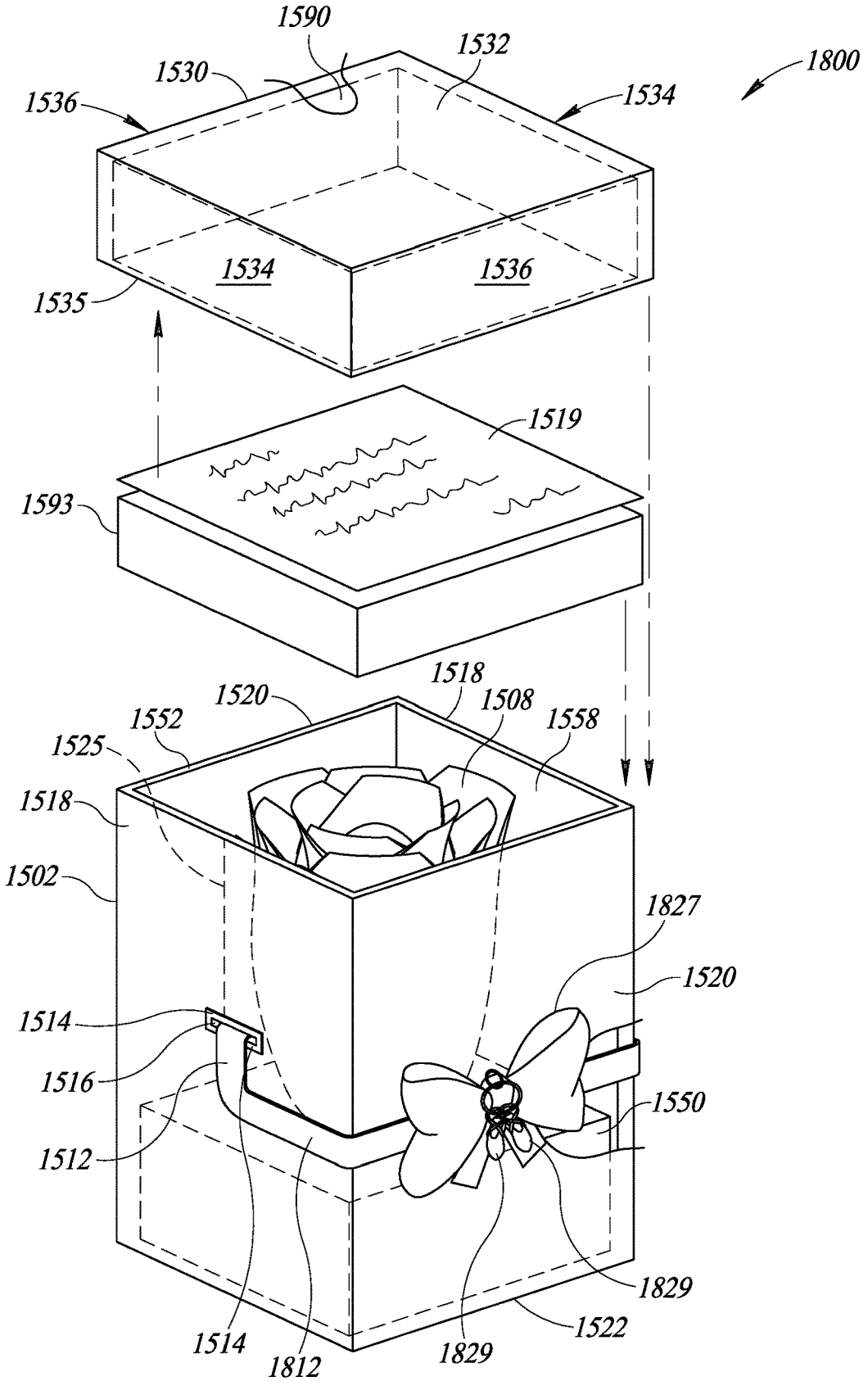
FIG. 18 is a diagram illustrating a partially cutaway and exploded perspective front view of a portion of an example flower container system of the present invention according to a fourth embodiment.

In accordance with embodiments of the invention, the tensioner 1512 may be configured to extend at least partially across one or more of the side walls 1518 and one of the end walls 1520 rather than the bottom wall 1522 of the body 1502 as illustrated in FIG. 15. This is illustrated with reference to FIG. 18 which is a diagram illustrating a partially cutaway and exploded perspective front view of a portion of an example flower container system (hereinafter system 1800 for the sake of clarity) of the present invention according to a fourth embodiment. The system 1800 may be similar to the system 1500 and may include one or more of the body 1502, the flower 1508, the platform 1550, the tensioner 1512, and the cover 1530 as discussed with reference to the system 1500. In some embodiments, it is envisioned that the tensioner 1512 may be configured such that it may pass along one or more of the side wall 1518 and at least one of the end walls 1520 of the body 1502.

Ornamentation such as one or more of a bow, a charm, rings, and/or the like may be attached to, or formed integrally with, the tensioner 1512. For example, a bow 1827 may be coupled to the tensioner 1512 using any suitable fastener. For example, the bow 1827 may be coupled to the tensioner 1512 using an adhesive (e.g., double sided tape, a thermo adhesive, etc.), a thread, a staple, an interference fit, a loop, a pin, etc. It is also envisioned that portions of the tensioner 1512 may be configured to form at least a portion of a bow or the like. It is further envisioned that ornamentation such as a charm 1829 may be coupled to the bow 1827 and/or tensioner 1512. The charm 1829 may include one or more of a ring (e.g., an engagement ring, etc.), a jewel, a shoe (e.g., baby shoes as shown, etc.), a graduation cap, a piece of jewelry, etc. The charm 1829 may be coupled to one or more portions of the tensioner 1512 and/or bow 1827 using any suitable method such as an adhesive (e.g., double sided tape, a thermo adhesive, etc.), a thread, a staple, an interference fit, a loop, a pin, a magnetic coupler, etc. When attaching a bow to the tensioner 1512, it may be desirable to situate portions of the tensioner 1512 on the side 1518 of the body 1502 between the openings 1516 rather than under the bottom wall 1522 of the body 1502.

The optional inner cover 1593 may be situated between the cover 1530 and the body 1502 and may be configured to prevent bleed through between the flower 1508 and portions of the cover 1530 and/or note 1519 situated therein. In some embodiments, it is envisioned that the note 1519 may be coupled to the optional inner cover 1593. The optional inner cover 1593 may be removed from the body 1502 prior to raising the platform 1550 and/or flower 1508 coupled thereto.

Figure 19:
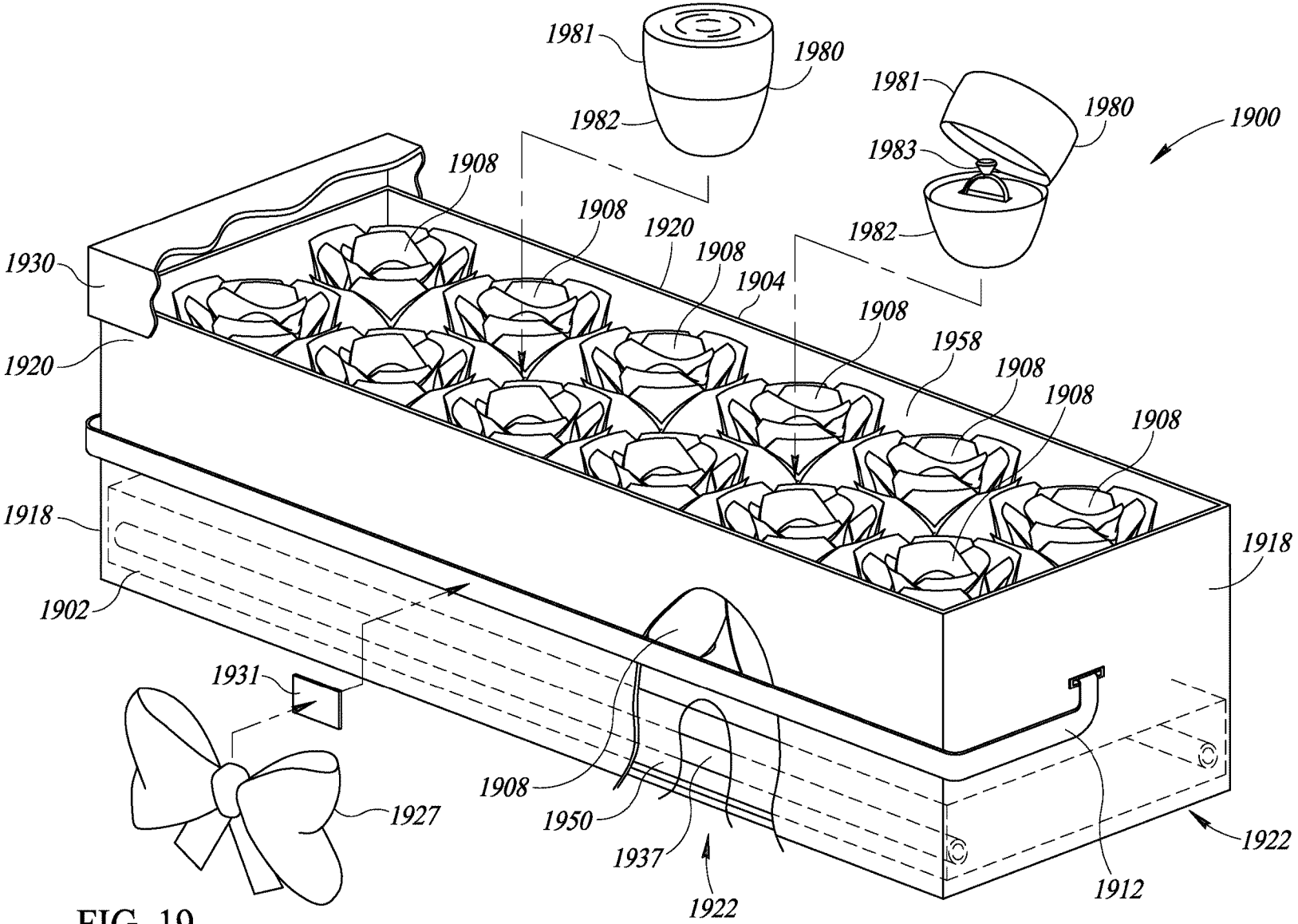
FIG. 19 is a diagram illustrating a partially cutaway and exploded perspective front view of a portion of an example flower container system of the present invention according to a fifth embodiment.

FIG. 19 is a diagram illustrating a partially cutaway and exploded perspective front view of a portion of an example flower container system (hereinafter system 1900 for the sake of clarity) of the present invention according to a fifth embodiment. The system 1900 may include one or more of a body 1902, at least one flower 1908, a platform 1950, a tensioner 1912, and a cover 1930. The body 1902 may include one or more walls such as side walls 1918, end walls 1920, and a bottom wall 1922 which may define at least a portion of a cavity 1958 which may be configured to receive the platform 1950 and the at least one flower 1908 attached thereto.

One or more of the side walls 1918 and end walls 1920 may define at least a portion of a top wall 1904. The body 1902 may form a substantially rectangular shape when viewed from the top.

One or more rigidity enhancing members such as plastic tubes 1937 or the like may be situated within the platform 1950 to increase rigidity of the platform 1950. It is envisioned that the rigidity enhancing member may have other cross-sectional shapes such as "I," "U," "C," "L," etc. In yet other embodiments, the rigidity enhancing member may include one or more layers (polymer or wood such as plywood, etc.) which may be laminated to, or otherwise coupled to, the platform 1950 to enhance rigidity of the platform 1950. The rear view may be similar. Operation may be similar to other embodiments of the present invention.

Those portions of the tensioner 1912 that may be situated outside of the cavity 1958 may pass along one or more of the side walls 1918 and one of the end walls 1920 as shown. In some embodiments, it is envisioned that those portions of the tensioner 1912 that may be situated outside of the cavity 1958 may pass along one or more of the side walls 1981 and the bottom wall 1922. It is further envisioned that portions of the tensioner(s), ribbons, and/or charms may be coupled to one or more portions of the body 1902 using any suitable coupling such as an adhesive, an interference fit, a magnetic coupling, etc.

One or more bows such as bow 1927 and/or one or more charms may be coupled to, or formed integrally with, the tensioner 1912. For example, the bow 1927 may include a pre-formed bow and may be coupled to the tensioner 1912 using any suitable coupler such as an adhesive 1931. The same or a separate coupler may couple one or more of the tensioner 1912 and the bow 1927 to a corresponding portion of the end wall 1920. For example, the adhesive 1931 may be shaped and/or sized such that a portion thereof may extend beyond a periphery of the tensioner 1912 so as to engage a corresponding portion of the end wall 1920. In yet other embodiments, tension within the tensioner 1912 may support that portion of the tensioner 1912 and/or bow 1927 attached thereto in a desired position prior to raising the platform 1950. In yet other embodiments, one or more magnetic couplers (e.g., magnets) may be provided to position the bow 1927 relative to desired portions of the body 1902 prior to and/or after the platform is raised.

In accordance with embodiments of the present system, the system 1900 may include one or more containers such as containers 1980 which may hereinafter be referred to as ring containers 1980 for the sake of clarity. The ring containers 1980 may have any suitable size and/or shape. In some embodiments, the ring containers 1980 may be shaped and/or sized similarly to the flowers 1908 and may be coupled (e.g., releasably) to the platform 1950 using any suitable method or methods such as by an interference fit between adjacent flowers 1908. Accordingly, it is envisioned that one or more of the ring containers 1980 may be removable such as may be desired. For example, a user may remove the ring container 1980 to access contents thereof such as a ring (e.g., an engagement ring) 1983 contained within a cavity 1985 of the respective ring container 1980. In accordance with some embodiments, the ring container 1980 may be coupled to the platform 1950 using magnetic or adhesive coupling methods.

The ring containers 1990 may include a body 1982 which may define at least a portion of the cavity 1985 situated within the body 1982 and which may be configured to hold a desired object such as the ring 1983 (e.g., an engagement ring, etc.). Any suitable coupler such as a pillow, a foam block, etc. may be provided to hold the ring 1983 in position within the cavity 1985. A cover 1981 may be coupled to the body 1982 using any suitable coupler such as a hinge, a screw coupler, an interference fit, etc., and may be configured to cover at least a portion of the cavity 1985 of the body 1982 when closed. In use, it is envisioned that the ring container 1980 may be coupled to the platform and its cover 1981 may be situated in a closed position relative to the body 1982 prior to raising the platform 1950. Thereafter, the platform 1950 may be raised and a user may remove the ring container 1980 and may thereafter open the cover 1981 to reveal contents of the ring container 1980 such as the ring 1983. In some embodiments, it is envisioned that the ring container 1980 may be opened without removing it from the platform 1950.

Figure 20A:
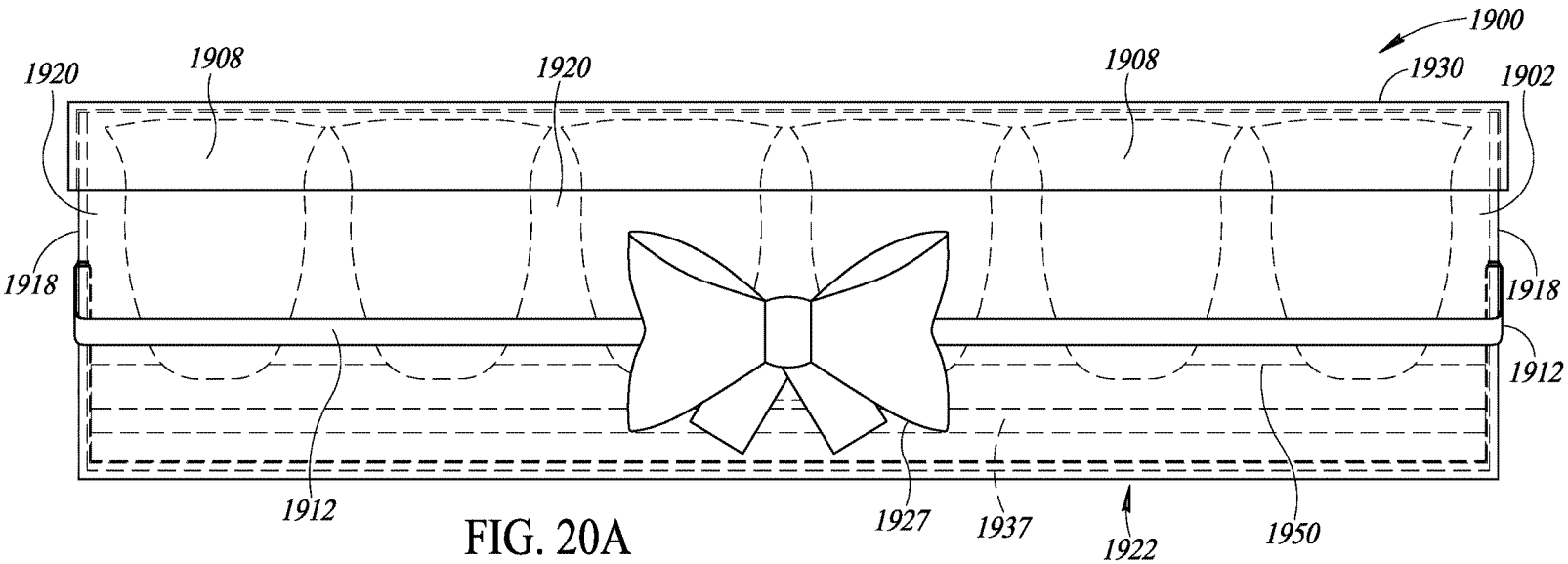
FIG. 20A is a diagram illustrating a front view of a portion of the system of the present invention.
Figure 20B:
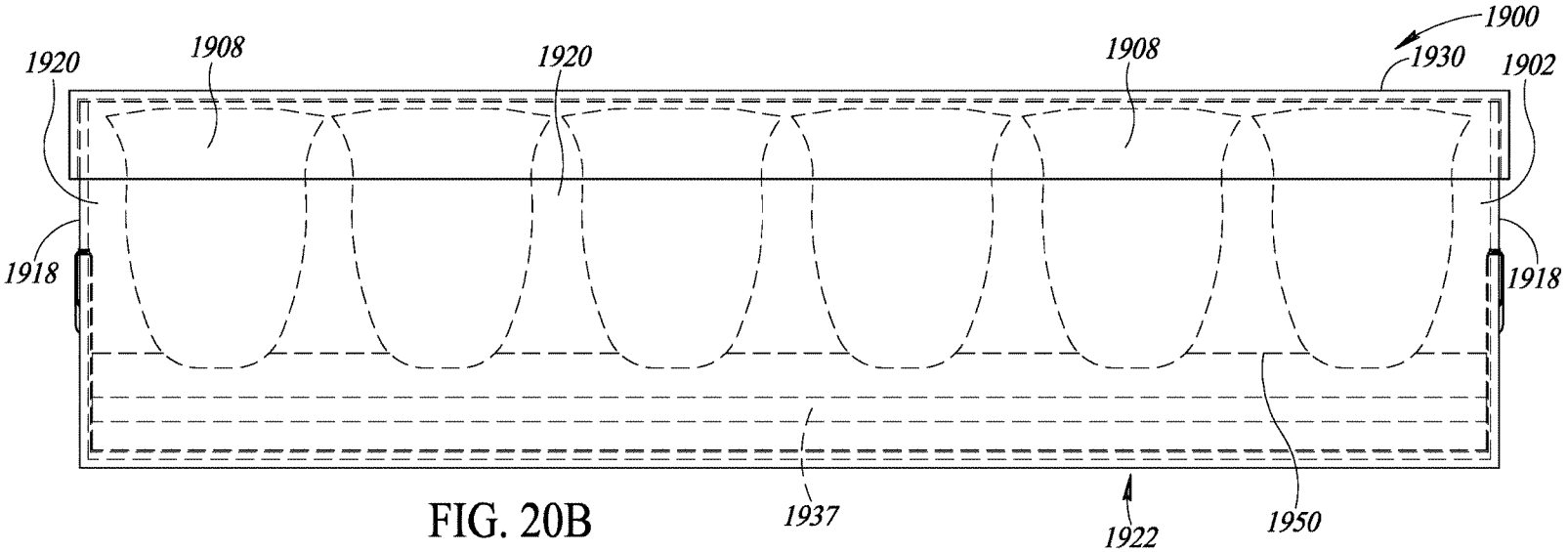
FIG. 20B is a diagram illustrating a rear view of a portion of the system 1900 of the present invention.
Figure 21:
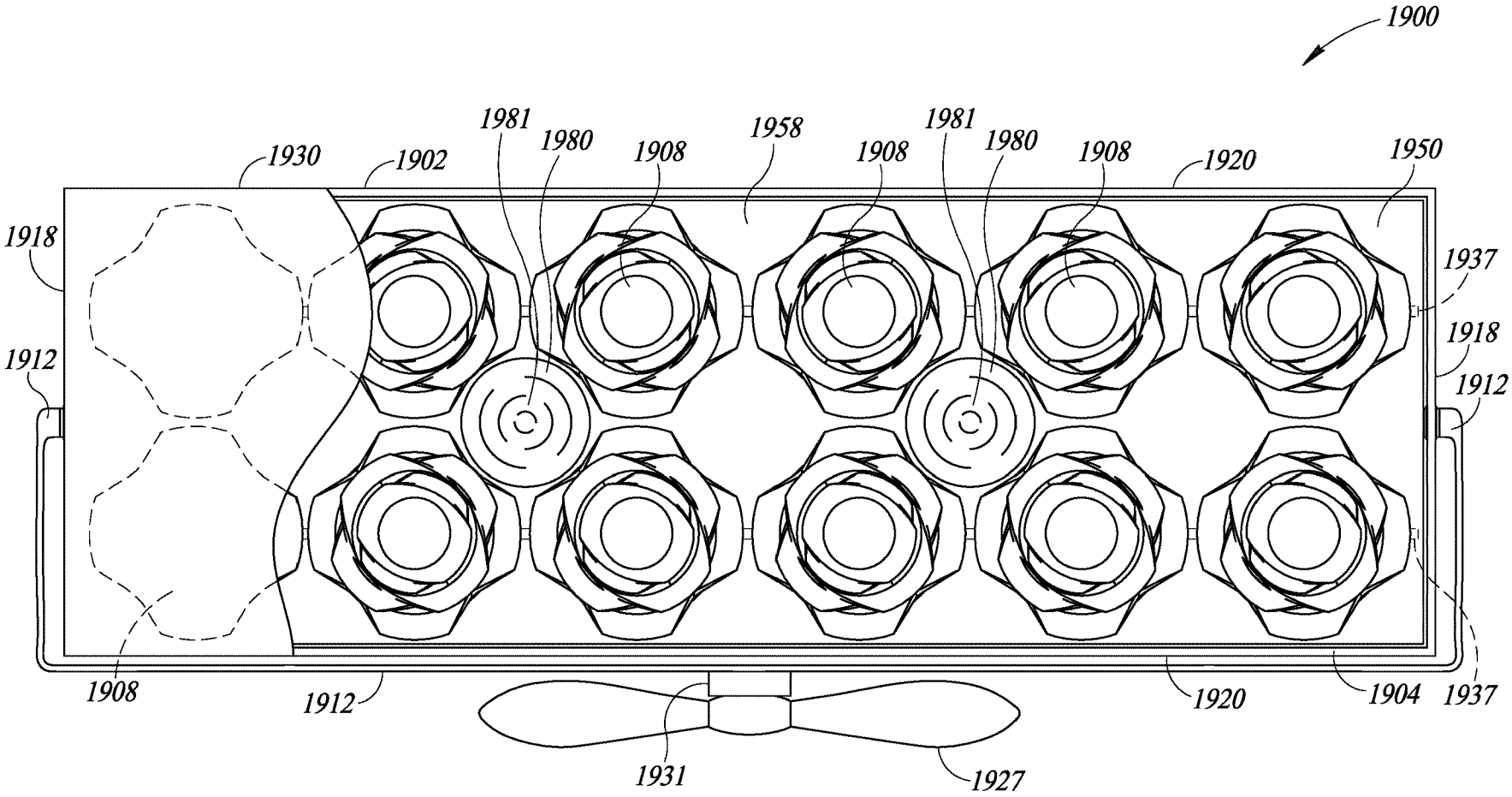
FIG. 21 is a diagram illustrating a partially cutaway top view of a portion of the system of the present invention.

In some embodiments, the tensioner 1912 may have a length suitable and/or may maintain a tension which may support the optional bow 1927 attached thereto at a desired height along a portion of the corresponding end wall 1920. For example, decreasing a length of the tensioner 1912 in that portion that is outside of the body 1902 may increase a height of the optional bow 1927. Conversely, increasing a length of the tensioner 1912 in that portion that is outside of the body 1902 may decrease a height of the optional bow 1927. The size of the tensioner 1912 in that portion that is outside of the body 1902 may be varied to control tension of the tensioner 1912 such that it may provide sufficient tension to support the optional bow 1927 in a desired position at least prior to raising the platform when the platform 1950 is in a desired position (e.g., fully recessed, etc.). FIG. 20A is a diagram illustrating a front view of a portion of the system 1900 of the present invention. The rigidity enhancing members such as the plastic tubes 1937 may extend fully or partially through the platform 1950 which may be inserted with the cavity of the body 1902. FIG. 20B is a diagram illustrating a rear view of a portion of the system 1900 of the present invention. FIG. 21 is a diagram illustrating a partially cutaway top view of a portion of the system 1900 of the present invention. The cover 1930 is partially cutaway to reveal the cavity 1958 and the at least one flower 1908 coupled to the platform 1950 contained therein. The optional containers 1980 may be situated between one or more of the flowers 1908. The containers 1980 may be coupled to one or more of the adjacent flowers 1980 using any suitable coupling such as an interference-type coupling, etc.

In FIGS. 18 through 23, it is envisioned that portions of the tensioner situated outside of the body may run along the front of the body or across the bottom of the body. For example, in accordance with some embodiments, the tensioner may extend along the side walls and the front wall of the body as opposed to extending along at least the side walls and bottom wall of the body.

Figure 22:
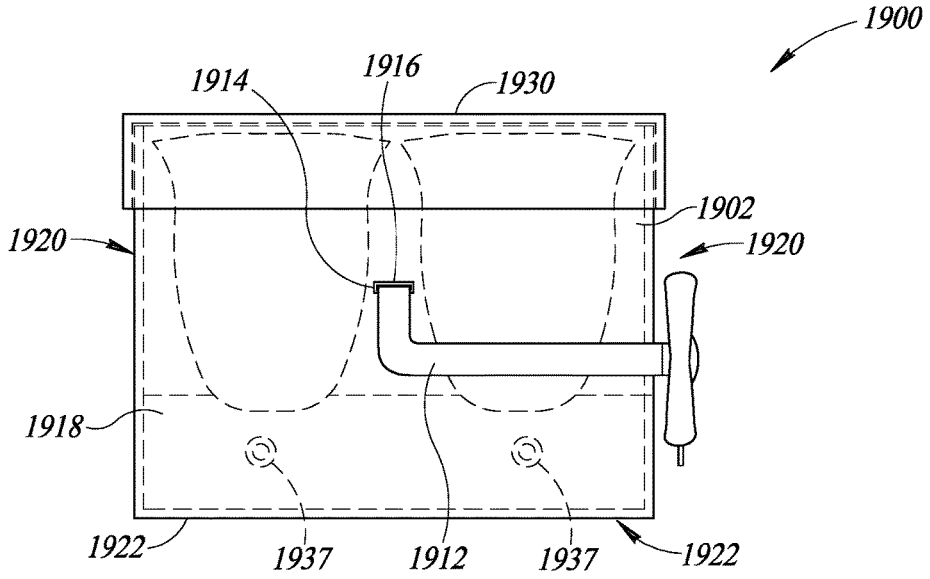
FIG. 22 is a diagram illustrating an end view of a portion of the system of the present invention.

FIG. 22 is a diagram illustrating an end view of a portion of the system 1900 of the present invention. The tensioner 1912 may extend through the opening 1916 and the grommet 1914 situated within the opening 1916. The other end view may be similar.

Figure 23:
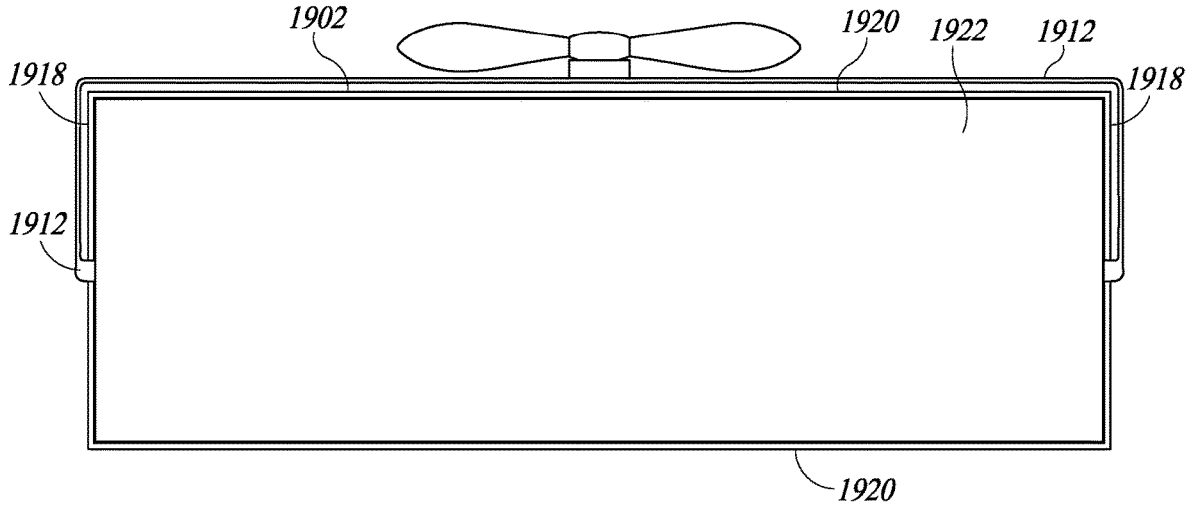
FIG. 23 is a diagram illustrating a bottom view of a portion of the system of the present invention.

FIG. 23 is a diagram illustrating a bottom view of a portion of the system 1900 of the present invention. The tensioner 1912 may extend across and/or be coupled to the bottom wall 1922.

Figure 24:
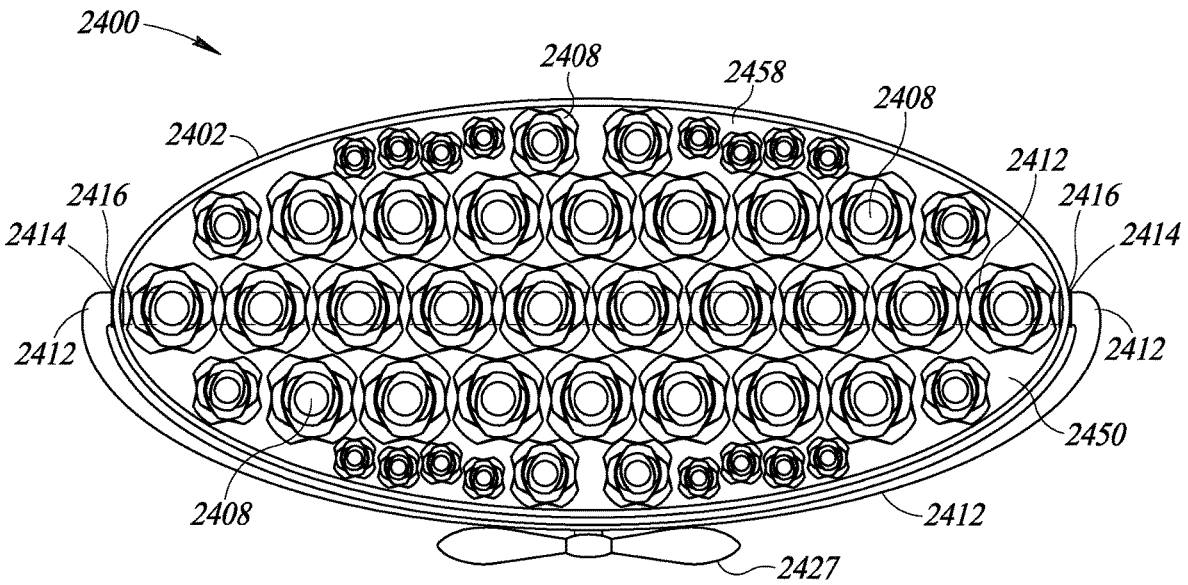
FIG. 24 is a diagram illustrating a top view of a portion of an example flower container system of the present invention according to a sixth embodiment.

FIG. 24 is a diagram illustrating a top view of a portion of an example flower container system 2400 of the present invention according to a sixth embodiment. A body 2402 may have an oval shape when viewed from the top and may include a platform 2450 which may be coupled to at least one flower 2408. The platform 2450 may be shaped and sized similarly to the body 2402 such that it may fit within a cavity 2458 of the body 2402. The platform 2450 may be shaped to receive the at least one flower 2408 and/or an optional ring container. One or more bows 2427 may be coupled to, or formed integrally with, the tensioner 2412.

The platform 2450 may include one or more wells which may be arranged apart from each other as may be desired. For example, the one or more wells may be arranged such that a user may easily and conveniently place the at least one flower 2408 in a desired pattern or patterns. The wells may correspond with a size of a flower to be inserted therein. Accordingly, the wells may have different sizes to receive different types and/or sizes of the at least one flower. In some embodiments, the wells may be situated apart from each other by the same or a different (e.g., varying) distances to correspond with different floral arrangements and/or flower sizes. Further, a top wall of the platform 2450 may have one or more heights to correspond with different types and/or sizes of the at least one flower 2408. The at least one flower 2408 may be located so as to provide an interference fit to couple a container such as an optional ring container.

At least one tensioner 2412 may extend through one or more of openings 1916 and corresponding grommets 1914 situated within each corresponding opening 1916 and may be configured to lift the platform 2450 as discussed elsewhere in this application. A cover is not shown for the sake of clarity.

Figure 25:
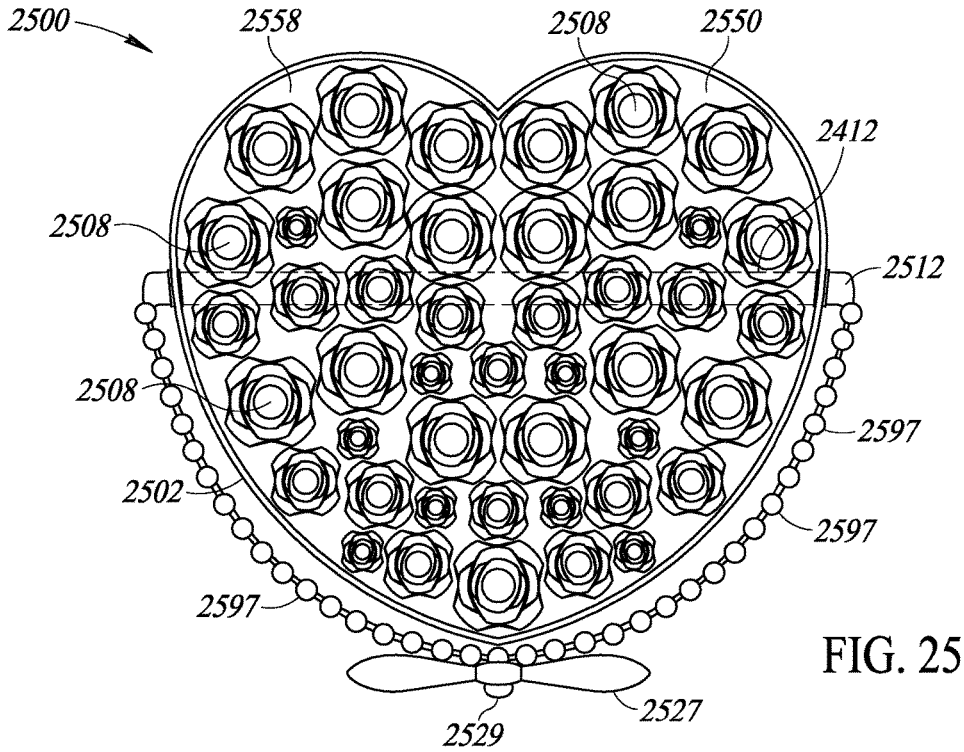
FIG. 25 is a diagram illustrating a top view of a portion of an example flower container system of the present invention according to a seventh embodiment.

FIG. 25 is a diagram illustrating a top view of a portion of an example flower container system 2500 of the present invention according to a seventh embodiment. A body 2502 may have a heart shape when viewed from the top and may include a platform 2550 which may be coupled to at least one flower 2508. The platform 2550 may be shaped and sized similarly to the body 2502 such that it may fit within a cavity 2558 of the body 2502. A cover is not shown for the sake of clarity. One or more optional bows 2527 may be coupled to, or formed integrally with, the tensioner 2512. One or more charms 2529 may be coupled to one or more of the one or more bows 2527 and/or the tensioner 2512. Further, one or more beads 2597 (e.g., real or artificial pearls or the like) or the like may be coupled to the tensioner 2512. For example, at least portions of the tensioner 2512 that are situated outside of the cavity 2558 (e.g., when the platform 2550 is in the fully or substantially recessed position) may be strung through the one or more beads 2597.

It is envisioned that the beads may include an opening to receive the tensioner which may be threaded (or otherwise strung) therethrough. It is also envisioned that the beads may be formed from any suitable material such as stone, bone, shell, metal, ceramic, glass, plastic, wood, or pearl, and/or the like. It is further envisioned that the beads may be formed from organic or synthetic materials. It is envisioned that the beads may have any suitable shape and/or size.

Figure 26:
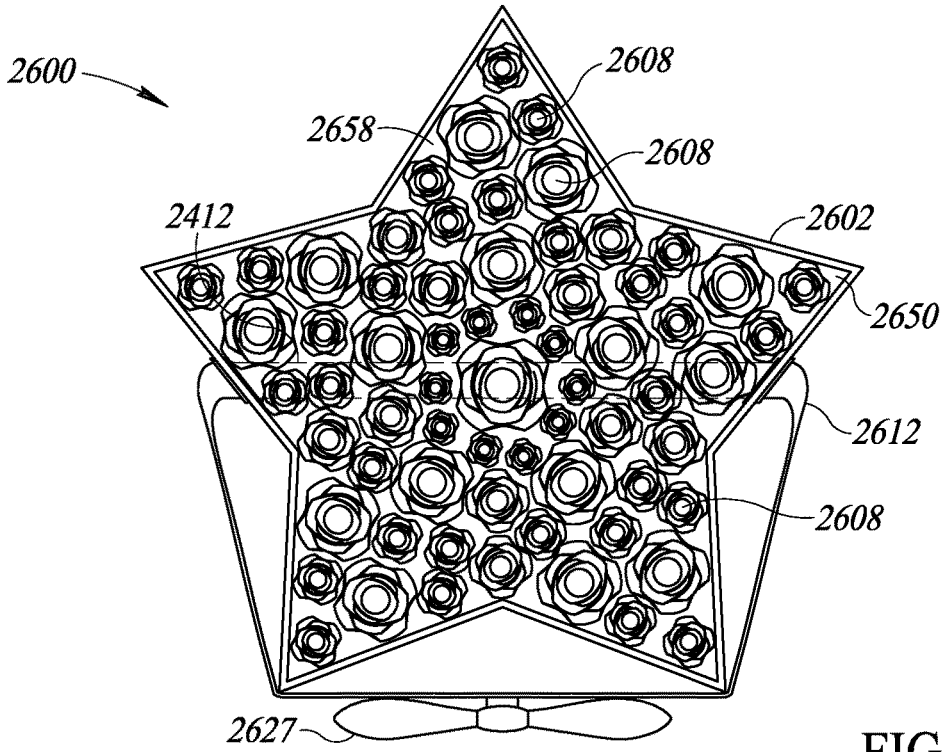
FIG. 26 is a diagram illustrating a top view of a portion of an example flower container system of the present invention according to an eighth embodiment.

FIG. 26 is a diagram illustrating a top view of a portion of an example flower container system 2600 of the present invention according to an eighth embodiment. A body 2602 may have a star shape when viewed from the top and may include a platform 2650 which may be coupled to at least one flower 2608. The platform 2650 may be shaped and sized similarly to the body 2602 such that it may fit within a cavity 2658 of the body 2602. A cover is not shown for the sake of clarity. One or more optional bows 2627 may be coupled to, or formed integrally with, a tensioner 2612.

Figure 27:
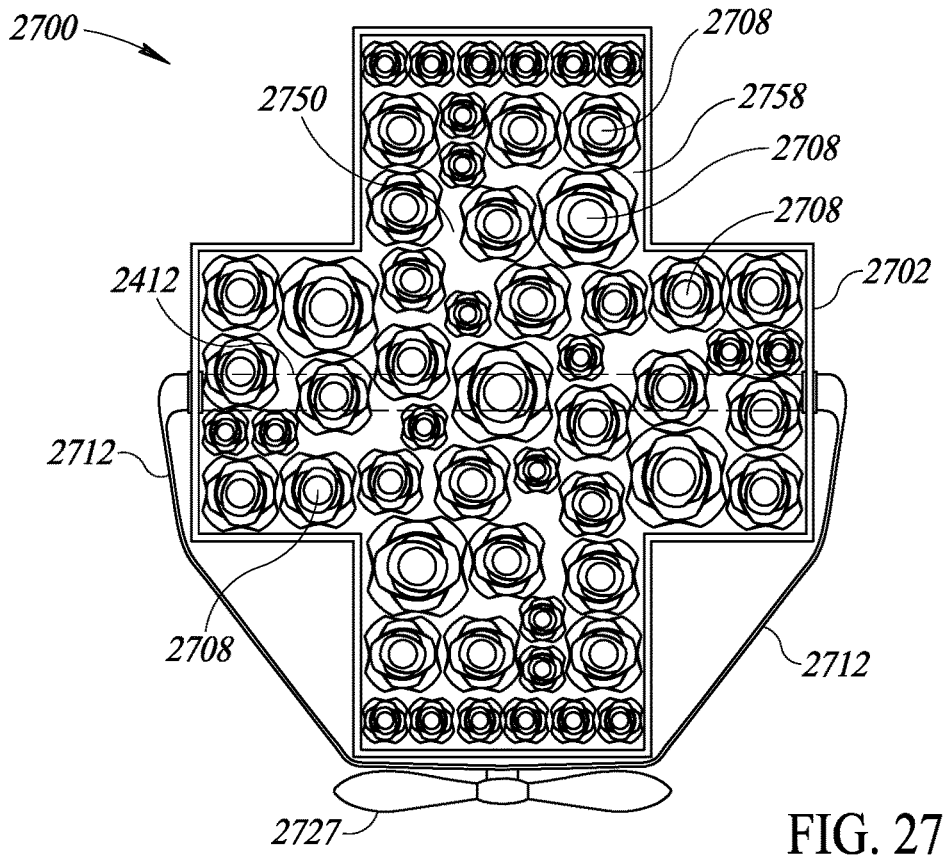
FIG. 27 is a diagram illustrating a top view of a portion of an example flower container system of the present invention according to a ninth embodiment.

FIG. 27 is a diagram illustrating a top view of a portion of an example flower container system 2700 of the present invention according to a ninth embodiment. A body 2702 may have a cross shape when viewed from the top and may include a platform 2750 which may be coupled to at least one flower 2708. The platform 2750 may be shaped and sized similarly to the body 2702 such that it may fit within a cavity 2758 of the body 2702. A cover is not shown for the sake of clarity. One or more optional bows 2727 may be coupled to, or formed integrally with, a tensioner 2712.

Figure 28:
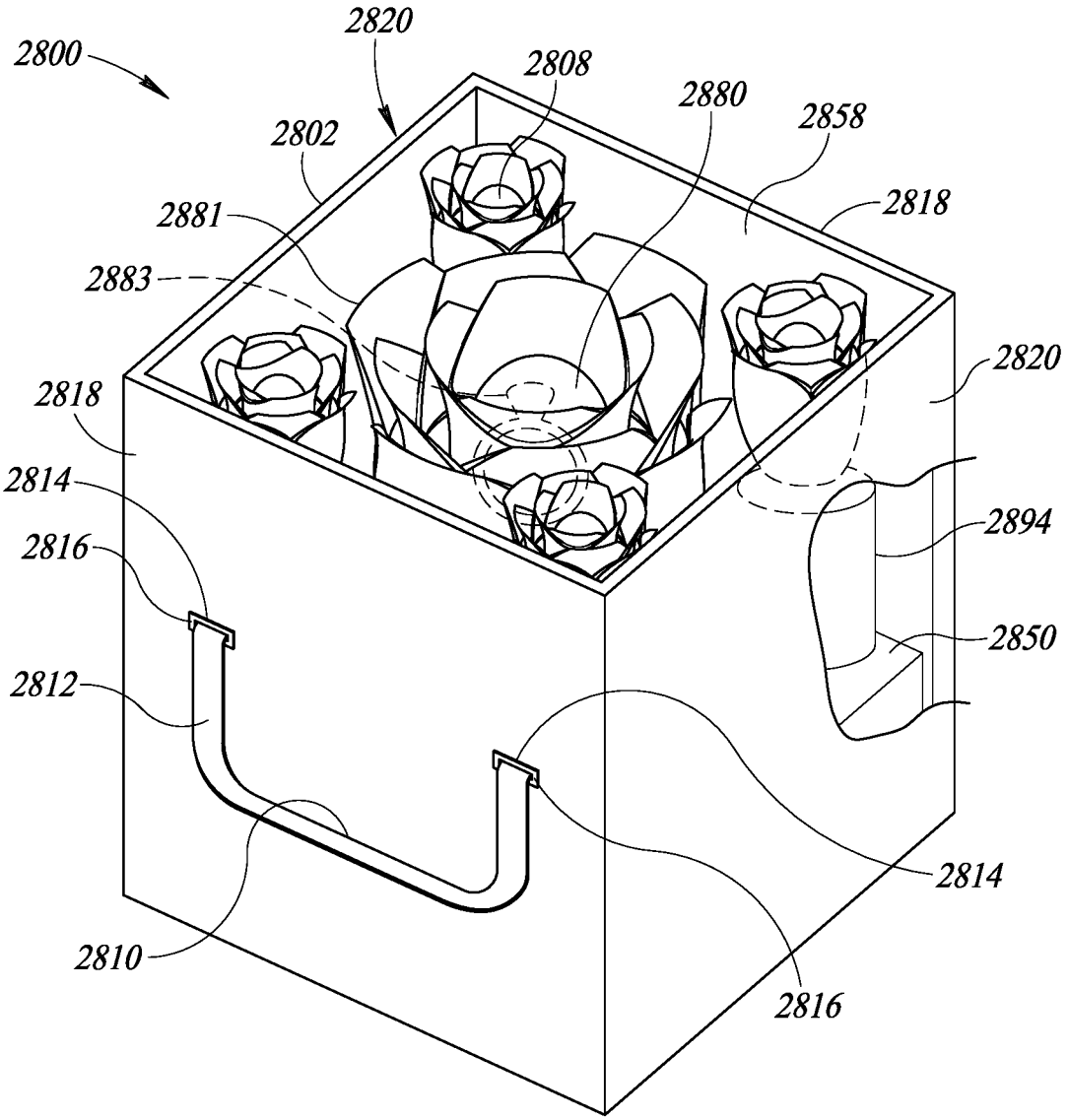
FIG. 28 is a diagram illustrating a perspective front view of a portion of an example flower container system of the present invention according to a tenth embodiment.

FIG. 28 is a diagram illustrating a partially cutaway perspective front view of a portion of an example flower container system (hereinafter system 2800 for the sake of clarity) of the present invention according to a tenth embodiment. The system 2800 may include one or more of a body 2802, at least one flower 2808, a platform 2850, and at least one tensioner 2812. A cover is not shown for the sake of clarity.

The body 2802 may include one or more of the side walls 2818 each of which may include a one or more openings such as openings 2816 which may be configured to receive, and or to provide passage of, corresponding portions of the at least one tensioner 2812 which may pass therethrough. One or more of the openings 2816 may include a grommet 2814 or the like (e.g., a cringle, an eyelet, etc.) through which the tensioner 2812 may pass. The openings 2816 in each of the side walls 2818 may be spaced apart from each other and may be aligned with, or offset (e.g., slightly) from the openings 2816 at the other side wall 2818. The tensioner 2812 may form a loop which may pass through each of openings 2816 in each of the side walls 2818 such as loops 2810 suitable for grasping by a user each of which may be situated at each corresponding side wall 2818 at the exterior side of the body 2802. The side walls 2818 and opposed end walls 2820 may define at least a portion of a cavity 2858 configured to receive the platform 2850 and the at least one flower 2808 attached thereto.

The platform 2850 may be raised in certain areas such as at area in which flowers 2808 having a smaller size may be located such that a desired height and/or uniformity of the flowers 2808 may be obtained. For example, the platform may be configured with a surface that may include various heights or may include blocks or pedestals 2894 coupled thereto which may be configured to raise a mounting surface upon which one or more of the flowers 2808 may be mounted as shown.

One or more ring containers 2880 may be coupled to the combination formed by the platform 2850 and/or the flowers 2850 using any suitable coupling such as an interference fit between the one or more ring containers 2880 and adjacent ones of the flowers 2850. In some embodiments, other couplings are also envisioned such as a releasable fastener (e.g., a hook-and-loop type fastener such a Velcro™, etc.), a magnetic fastener, an adhesive fastener, etc. The ring container 2880 may include cavity configured to receive a ring 2883 (e.g., an engagement ring, etc.) contained therein. The one or more ring containers 2880 may include a cover 2881 which may open to reveal the cavity. Exterior portions of the ring container 2880 such as at least the cover 2881 may be shaped, sized, and/or colored to match a desired flower pattern, size, and/or color, respectively. For example, the exterior portions of the ring container 2880 such as at least the cover 2881 may be embossed to simulate the look of a desired flower such as a rose and may include a desired color (e.g., red, etc.).

Figure 29:
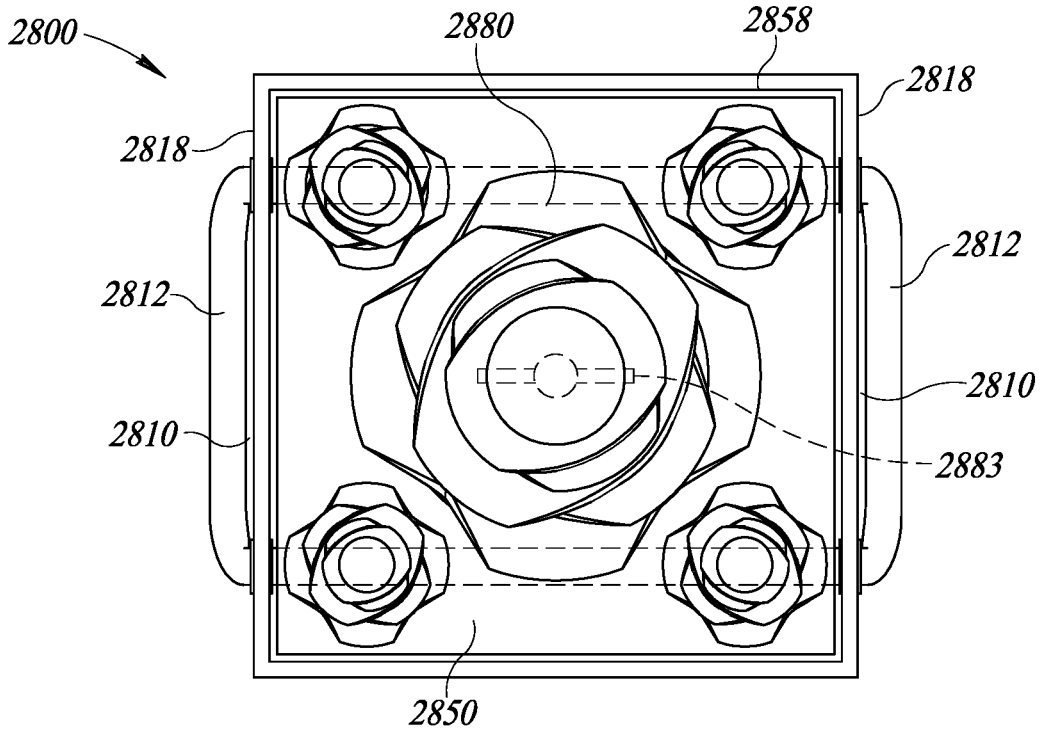
FIG. 29 is a diagram illustrating a top view of a portion of the system of the present invention.

FIG. 29 is a diagram illustrating a top view of a portion of the system 2800 of the present invention. The openings (e.g., 2816 FIG. 28) in each of the side walls 2818 may be spaced apart from each other and situated opposite openings (e.g., 2816 FIG. 28) in the opposite side wall 2818 such that the tensioner may be have parallel or substantially parallel runs adjacent to platform 2850. It is envisioned that adjacent portions of the tensioner 2812 may be parallel or non-parallel as may be desired. The cover is not shown for the sake of clarity. The tensioner 2812 may form one or more loops such as the loops 2810 at each exterior side of the body 2802. These loops 2810 may be configured to be grasped by a user and may be pulled in opposite directions to tension the tensioner 2812 and raise the platform 2850 within the cavity 2858 of the body 2802.

Figure 30:
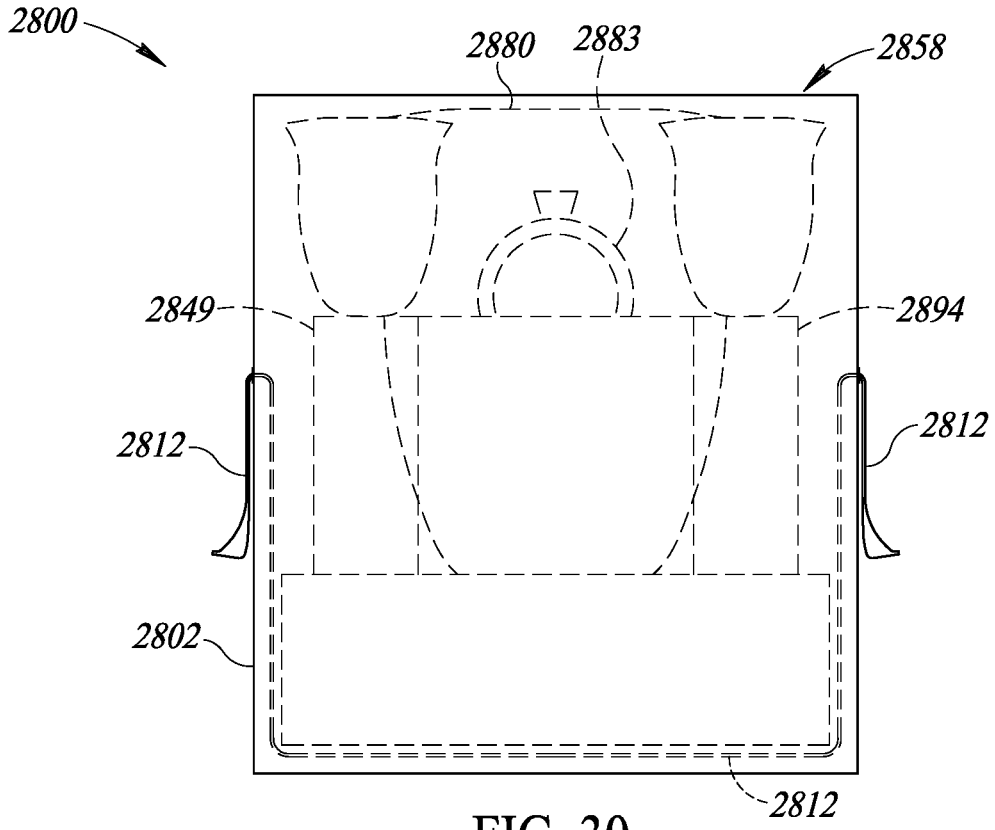
FIG. 30 is a diagram illustrating a side view of a portion of the system of the present invention.

FIG. 30 is a diagram illustrating a side view of a portion of the system 2800 of the present invention. The pedestals 2894 may be coupled to the platform 2850 to raise a mounting surface upon which one or more of the flowers 2808, such as smaller corner flowers 2808 situated in corners of the cavity 2858. The pedestals 2894 may be coupled to (e.g., using an adhesive, etc.), or formed integrally with, the platform 2850. The flowers 2808 may be coupled to the pedestals 2894 using any suitable method (e.g., adhesives, staples, etc.). The pedestals 2894 may include wells to position the flowers 2808 mounted thereto which may be similar to the wells of the platform 2850.

Each of the wells may include a graphical depiction of a flower to be inserted within. This graphical depiction may be printed or may be embossed in the corresponding well. For example, a well configured to receive a rose may have a rose shape or a depiction of a rose while a well configured to receive a tulip may have a shape or a depiction of a tulip. This may aid in the formation of a desired floral arrangement if desired.

Figure 31:
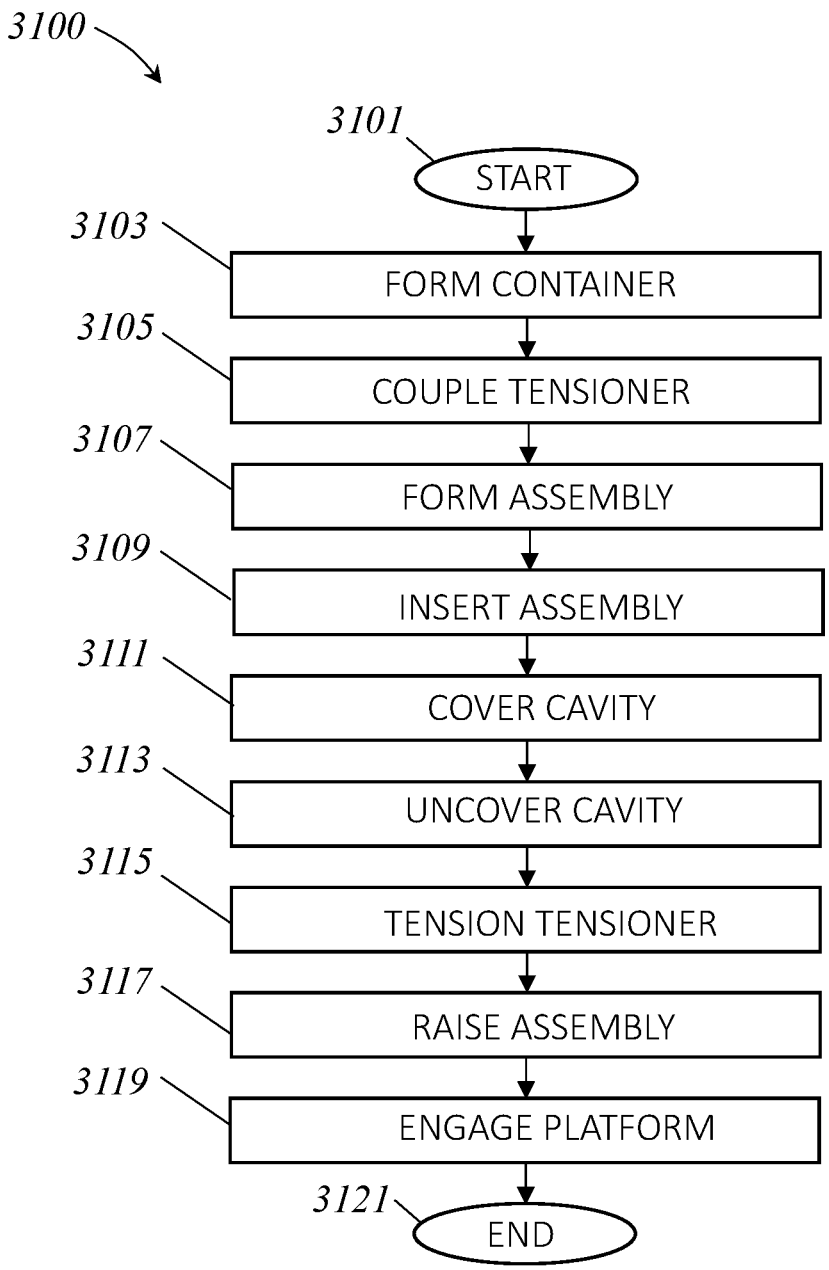
FIG. 31 is a flowchart which shows a portion of a process to form a flower container in accordance with embodiments of the present invention.

A method to form and/or use flower container in accordance with embodiments of the present invention will now be discussed with reference to FIG. 31; wherein FIG. 31 is a flowchart 3100 which shows a portion of a process to form a flower container in accordance with embodiments of the present invention. The process may be performed using one or more logic devices (e.g., controllers, processors, microprocessors, shift registers, gates, circuits, etc.) communicating over any suitable medium (e.g., a network) to obtain information from, and/or store information to, one or more memories which may be local and/or remote from each other. The process 3100 may communicate with one or more actuators and/or sensors. For example, the process may control one or more actuators or the like (e.g., motors (e.g., linear, rotary, robotic, etc.), solenoids, etc.) to perform desired actions to complete steps or acts (hereinafter both of which may be referred to as steps or acts) of the process and/or to form a container suitable for displaying articles such as flowers and the like in accordance with embodiments of the present system. The process may further receive feedback information from the one or more sensors (e.g., location sensors, proximity sensors, temperature sensors, orientation sensors, location sensors, image sensors, position sensors, optical sensors, angular displacement sensors, etc.) and act in accordance with the sensor information to perform acts in accordance with the process. It is envisioned that the process may control one or more robotic manipulation portions to perform acts of the process and/or may receive sensor information from the one or more manipulation portions. Thus, the process may control actuator of the robotic manipulation portions. The process may include one or more of the steps discussed below and may differ from the order in which they are described as may be desired with appropriate discretion. One or more of the following steps may be combined, separated into one or more sub-steps as may be desired, and/or may be skipped depending upon system and/or user settings. During the process, information generated and/or obtained by the process may be encrypted and/or stored for a desired duration (e.g., for a desired period of time) or longer as may be desired in a memory of the system. The process may start during step 3100 and then proceed to step 3103. For the sake of clarity, although only a single flower and platform will be discussed, it should be understood that a plurality of flowers and/or platforms may be employed in accordance with embodiments of the present system. Further, the process may be repeated a plurality of times. It is envisioned that the process 3100 may be operative to build a container in accordance with container build information (CBI) as discussed below with respect FIG. 32.

During step 3103, the process may form a container having a body which defines a cavity configured to receive an assembly including a platform and a flower attached thereto. The body may have one or more side walls which may define at least a portion of the cavity which may be configured to receive the assembly and provide for telescopic motion of the assembly relative to the one the one or more side walls. During this act, the process may further form one or more openings and/or corresponding insertion slits into the one or more side walls. The one or more openings may be suitable for receiving a grommet and/or a tensioner inserted therethrough. For example, the grommets may be inserted and secured to corresponding ones of the one or more openings.

The process may further form the grommets which may be coupled to, or formed integrally with, the body during the current step and/or other steps of the process. For example, if the body is formed from a plastic material, it may be heated to thermoform at least a portion of the grommets. It is envisioned that a spacer such as puck may be inserted into the cavity if desired. It is envisioned that the process may further form and/or obtain the body, the platform, the tensioner, the flower, the grommets, and/or other portions employed by embodiments of the present system. The platform may be configured to correspond with a shape and size of the cavity of the body so as to be operative with the body in accordance with embodiments of the present invention. After completing step 3103, the process may continue to step 3105.

During step 3105, the process may couple a tensioner to the platform. Accordingly, the process may insert portions of the tensioner into corresponding openings of the body (and/or through corresponding grommets) and may secure ends of the tensioner to the platform. For example, the free ends of the tensioner may be threaded through openings of the body (and/or through grommets placed in the respective opening) and thereafter coupled to the at least one platform to form a loop.

In some embodiments, the tensioner may be passed through the correspond openings of the body and the platform may be coupled to portions of the tensioner. The tensioner may have unattached opposed ends or may be formed into a loop and may be coupled to the platform. It is envisioned that the tensioner may be coupled (e.g., fixedly or slidably) to the platform. Ends of the tensioner may be joined or otherwise coupled using any suitable method such as a lap joint, a but joint, etc. After completing step 3105, the process may continue to step 3107.

During step 3107, the process may form the assembly including the platform and the flower attached thereto. Accordingly, the process may control any suitable coupling device to couple the flower (or flowers) to the platform using any suitable method such as adhesives, staples, etc. It is envisioned that prior to coupling the flower to the platform, the process may control a robotic manipulation portion to align the flower to the platform. Thereafter, the robotic manipulation portion may couple the flower to the platform. The robotic manipulation portion may couple one or more optional ring containers to the platform and/or the flower (or flowers). After completing step 3107, the process may continue to step 3109.

During step 3109, the process may insert the assembly including the platform and the flower (and/or optional ring container(s)) into the cavity of the body. The assembly may be placed in a fully recessed position (e.g., as opposed to a display position for displaying the flower). The platform may be loaded from the top or from the bottom of the body. When inserting the platform from into the body, it will be assumed that the bottom wall of the body is not attached and may be attached thereafter. The process may further insert any suitable pucks if desired to adjust a height of the platform relative to the body. After completing step 3109, the process may continue to step 3111.

During step 3111, the process may cover (e.g., close) the cavity of the body using any suitable method. For example, the process may install, or otherwise position, an optional cover on the body using any suitable method to cover an opening to the cavity of the body. Depending upon cover type, the cover may fit using a male or a female interference fit. In some embodiments it is envisioned that the cover may be hinged or otherwise coupled to the body. In some embodiments, the cover may be formed from a film (e.g., a polymer film or the like having one or more layers, etc.) which may be coupled to the body using any suitable method such as adhesives, friction or thermo welding, etc.

The cover may include a cavity in which an insert (e.g., a card, a mirror, etc.) may be placed. This insert may include graphics, text, an electronic greeting card, etc. and may include an area for receiving a note, text, and/or graphics. The process may print and/or form all or part of the insert. For example, the process may generate a card or note on an insert and/or may couple the insert to the cover in accordance with embodiments of the present system. After completing step 3111, the process may continue to step 3113. At this point, the container including the platform and the flower may be completed.

During step 3113, the cavity (of the body) may be uncovered (e.g., opened) by manipulating the optional cover, or portions thereof, to expose the cavity of the body using any suitable method. For example, the cover may be removed or may be opened to expose the cavity of the body. If the cover comprises a film all or a portion thereof may be peeled away from the body and/or any portion of the cover which is to remain coupled to the body. After competing step 3113 the process may continue to step 3115.

During step 3115, the tensioner may be tensioned using any suitable method. For example, tension may be applied to one or more ends or portions of the tensioner that are outside of the cavity of the body such that a force may be applied via the tensioner to the platform. This force may telescopically raise the platform relative to the body. For example, the tensioned tensioner may transfer a force from a support point at a side wall of the container to the platform of the assembly. After completing step 3115, the process may continue to step 3117.

During act 3117, the assembly may be raised such that at least a portion of the flower and/or platform may be raised out of the cavity of the body by a desired amount so as to be fully or substantially raised from the cavity of the body as discussed elsewhere in this application. When fully or substantially raised, at least a portion of the flower and/or a portion of the platform may be raised above a cavity or top wall of the body depending upon a desired configuration of the assembly and/or the body. In accordance with some embodiments, a user may raise the platform by a desired amount. After completing step 3117, the process may continue to step 3119.

During step 3119, the process may engage the platform to secure it relative to the body. For example, an interference fit between adjacent portions of the body and the platform may secure the platform in the fully or substantially raised position relative to the body. It is envisioned that any suitable method to engage the platform in the fully or substantially raised position such as an interference fit, a tab and/or a notch, dimpling, a magnetic lock, etc. (which may be actively or passively activated) may be provided to lock the platform in position relative to the body. In yet other embodiments, it is envisioned that the platform lock may be engaged at other positions as may be desired. After completing step 3119, the process may continue to step 3121 where it may end.

Figure 32:
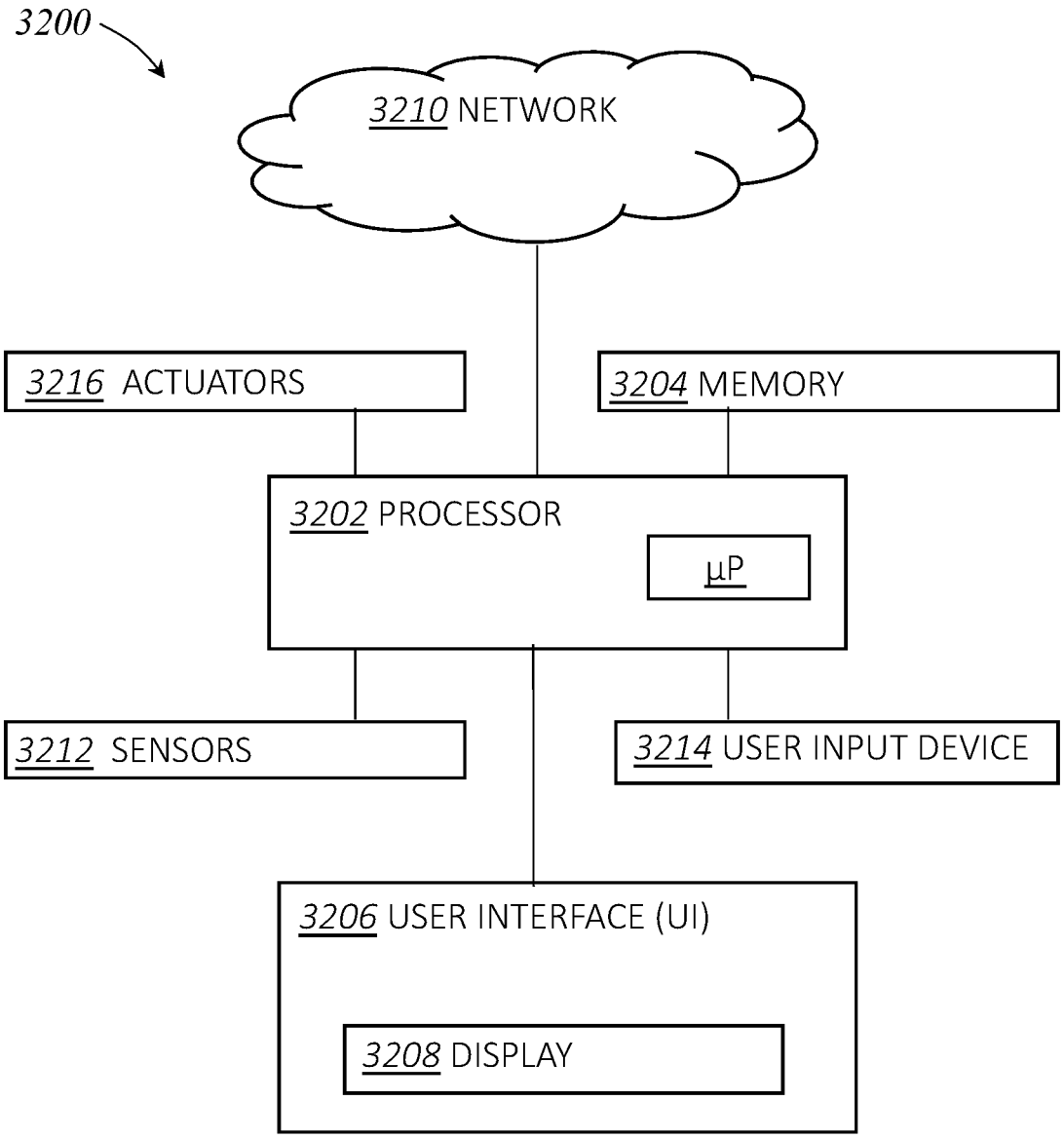
FIG. 32 is a diagram illustrating a schematic view of a portion of an example system in accordance with embodiments of the present invention.

FIG. 32 is a diagram illustrating a schematic view of a portion of an example system 3200 (hereinafter system 3200) in accordance with embodiments of the present invention.

In accordance with some embodiments, a portion of the present system may include one or more of a processor 3202 operationally coupled to a memory 3204, a user interface (UI) 3206 including a rendering device such as a display 3208 or the like, sensors 3212, a communication network 3210, a user input device 3214, and actuators 3216, communicatively coupled to each other. In accordance with some embodiments, portions of the system 3200, such as one or more of the processor 3202, the memory 3204, the user interface (UI) 3206, the sensors 3212, the communication network 3210, the user input device 3214, and/or the actuators 3216, may be distributed over a network such as the network 3210.

The processor 3202 may control the overall operation of the system 3200 and may include one or more logic devices such as processors, controllers, micro-processors (pPs), shift registers, gates, circuits, and/or the like. These logic devices may be local or distributed throughout the system 3200 using one or more logic devices.

The memory 3204 may include any suitable memory such as non-volatile memories, etc. The memory 3204 may include one or more memories which may be local and/or distributed. For example, the memory 3204 may include a distributed memory such as a cloud storage network and/or the like.

The UI 3206 may include any suitable rendering device which may render information generated by the system 3200 for the convenience of the user such as a display (e.g., the display 3208), a speaker, a haptic device (e.g., a vibrator, etc.), and/or the like. For example, the display 3208 may include a touchscreen display.

The sensors 3212 may include any suitable sensor or sensors which may sense information, generate corresponding sensor information, and/or may provide this sensor information to the processor 3202 for further analysis in accordance with embodiments of the present system. The sensors 3212 may include, for example, one or more of temperature sensors, pressure sensors, optical sensors, image sensors, lighting sensors, rotational sensors, position sensors, acceleration sensors, velocity sensors, etc. each of which may sense corresponding information and generate corresponding sensor information. For example, the temperature sensors may sense temperature at one or more portions of the system 3200 and generate corresponding temperature information while a position sensor may sense position of one or more portions of the system 3200 and generate corresponding position information. Then the generated sensor information may then be provided to the processor 3202 for further processing.

The communication network 3210 may include any suitable communication network which may communicatively couple one or more of the processor 3202, the memory 3204, the user interface (UI) 3206, the sensors 3212 the user input device 3214, and/or the actuators 3216 to each other. The communication network 3210 may include any suitable wired and/or wireless communication network such as a local area network (LAN), a wide-area network (WAN), the Internet, an intranet, a proprietary network, an ad-hoc network, a telephony network, a cellular network, a bus, a controller area network (CAN) bus, etc.

The actuators 3216 may include one or more actuators such as linear actuators, rotary actuators, solenoids, motors, pneumatic actuators, hydraulic actuators, magnetic actuators, positioning actuators, fillers, labelers, etc. which may change position, rotation, and/or orientation of portions of the system 3200 and/or a container or portions thereof such as inserts, flowers, platforms, tensioners, bodies, covers, etc. For example, the actuators 3216 may include a robotic actuator which may manipulate one or more portions of the system along or about one or more axes and/or to obtain, manipulate and/or form one or more portions of a container in accordance with embodiments of the present system.

The user input device 3214 may include any suitable device with which a user may enter, input, or select information such as a touch-screen display or touch-sensitive display, a keyboard, a mouse, a trackball, a microphone, a camera or image sensor, etc., which may be stand alone or part of the system 3200, such as part of a personal computer, a personal digital assistant (PDA), a mobile phone (e.g., a smart phone), a monitor, a tablet (e.g., an IPAD™ etc.), a smart or dumb terminal or other device for communicating with the processor 3202 via any operable link such as a wired and/or wireless communication link via the network 3210.

The user input device 3214 be operable for interacting with the processor 3202 including enabling interaction within the UI 3206 as described herein. It is envisioned that one or more of the processor 3202, the memory 3204, the user interface 3206, the sensors 3212, the actuators 3216, and/or user the input device 3214 may form at least a portion of a computer system or other device such as a client and/or server device. It is further envisioned that one or more of the processor 3202, the memory 3204, the user interface 3206, the sensors 3212, the actuators 3216, and/or user the input device 3214 may form a node in a computer system having a plurality of nodes.

It is envisioned that methods of the present system may be particularly suited to be carried out by a computer software program, such program including modules corresponding to one or more of the individual steps or acts described and/or envisioned by the present system. Such program may be embodied in a computer-readable medium, such as an integrated chip, a peripheral device or memory, such as the memory 3204 or other memory coupled to the processor 3202.

The program and/or program portions contained in the memory 3204 may configure the processor 3202 to implement the methods, operational acts, and functions disclosed herein. The memories may be distributed, for example between the clients and/or servers, or local, and the processor 3202, where additional processors may be provided, may also be distributed or may be singular. The memories may be implemented using any suitable storage device or method such as electrical, magnetic, or optical memory, or any combination of these or other types of storage devices. Moreover, the term "memory" should be construed broadly enough to encompass any information able to be read from or written to an address in an addressable space accessible by the processor 3204. With this definition, information accessible through a network such as the network 3210 may still be within the memory 3204, for instance, because the processor 3202 may retrieve the information from the network 3210 for operation in accordance with the present system.

Operation acts performed by the system 3200 may include obtaining sensor information from one or more of the sensors 3212, analyzing the sensor information, and controlling the one or more actuators 3216 to manipulate and/or form at least a portion of a container in accordance with container build information (CBI) and the sensor information in accordance with embodiments of the present system. The CBI may be set by the system and/or user and may be stored in a memory of the system 3200 such as the memory 3204 for later use. The CBI may set forth instructions for use by the system 3200 to generate at least one corresponding container.

The CBI may include information related to, for example, container size (e.g., small, medium, large, etc.), shape, (e.g., circular, oval, cross, star, heart shaped, etc.), color (e.g., blue, red, silver, etc.), number of flowers (e.g., 1, 4, etc.), type of flowers (e.g., rose, iris, marigold, etc.), colors of flowers, type of tensioner (e.g., rope, cable, beaded, etc.), color of tensioner or portions thereof (e.g., blue, silver, white pearls, etc.), insert print (e.g., text, graphics, etc. of insert), insert style (e.g., round, square, etc.), insert material, insert color, etc.

Accordingly, it is envisioned that the controller 3202 may generate a GUI (e.g., which may be referred to as a CBI selection GUI) with which the user may select and/or set the CBI or portions thereof. For example, the CBI selection GUI may include a plurality of selection items for the user to select information related to the CBI such as the container size (e.g., small, medium, large, etc.), container shape, (e.g., circular, oval, cross, star, heart shaped, etc.), container color (e.g., blue, red, silver, etc.), number of flowers (e.g., 1, 4, etc.), type of flowers (e.g., rose, iris, marigold, etc.), colors of flowers, type of tensioner (e.g., rope, cable, beaded, etc.), color of tensioner or portions thereof (e.g., blue, silver, white pearls, etc.), insert (e.g., text, graphics, etc. of insert.). Once selected, the system 3200 may store the completed CBI in the memory 3204 for later use such for building a container in accordance with the CBI.

In accordance with embodiments of the present system the tensioner may have first and second ends. The first end or portion of the tensioner may be fixedly coupled to a wall of the body such that tension may be applied between the tensioner and the body. A height at which this coupling is fixed should be sufficient to fully raise a platform coupled to the tensioner to the fully or substantially raised position relative to the body. Accordingly, when tension is applied to the tensioner (e.g., by pulling on only a single end of the tensioner), this tension may result in a force being applied to the platform so as to raise the platform and a flower attached thereto to the fully or substantially raised position.

In accordance with some embodiments, it is envisioned that the platform may be lowered from a raised position such as a partially, substantially or fully raised position (hereinafter each of which may be referred to as a raised position unless the context indicates otherwise) to fully or substantially recessed position (hereinafter each of which may be referred to as a lowered position unless the context indicates otherwise). In the recessed position the flower may be situated partially or fully within the cavity of the body such as for shipping and/or storage. The platform may be urged (e.g., lowered) from the raised position to the lowered position by grasping a suitable portion of the platform (e.g., or portions coupled thereto such as the cap, staple, or tensioning member) and pulling the grasped potion towards or through the second opening so as to move the platform towards the bottom wall of the body. In some embodiments, a tab suitable for grasping by a user may be provided.

The tab may be formed integrally with the platform and/or portions coupled thereto such as one or more of the staple (e.g., 148, FIG. 4A), the cap (e.g., see, 145, FIG. 4A), the tensioning member(s) (e.g., see 112, FIG. 4A). For example, a portion of the tensioning member that may be situated within the cavity of the body may form a tab suitable for grasping by a user through an opening defined by the bottom edge (e.g., see, 153, FIG. 4A) and/or the bottom wall. This opening may define at least a portion of the second opening and may be opposite the first opening. The second opening may be sized and/or shaped to support the platform when the platform is in a lowered position. The cavity may be located between the first and second openings and may be configured to receive a platform including a flower. This is illustrated with reference to FIG. 33 below.

Figure 33:
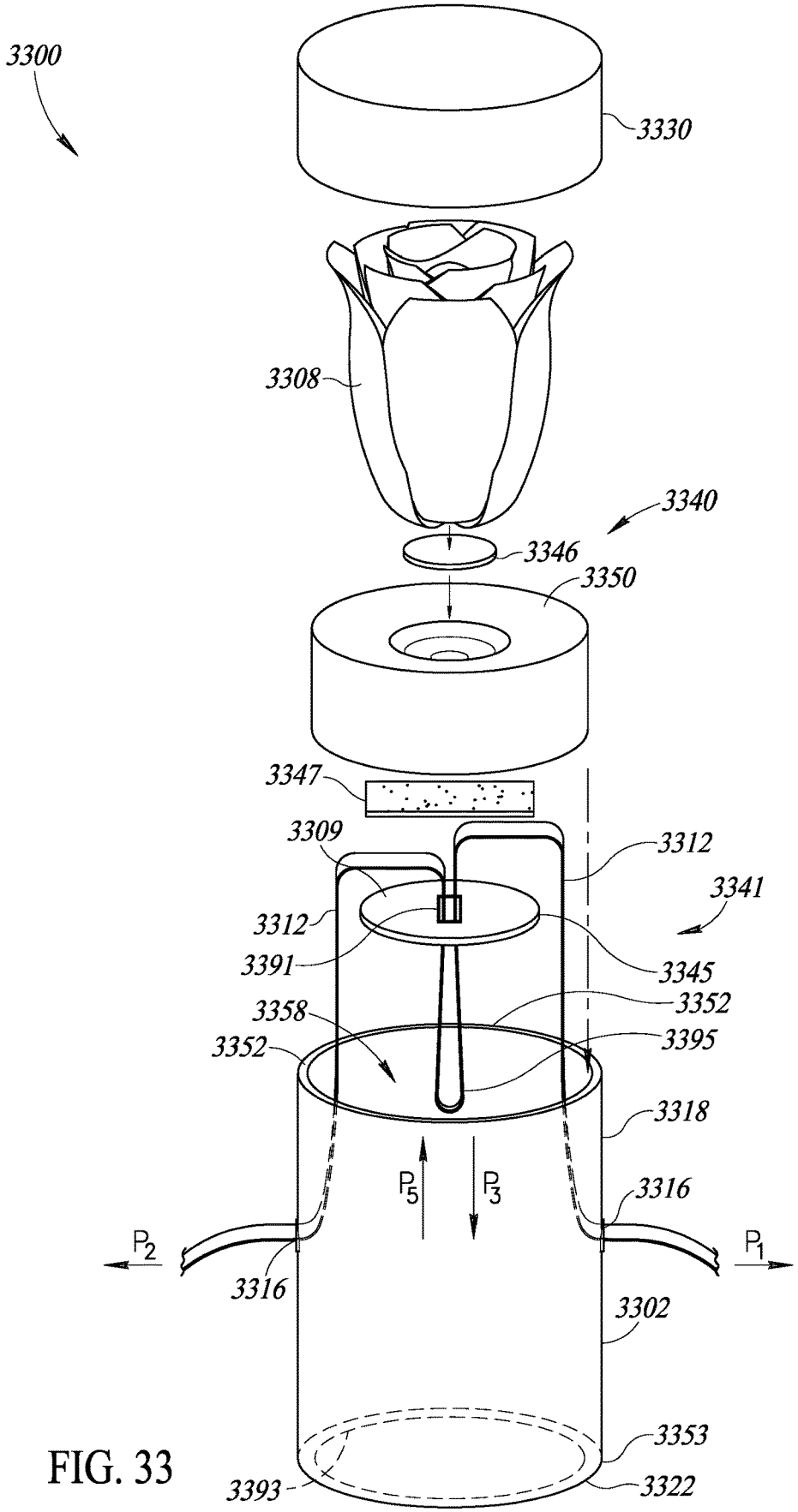
FIG. 33 is a diagram illustrating a partially exploded perspective front view of an example flower container of the present invention according to an eleventh embodiment.

FIG. 33 is a diagram illustrating a partially exploded perspective front view of an example flower container (hereinafter system 3300 for the sake of clarity) of the present invention according to an eleventh embodiment. The rear perspective view may be similar. Portions of at least one tensioner 3312 may extend through a corresponding opening 3316 of openings 3316 situated in at least one side wall 3318 of a body 3302 having the at least one side wall 3318. Portions of the at least one side wall 3318 may extend between top and bottom ends (3352, 3353, respectively) and may define at least a portion of a cavity 3358 configured to receive a platform 3350. The top end 3352 of the at least one side wall 3318 may define a first opening leading to the cavity 3358. A coupler 3341 may couple the at least one tensioner 3312 to the platform 3350 using any suitable coupling method or methods. A coupler 3340 may couple a flower 3308 to the platform 3350 using any suitable coupling method such as an adhesive 3346 and/or a fastener such as one or more staples, etc. One or more of the platform 3350, the flower 3308, and the tensioner 3312 (or portions thereof) may be situated within, or inserted into, the cavity 3358 of the body 3302. The coupler 3341 may include one or more adhesive layers or films such as an adhesive 3347 (e.g., similar to 147, FIG. 4A) and a cap 3345 which may include an adhesive layer 3309 disposed on a surface thereof. The cap 3345 may include one or more openings, notches, and/or cutaways, such as at least one opening 3391, configured to receive portions of the tensioner 3312 which may form a loop or tab 3395 (hereinafter both of which may be commonly referred to as a tab 3395 unless the context indicates otherwise) suitable for grasping by the user. The adhesive layer 3309 may couple the cap 3345 and/or the tensioner to 3312 to the platform 3350 and may include any suitable adhesive such as a pressure sensitive adhesive (PSA) or the like. However, other types of adhesives are also envisioned. The body 3302 may include an optional bottom wall 3322 having at least one opening 3393 configured to provide for a user to grasp the tab 3395.

During use, pulling on portions of the at least one tensioner 3312 that may extend through a corresponding opening 3316 of openings 3316 in opposite directions as illustrated by arrows P1 and P2 may cause the at least one tensioner 3312 to apply a force which may raise or otherwise elevate the platform 3350 (e.g., in the direction of arrow P5) and the flower 3308 attached thereto to a fully or substantially raised position and (assuming the platform is partially, fully, or substantially raised) pulling of the tab 3395 of the at least one tensioner 3312 in the direction of arrow P3 may apply a force to the platform 3350 which force may urge the platform 3350 and the flower 3308 attached thereto towards the second opening (e.g., lower the platform in the direction arrow P3) to a lowered position (e.g., to a stored or fully or substantially recessed). Movement of the platform 3350 may be limited by the bottom wall 3302 upon contact of the platform 3350 with the bottom wall 3302. An optional cover 3330 may be removably attached to the body 3302 to cover the flower 3308 situated within the cavity 3358 and may be removed before use such as when raising the platform 3350 and the flower 3308 attached thereto from within the cavity 3358.

Figure 34:
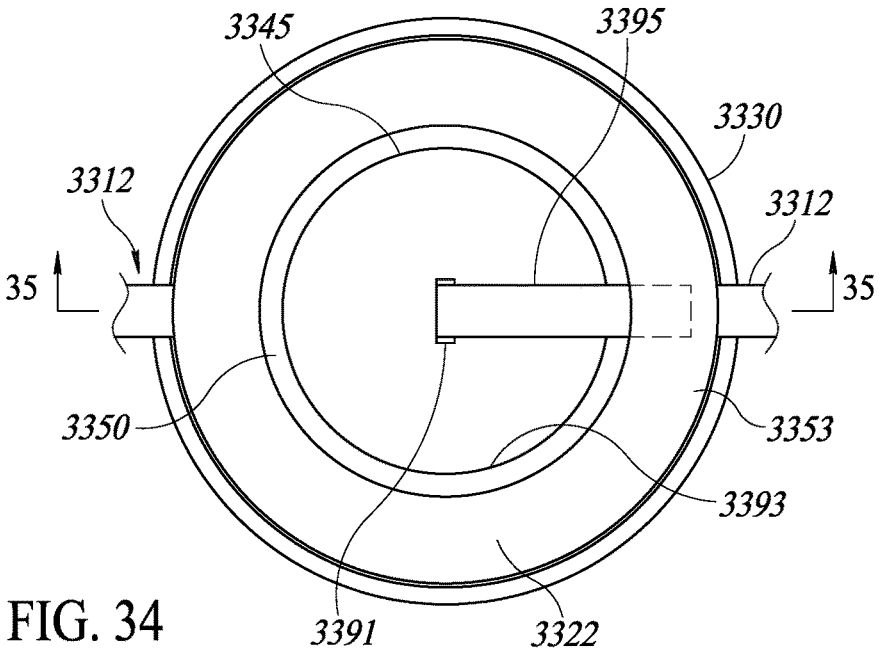
FIG. 34 is a diagram illustrating a bottom view of a portion of the system of the present invention.

FIG. 34 is a diagram illustrating a bottom view of a portion of the system 3300 of the present invention. The bottom wall 3322 may include an opening 3393 that may define a second opening through which a portion of one or more of the platform 3350, the cap 3345, and the tab 3395 may be seen. When the platform 3350 is in the raised position the tab 3395 may be grasped by a user via the second opening. The cap 3345 may be shaped or sized such that is may be equal to, or smaller than (as shown), the platform 3350 to which it is coupled and may cover a lower portion of the platform 3350. For the sake of clarity, it will be assumed that the cap 3345 may be a portion of the platform 3350. In some embodiments the cap 3350 may be embossed and/or include text and/or graphics. In some embodiments the at least one opening in the bottom wall and/or the at least one side wall may define at least a portion of the second opening.

Figure 35:
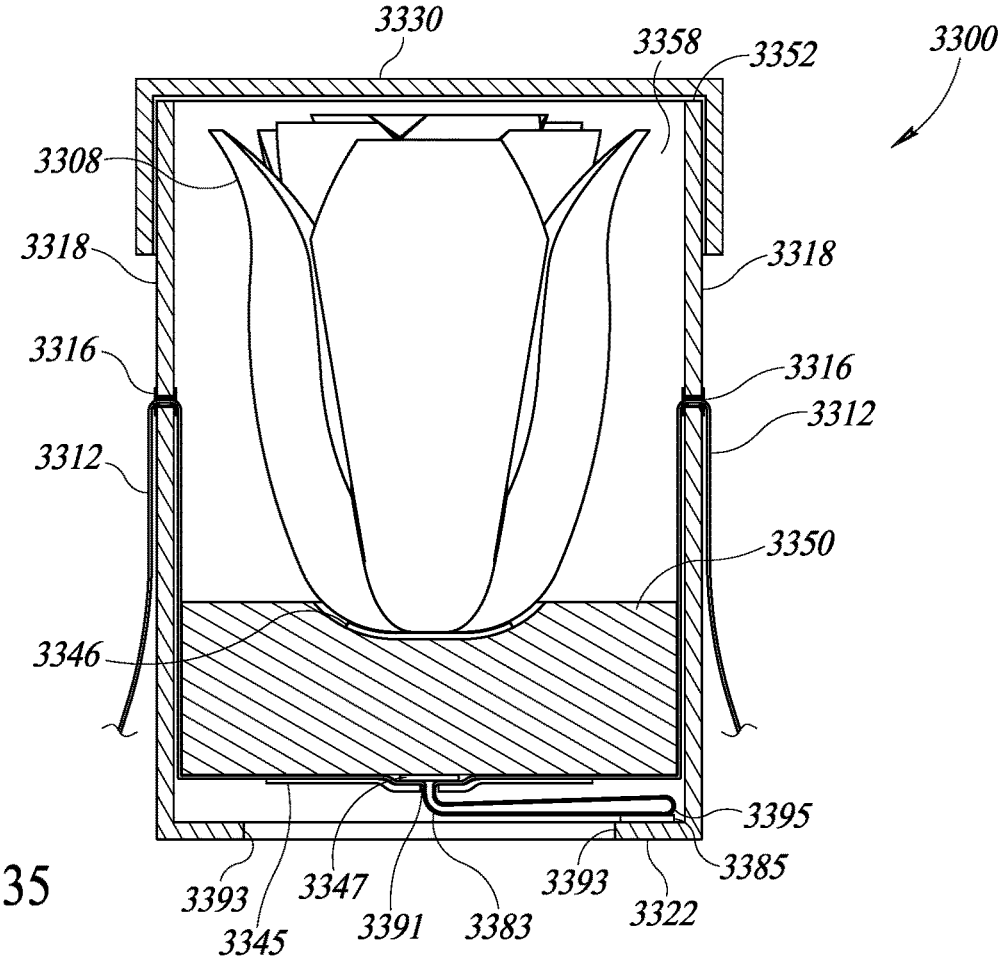
FIG. 35 is a diagram illustrating a cross-sectional view of a portion of the system of the present invention taken along lines 35-35 of FIG. 34.

FIG. 35 is a diagram illustrating a cross-sectional view of a portion of the system 3300 of the present invention taken along lines 35-35 of FIG. 34. The tab 3395 may be folded at fold 3383 to a side of the body 3302 (within the cavity) and may be situated between the platform 3350 and the bottom wall 3322. A releasable coupler such as a releasable adhesive 3385 may be configured to releasably couple the tab 3395 in the folded position to a portion of the bottom wall 3322 such that the tab 3395 may separate from the bottom wall 3322 and unfolded when the platform 3350 is fully or partially raised. The bottom wall 3322 may be formed integrally with, or separately from, the at least one side wall 3318. In some embodiments, the releasable coupler may include fasteners (e.g., hook and loop type fasteners such as Velcro™ or the like) or may include a notch or slit may be configured to releasably couple the tab 3995 to the bottom wall 3322.

In some embodiments, it is envisioned that the platform may be urged from the lowered position to the raised position by applying a force through a second opening of the body against a bottom portion of the platform in the direction of the first opening. The bottom portion of the platform may be defined as that portion of the platform that is covered by the cap and/or is opposite that portion of the platform to which the flower is coupled. This force may urge the platform from the lowered position to the raised position. When in the raised position, it is assumed that one or more flowers attached to the platform may extend fully or partially through the first opening of the body. The platform may be lowered from the raised position to a lowered position (in which the flower may be situated partially or fully within the cavity of the body such as for shipping and/or storage) by grasping a tab coupled to the platform (e.g., or portions coupled thereto such as the cap, staple, or pull tab or loop) and pulling the grasped potion towards or through the second opening of the body so as to urge the platform towards the second opening (or optional bottom wall) of the body. This is illustrated with reference to FIG. 36 below.

Figure 36:
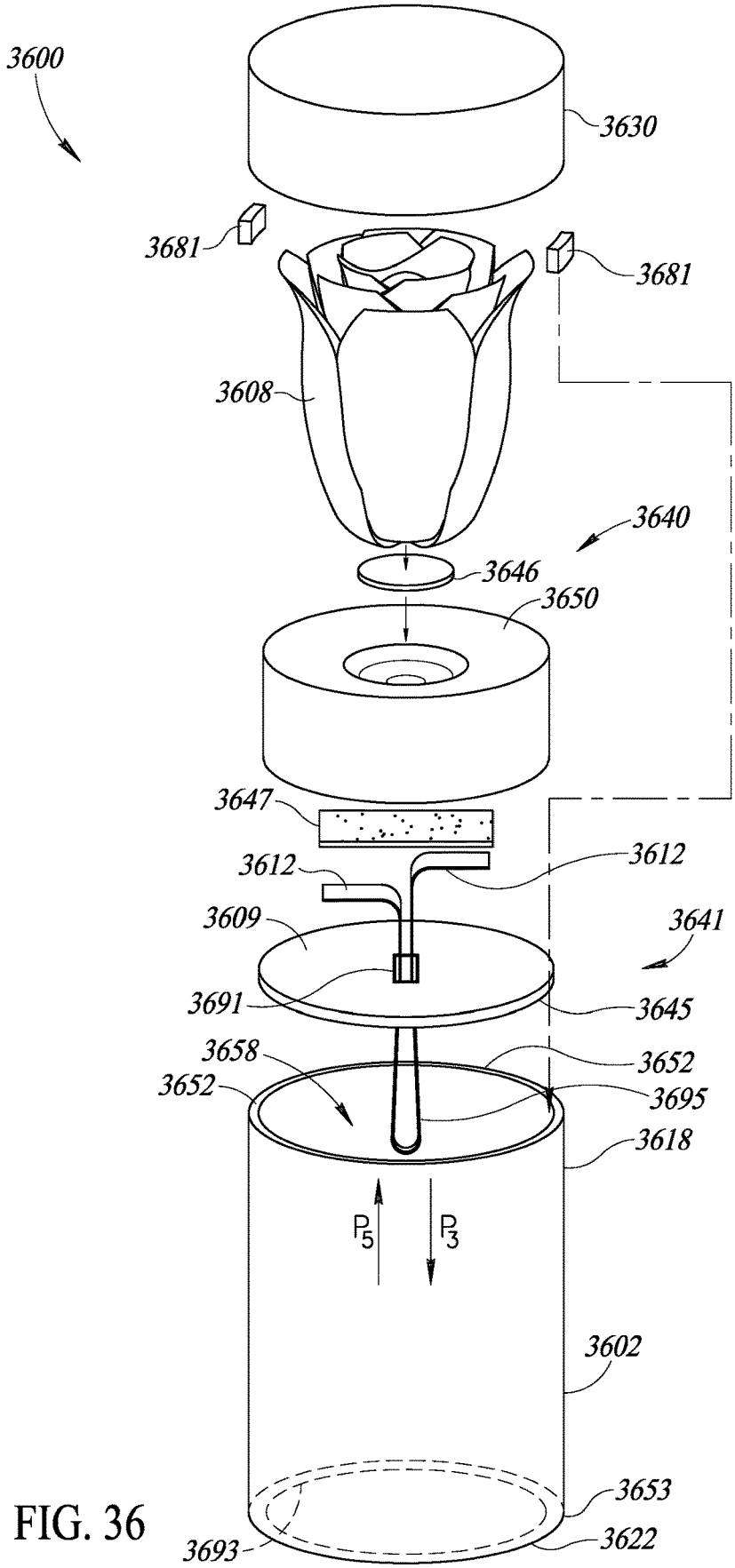
FIG. 36 is a diagram illustrating a partially exploded perspective front view of an example flower container of the present invention according to an twelfth embodiment.

FIG. 36 is a diagram illustrating a partially exploded perspective front view of an example flower container (hereinafter system 3600 for the sake of clarity) of the present invention according to an twelfth embodiment. The rear perspective view may be similar.

A body 3602 may have at least one side wall 3618 and may extend between top and bottom ends (3652, 3653, respectively, or first and second ends 3652 and 3653, respectively). The body 3602 may define at least a portion of a cavity 3658 which may be configured to receive a platform 3650. The top end 3652 may define at least a portion of a first opening leading to the cavity 3658. A coupler 3641 may couple at least one tensioner 3612 to the platform 3650 using any suitable coupling method or methods. A coupler 3640 may couple a flower 3608 to the platform 3650 using any suitable coupling method or methods such as an adhesive 3646 and/or one or more fasteners such as staples, etc. One or more of the platform 3650, the attached flower 3608, and the at least one tensioner 3612 (or portions thereof) may be situated within, or inserted into, the cavity 3658 of the body 3602 via the first opening (or the second in some embodiments). The coupler 3641 may include one or more adhesive layers or film such as an adhesive 3647 (e.g., similar to 147, FIG. 4A) and a cap 3645 which may include an adhesive layer 3609 situated upon a surface thereof.

The cap 3645 may include one or more openings, notches, and/or cutaways, such as at least one opening 3691, and may be configured to receive portions of the at least one tensioner 3612 so as to form a loop or a tab 3695 (hereinafter both of which may be commonly referred to as the tab 3695 unless the context indicates otherwise) suitable for grasping by the user. The adhesive layer 3609 may couple the cap 3645 and/or the tensioner to 3612 to the platform 3650. Once coupled, it will be assumed that the platform 3650 may include the cap 3654 for the sake of clarity. The cap 3654 may be embossed and/or include graphics or text such as operating instructions as may be desired. The bottom wall 3622 may be configured to limit travel of the platform 3650 at the lowered position (e.g., the fully or substantially recessed position).

The body 3602 may include a bottom wall 3622 having at least one opening 3693 defining at least a portion of the second opening and configured to provide for a user to grasp the tab 3395 during use such as when the platform is in the raised position. The cap 3654 may have the same or similar shape and/or size as the platform 3650 or may have a different shape and/or size as the platform 3650.

It is envisioned that the platform 3650 may be raised from the lowered position to the raised position by applying a force against it towards the first opening (e.g., in the direction of arrow P5). This force may urge the platform 3650 towards the first opening. This force may be applied by inserting an object (e.g., one or more fingers of a user, a stick, a pencil, etc.) through the second opening and against the cap 3545 (e.g., a bottom side of the platform 3650) to raise the platform 3650 to the raised position. Accordingly, the platform 3650 and the flower 3308 attached thereto may be urged to a raised position (e.g., the fully raised position). When in the raised position, the platform 3650 may then be lowered by pulling on the tab 3695 (e.g., in the direction of arrow P3) to transfer a force to the platform 3650 which force may be operative to urge the platform 3650 (and the flower 3608 attached thereto) towards the bottom wall 3622 to the lowered position. The bottom wall 3622 may be operative to limit travel (e.g., to check travel) of the platform 3622 when the platform 3650 is in the lowered position (e.g., stored or fully or substantially recessed). This may enable a user to raise the platform 3650 and the flower 3608 attached thereto to a desired height relative to the body 3602.

An optional cover 3630 may be attached to the body 3602 to cover the flower 3608 situated within the cavity 3658 and may be removed before use. The optional cover 3630 may be removable and may be reattached when desired (e.g., assuming that the platform 3650 is in the lowered position.

A limiter, such as flanges 3681 and/or the like, may limit travel of the platform 3650 relative to the body 3602. The limiter may be formed from one or more portions such as the flanges 3681 or may be formed from a single portion such as a ring (e.g., a snap ring, etc.) and/or the like that may be coupled to the body 3602. For example, a ring or cylinder may be inserted into the cavity 3658 and may be coupled to an inner wall of the at least one wall 3618 of the body 3602 to limit travel of the platform 3650 at the raised position. The limiter may be fastened to the body 3602 using any suitable method or methods. In some embodiments, the limiter may be fastened to the body 3602 using any suitable method or methods such as fasteners (staples, adhesives, epoxies, welds, etc.), interference fits, etc. It is envisioned that in some embodiments, the limiter may be formed integrally with the body such as by dimpling the body 3602 inwards towards the cavity 3658 and/or by rolling the top end 3652 of the body 3602 into the cavity 3658. In yet other embodiments, the limiter may include an adhesive pad or patch coupled to the body 3602 using an adhesive such as a pressure sensitive adhesive. In some embodiments, it is envisioned that the limiter may include a strip formed from any suitable material such as cloth (e.g., a cloth ribbon), felt, foam, plastic, rubber, woven, non-woven, strip that may be coupled to the body 3602 to limit travel of the platform 3650 at its raised position. This strip may be continuous or discontinuous. For the sake of clarity, it will be assumed that the platform 3650 may include the cap 3645. Accordingly, a force applied to the cap 3645 may be considered as being applied to the platform 3650 directly.

Figure 37:
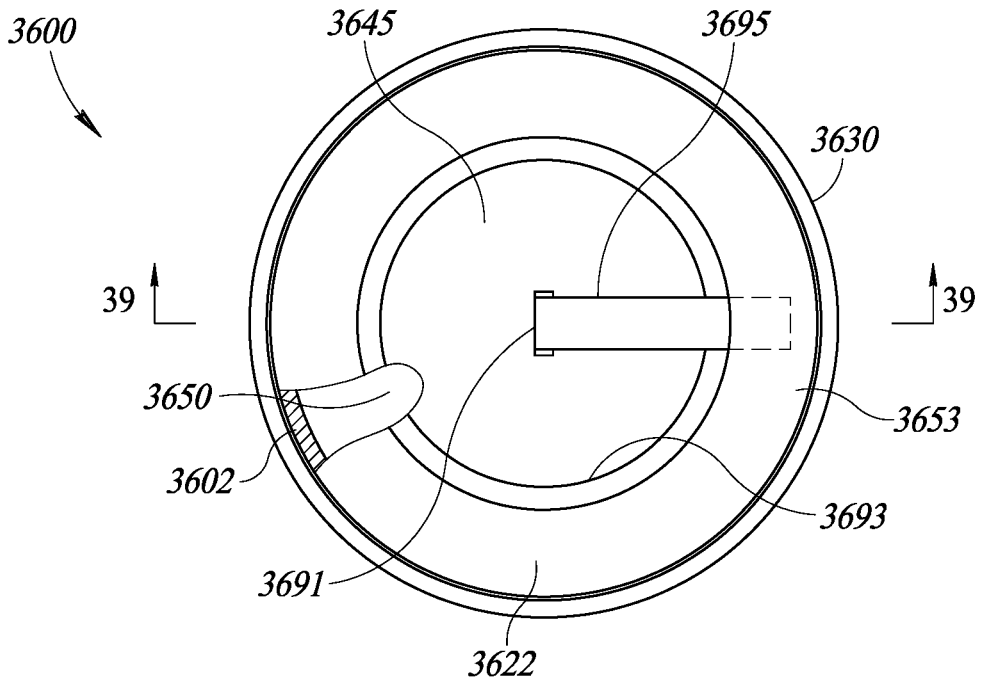
FIG. 37 is a diagram illustrating a partially cutaway bottom view of a portion of the system of the present invention.

FIG. 37 is a diagram illustrating a partially cutaway bottom view of a portion of the system 3700 of the present invention. A portion of one or more of the platform 3650, the cap 3645, the tab 3695, and the opening 3691, are seen through the at least one opening 3693 in the bottom wall 3622. In the present embodiments the at least one opening 3693 defines the second opening to the cavity 3658. The cap 3645 may be shaped or sized such that is may be equal to, or smaller than (as shown), the platform 3650 to which it is coupled.

Figure 38:
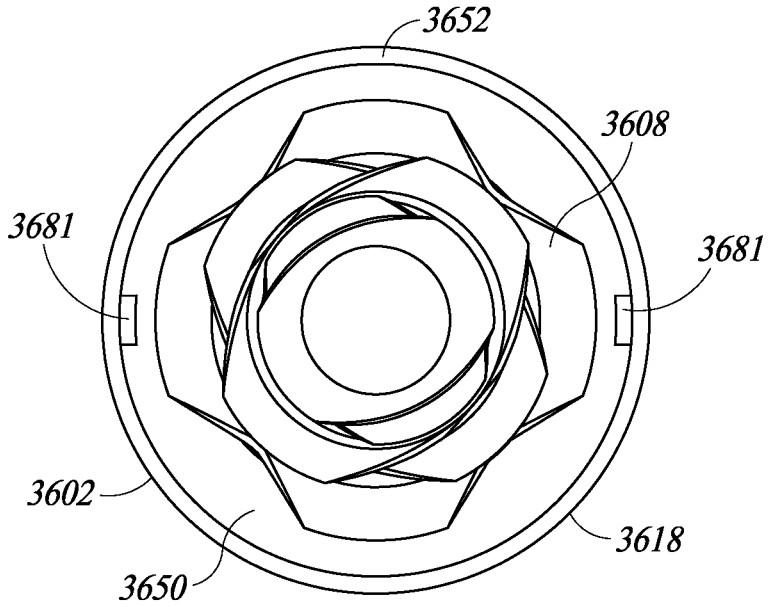
FIG. 38 is a diagram illustrating a top view of a portion of the system 3700 of the present invention with the cover removed.

FIG. 38 is a diagram illustrating a top view of a portion of the system 3700 of the present invention with the cover removed. The flower 3608 may be coupled to the platform 3650 and may be located within the cavity 3658 of the body 3602.

Figure 40:
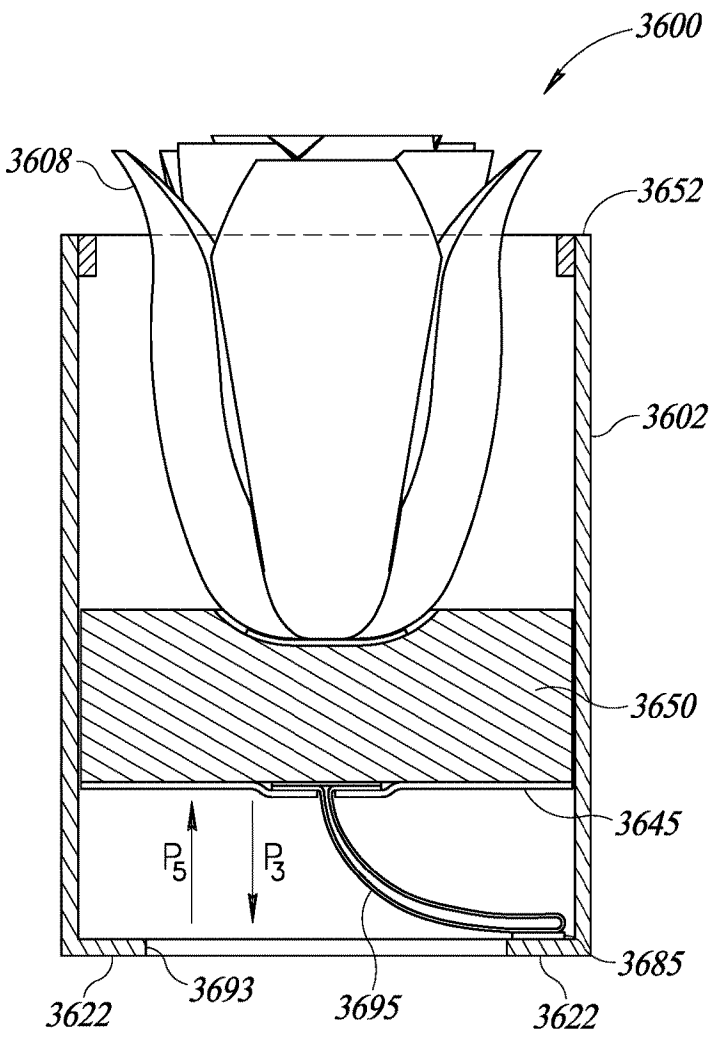
FIG. 40 is a diagram illustrating a cross-sectional view of a portion of the system of the present invention shown in a partially raised position.
Figure 39:
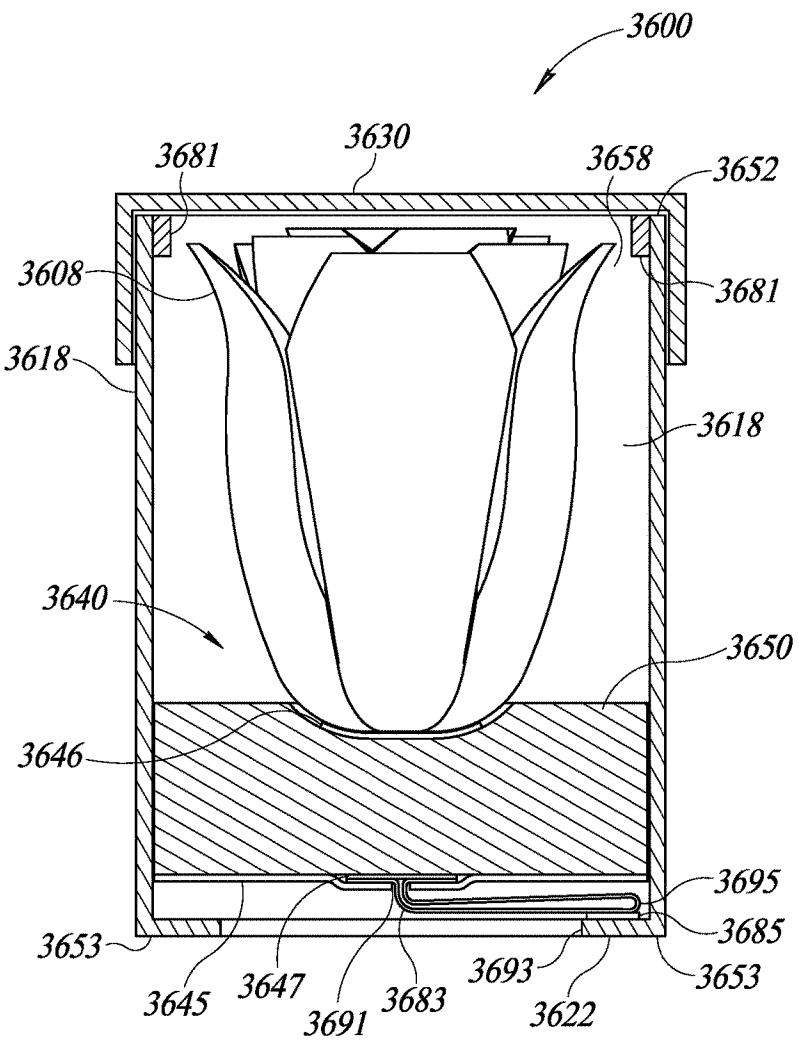
FIG. 39 is a diagram illustrating a cross-sectional view of a portion of the system of the present invention taken along lines 39-39 of FIG. 37.

FIG. 39 is a diagram illustrating a cross-sectional view of a portion of the system 3600 of the present invention taken along lines 39-39 of FIG. 37. The tab 3695 may be folded (e.g., at fold 3683) to the side (e.g., towards the at least one side wall 3618) and may be situated between the platform 3650 and a portion of the bottom wall 3622. A releasable coupler, such as a releasable adhesive (or cohesive) 3685, may be configured to releasably couple the tab 3695 in the folded position to a portion of the bottom wall 3622 such that the tab 3695 may separate from the bottom wall 3622 and unfold when the platform 3650 is fully or partially raised as illustrated in FIG. 40 which is a diagram illustrating a cross-sectional view of a portion of the system 3600 of the present invention shown in a partially raised position. As the platform 3650 is moved away from the bottom wall 3622 and partially raised, the tab 3695 may unfold and/or be pulled away from the bottom wall 3622.

Figure 41:
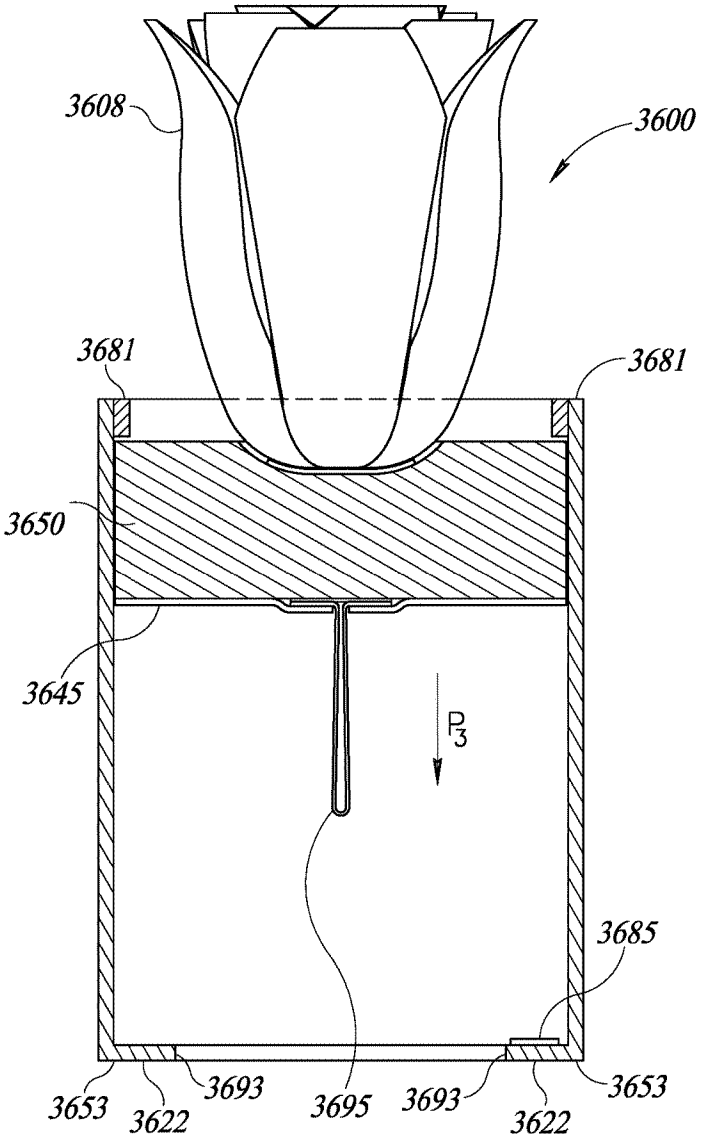
FIG. 41 is a diagram illustrating a cross-sectional view of a portion of the system of the present invention shown in the raised position.

FIG. 41 is a diagram illustrating a cross-sectional view of a portion of the system 3600 of the present invention shown in the raised position. When the platform 3650 is in the raised position, the tab 3695 may be decoupled from the bottom wall 3622. Travel of the platform 3650 may be checked by the flanges 3681 of the limiter. To lower the platform 3650 to the lowered position, a user may grasp the tab 3695 via the second opening and/or the at least one opening 3693 of the bottom wall 3622 and pull the tab 3695 fully or partially through the second opening and/or the opening 3693 of the bottom wall 3622 to apply a force to the platform which force may urge the platform 3650 towards the second opening and/or the at least one opening 3693 of the bottom wall 3622 in the direction indicated by arrow P3. The at least one opening 3693 may define at least part of the second opening and may be shaped and sized to provide access to the bottom of the platform 3650 such that a user may grasp the tab 3695 and may pull on the tab 3695 to apply the force (e.g., in the direction of P3) which force may be transferred to the platform 3650 coupled to the tab 3695 to urge the platform 3650 in the corresponding direction. The tab 3695 may have a length suitable for grasping by a user when the platform 3650 is in the fully raised position and may extend to or through the opening 3693 of the bottom wall 3622 when the platform 3650 is in the lowered position.

Figure 42:
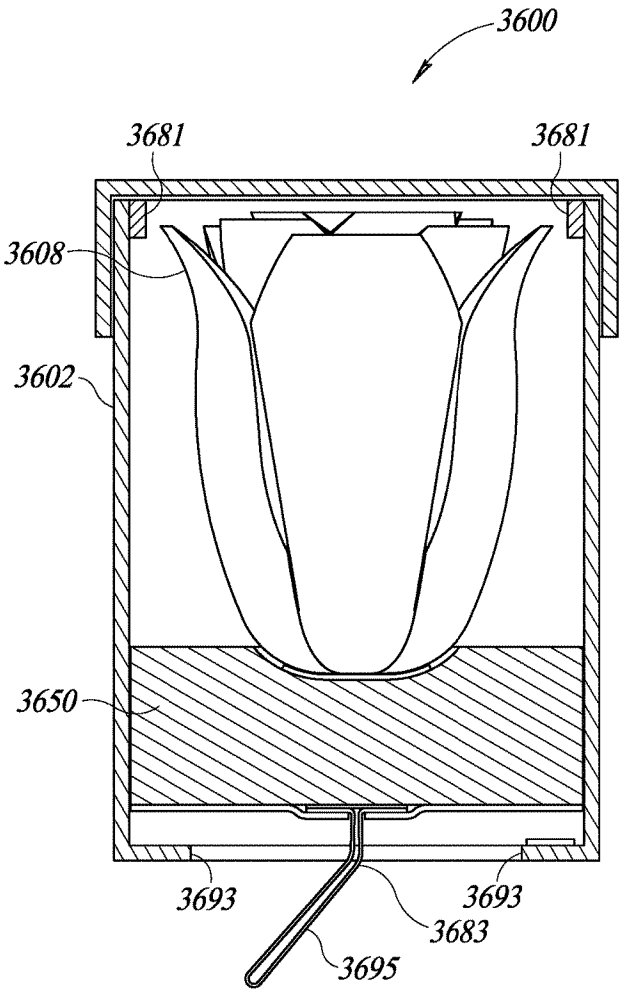
FIG. 42 is a diagram illustrating a cross-sectional view of a portion of the system of the present invention shown in the lowered position after the platform is raised.

FIG. 42 is a diagram illustrating a cross-sectional view of a portion of the system 3600 of the present invention shown in the lowered position after the platform 3650 is raised. A portion of the tab 3695 may pass through the second opening and/or the opening 3693 and may be folded in a desired direction such as at fold 3683. The opening 3693 may be shaped and sized such that that the tab 3695 may be grasped by a user. In some embodiments a releasable fastener such as a hook and loop type fastener (e.g., Velcro™) may be coupled to the bottom wall to releasable couple to the tab 3695 so as to hold the tab in a desired location.

Figure 43:
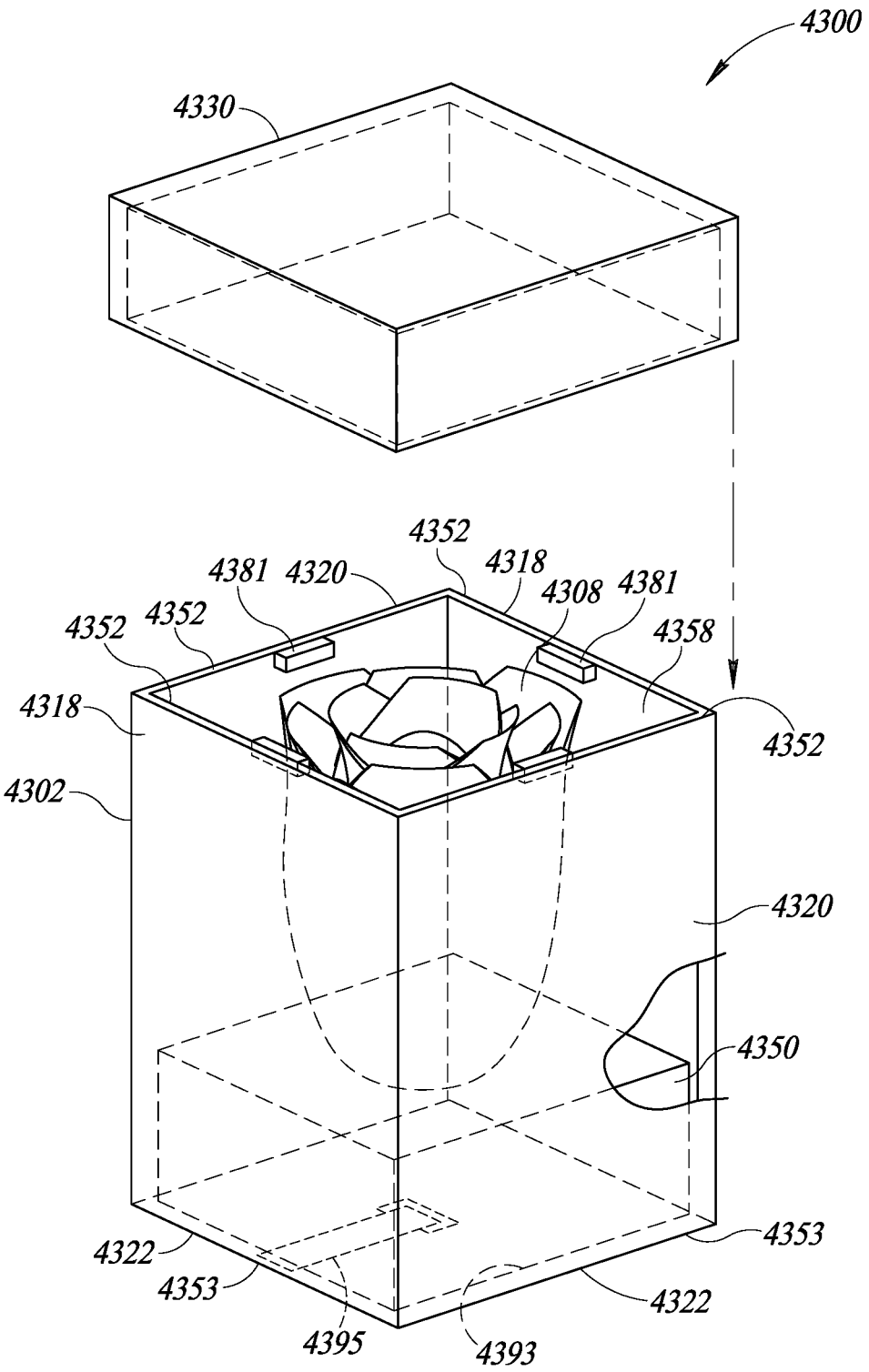
FIG. 43 is a diagram illustrating a partially exploded perspective front view of an example flower container of the present invention according to a thirteenth embodiment.

FIG. 43 is a diagram illustrating a partially exploded perspective front view of an example flower container (hereinafter system 4300 for the sake of clarity) of the present invention according to a thirteenth embodiment. The system 4300 may include one or more of a body 4302, a flower 4308, a platform 4350, a tensioner including a tab 4395, and a cover 4330. The cover 4330 may be similar to the cover 1530 of FIG. 15 and may fit over the body 4302 to cover a first opening of the body 4302.

The body 4302 may include one or more walls such as side walls 4318, end walls 4320, and a bottom wall 4322 which may define at least a portion of a cavity 4358 which may be configured to receive the flower 4308 coupled to the platform 4350. One or more of the side walls 4318 and end walls 4320 may define at least a portion of a top wall 4352 and/or a bottom wall 4353. A bottom wall 4322 may be located at, near, or adjacent to the bottom wall 4353 and may include an opening 4393. A first opening of the body may be located at the top wall 4352 and a second opening of the body may be located at the opening 4383 of the bottom wall 4322. The body 4302 may form a substantially square shape when viewed from the top (e.g., into the cavity 4358). However, in some embodiments, it is envisioned that the body may form other shapes such as polygonal, rectangular, oval, star-shaped, heart-shaped, etc. when viewed from the top.

Limiters such as flanges 4381 may be coupled to, or formed integrally with (e.g., dimples, etc.), a corresponding one of the side walls 4318 and/or end walls 4320. For example, the limiters 4381 may be coupled to a corresponding one of the side walls 4318 and/or end walls 4320 using an adhesive or other suitable fastener (e.g., a staple, a bond, a weld, an epoxy, a hook and loop type fastener, etc.). Although discrete limiters (e.g., flanges 4381) are illustrated, it is also envisioned that in some embodiments the limiters may form a continuous limiter which may be configured to fit within the cavity 4358 to limit travel of the platform 4350 when at the raised position. In some embodiments, the limiters 4381 may include a clip (e.g., a one-way slide-on clip) and/or the like such as a one-way slide clip which may be slid over a corresponding one of the side walls 4318 and/or end walls 4320 and may automatically lock in place (e.g., using any suitable method or methods such as in interference type fit, adhesive, locking tab(s), etc.). In some embodiments, it is envisioned that that clip may be a channel-type clip and/or may be formed integrally with the body 4302. The slide clip may be shaped and/or sized such that it does not interfere with placement of the cover 4330 over the body 4302 and may be configured as a limiter to limit travel of the platform. In yet other embodiments, the limiters may include a felt strip and may include a ribbon which may fold over the top wall 4352.

The platform 4350 may be situated within the cavity 4358 and may be coupled to the tab 4395.

Figure 44:
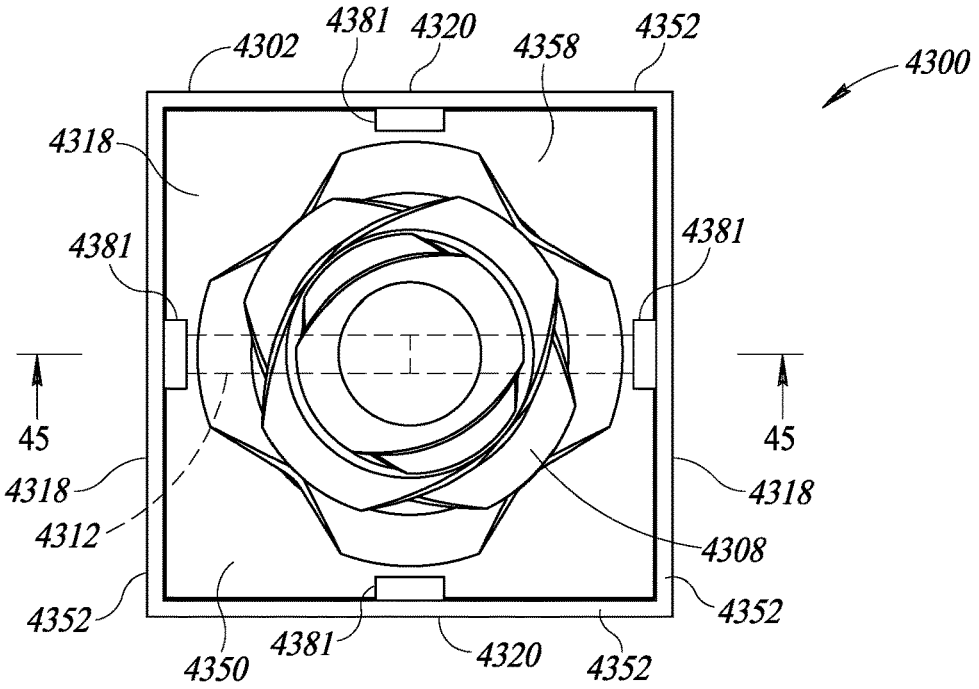
FIG. 44 is a diagram illustrating a top view of a portion of the system of the present invention with the cover removed.

FIG. 44 is a diagram illustrating a top view of a portion of the system 4300 of the present invention with the cover 4330 removed. The flower 4308 may be coupled to the platform 4350 which is situated within the cavity 4358 of the body 4302. The flanges 4381 may be configured to limit travel of the platform 4350 when raised so as to limit travel of the platform 4350 when the platform is at the fully raised position.

Figure 45:
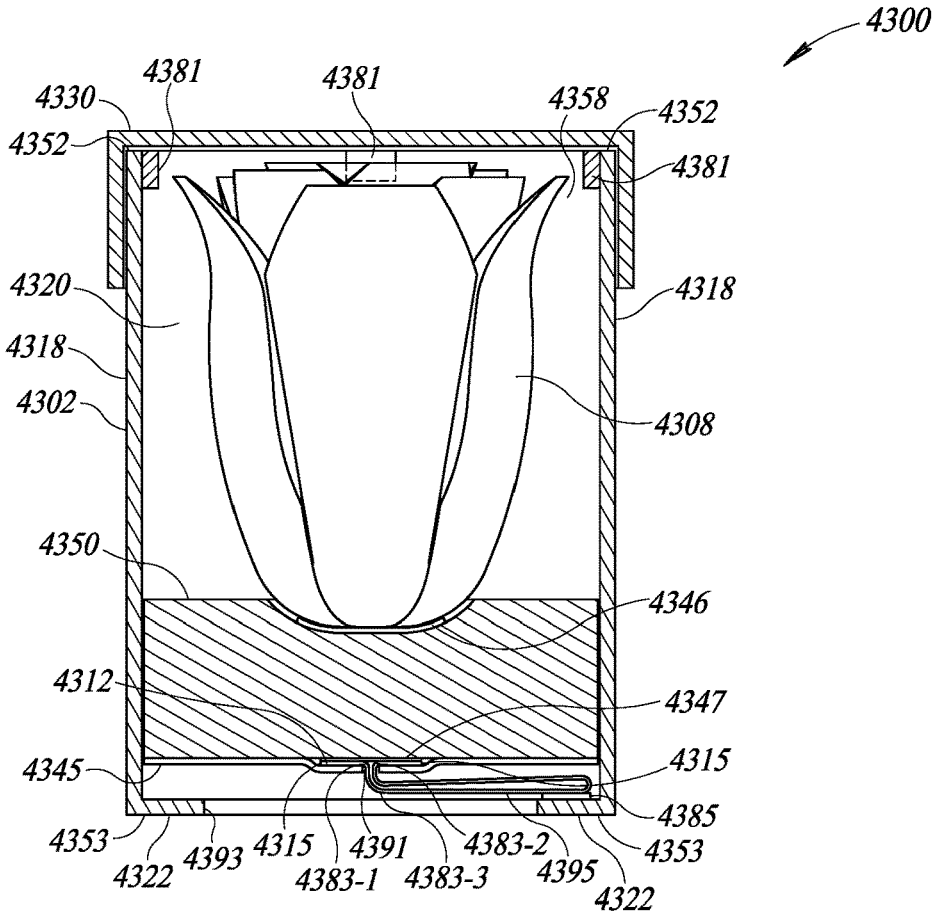
FIG. 45 is a diagram illustrating a cross-sectional view of a portion of the system of the present invention taken along lines 45-45 of FIG. 44.

FIG. 45 is a diagram illustrating a cross-sectional view of a portion of the system 4300 of the present invention taken along lines 45-45 of FIG. 44. The body 4302 may include the bottom wall 4322 having an opening 4393 configured to receive one or more fingers of a user such that the user may push the platform 4350 to urge it towards the first opening to raise it (e.g., a partially, substantially, or fully position) and may thereafter grasp the tab 4395 to pull the platform 4350 down from its current position to a desired position such as a partially, substantially, or fully recessed position as may be desired. The bottom wall 4322 may be formed integrally with, or separately from, the body 4302. For example, the bottom wall 4322 may be formed integrally with one or more of the side walls 4318 and end walls 4320 and/or may be formed separately from one or more of the side walls 4318 and/or end walls 4320 and may be coupled one or more of the side walls 4318 and end walls 4320 using any suitable method such as adhesives, bonds, welds, epoxies, etc.

The tensioner 4312 may have one or more distal ends 4315 one or more of which may be located proximate to the platform 4350. The tensioner 4312 may include tab 4395 and may be coupled to the platform 4350 using any suitable method or methods such as adhesives (e.g., adhesive layer or tape 4347) which may couple the tensioner 4312 to the platform 4350 such as adhesive 4347. Suitable methods to couple the tensioner 4312 to the platform 4350 may include pressure sensitive adhesives, fasteners, bonds, epoxies, welds, etc. The method(s) employed to couple the tab 4395 to the platform 4350 should be compatible with the materials employed. The cap 4345 may include one or more openings 4391 through which a portion of the tensioner 4312 may pass to form a corresponding tab 4395 and may be coupled to the tensioner 4312 and/or the platform 4350 using any suitable method(s) such as an adhesive (e.g., a pressure sensitive adhesive or the like). However, other suitable coupling methods for coupling the cap 4345 to the tensioner 4312 and/or the platform 4350 are also envisioned such as thermal bonding, etc. The tensioner 4312 may be folded at one or more locations such as at first through third folds 4383-1, 4383-2, and 4383-3, respectively, as may be desired.

The platform 4350 may be inserted within the cavity 4358 and the tensioner 4312 including the tab 4395 may be releasably coupled to the bottom wall 4322 (or to an adjacent one of one or more of the side walls 4318 and end walls 4320) using any suitable coupler such as a fastener which may, for example, include releasable adhesive 4385, a hook and loop fastener, and/or the like. The tensioner 4312 may form one or more portions of the tab 4395. Accordingly, portions of the tab 4395 may be tucked between the platform 4350 and bottom wall 4322 and may be releasably coupled to the bottom wall 4322 by the fastener (e.g., adhesive 4385) (which may be optional) such that the tab 4395 may separate from the bottom wall 4322 when the platform 4350 is raised to a fully or partially raised position (as the platform is raised from the fully recessed position as shown). A length of the tab 4395 may be adjusted such that it may be easily accessed via the second opening of through the bottom wall 4322 when the platform 4350 is raised by the user. In some embodiments, it is envisioned that the tab 4395 may remain coupled to the bottom wall 4322.

Figure 46:
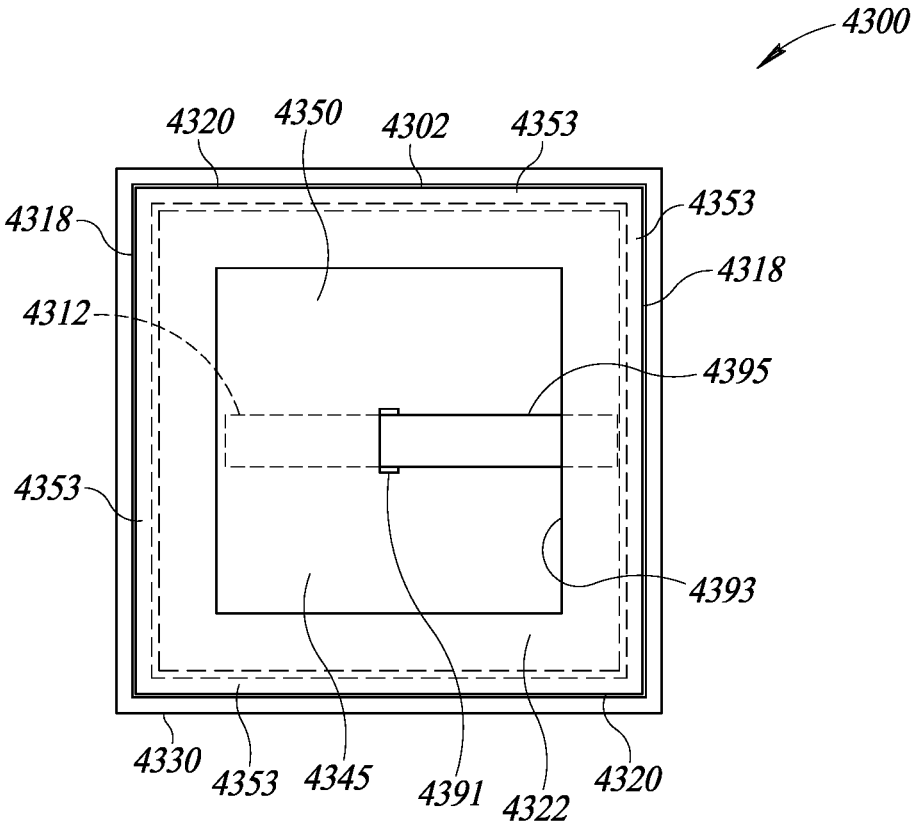
FIG. 46 is a diagram illustrating a bottom view of a portion of the system of the present invention.

FIG. 46 is a diagram illustrating a bottom view of a portion of the system 4300 of the present invention. The tab 4395 may be folded and tucked between the platform 4350 and a corresponding portion of the bottom wall 4322 of the body 4302 if desired. The cap 4345 may have the same shape and size as the bottom of the platform 4350 and may cover the bottom (e.g., a side of the platform opposite to the side which the flower is located) of the platform 4350. The tab 4395 may extend through the opening 4391 of the cap 4395. The opening 4393 in the bottom wall 4322 may be shaped similarly to the body 4302 (e.g., square in the present embodiment) and should be configured to allow passage of an object may be employed to transfer a force to the platform 4350 (e.g., one or more fingers of a user) to urge movement of the platform 4350 and/or to provide for a user to grasp the tab 4395. In some embodiments, portions of the tab 4395 may extend from the opening 4393 regardless of the position of the platform 4350 within the body 4302. The tab 4395 may be folded for storage and/or during use. In some embodiments, the opening 4393 may have any suitable shape as may be desired or may include one or more openings (e.g., a plurality of openings) through which portions of the tensioner 4312 may pass (as may be described below with reference to FIGS. 51 through 53). The operation of raising and lowering the platform 4350 may be similar to that shown in FIGS. 40 through 42 and described in the corresponding description.

Figure 47:
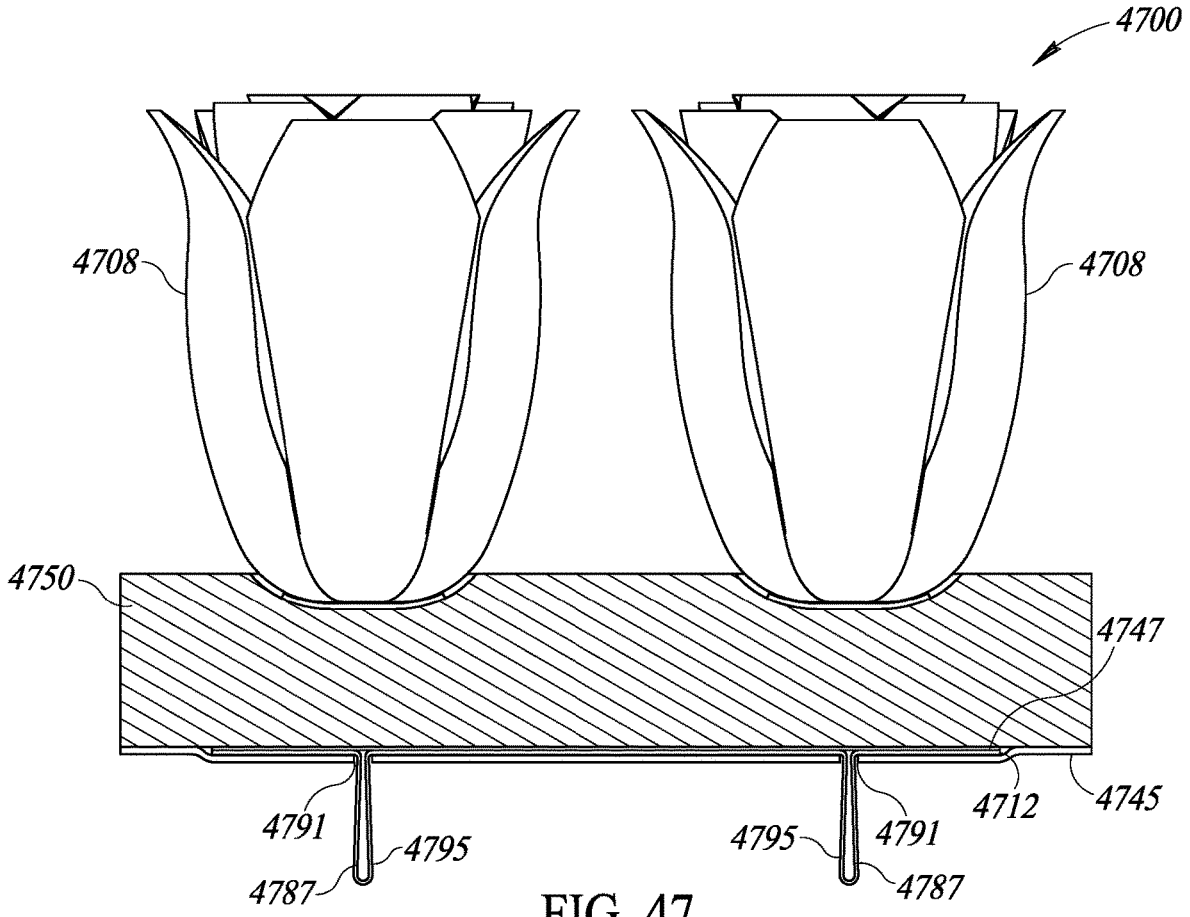
FIG. 47 is a diagram illustrating a side view of a portion of an example platform assembly of the present invention.

In some embodiments, a platform including a tensioner with a plurality of tabs may be provided. For example, FIG. 47 is a diagram illustrating a side view of a portion of an example platform assembly 4700 of the present invention. The platform assembly 4700 may include one or more of a platform 4750, a cap 4745, tensioner 4712, and at least one flower 4708. The at least one flower 4708 may be coupled to the platform 4750 using any suitable method(s) such as an adhesive. The cap 4745 may be coupled to the platform 4750 and portions of the tensioner 4712 using any suitable coupler such as an adhesive (e.g., a pressure sensitive adhesive). The cap 4745 may include a plurality of openings 4791 through which portions of the tensioner 4712 (e.g., loops) may pass and form corresponding tabs 4795. Portions of the tensioner 4712 may be coupled to the platform 4750 using any suitable method such as an adhesive (e.g., a pressure sensitive adhesive) 4747. The tabs 4795 may include openings such as loops 4787 configured to be grasped by a user. In yet other embodiments the tabs 4795 may be closed.

Figure 48:
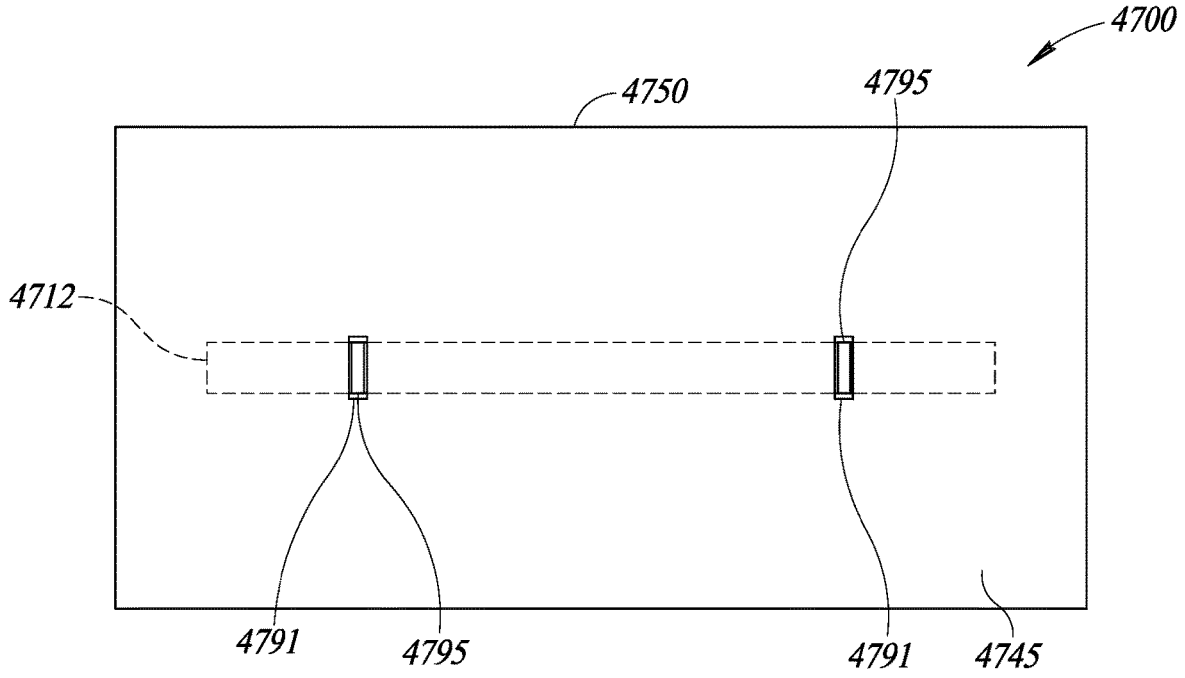
FIG. 48 is a diagram illustrating a bottom view of a portion of the example platform assembly of the present invention.

FIG. 48 is a diagram illustrating a bottom view of a portion of the example platform assembly 4700 of the present invention. Each of the plurality of openings 4791 may be situated apart from each other by a desire amount. Each of the tabs 4795 may extend from a corresponding one of the plurality of openings 4791.

Figure 49:
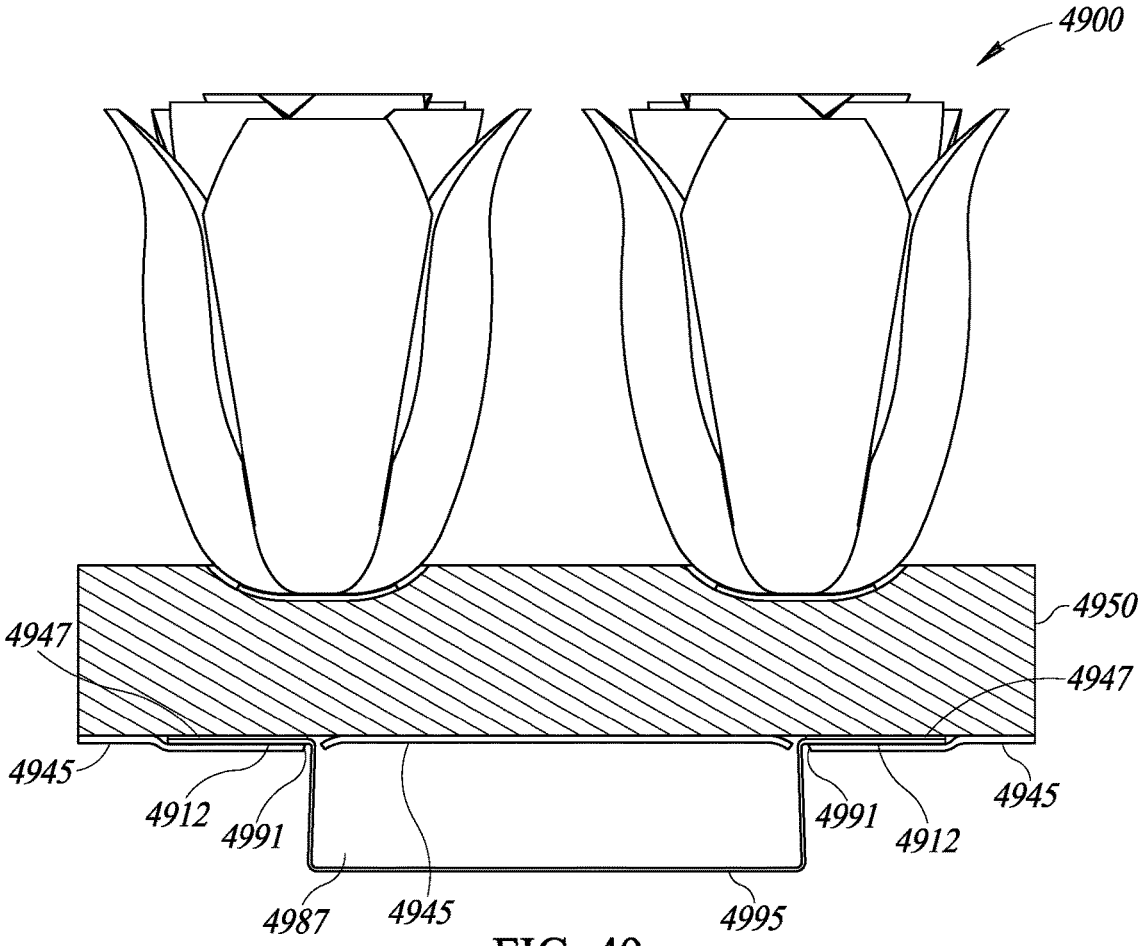
FIG. 49 is a diagram illustrating a side view of a portion of an example platform assembly of the present invention.

In some embodiments, a tab may extend from two or more openings. For example, FIG. 49 is a diagram illustrating a side view of a portion of an example platform assembly 4900 of the present invention. The platform assembly 4900 may include one or more of a platform 4950, a cap 4945, tensioner 4912, and at least one flower 4908. The at least one flower 4908 may be coupled to the platform 4950 using any suitable method(s) such as an adhesive. The cap 4945 may be coupled to the platform 4950 and/or portions of the tensioner 4912 using any suitable coupler such as an adhesive (e.g., a pressure sensitive adhesive). The cap 4945 may have a plurality of openings 4991 through which portions of the tensioner 4712 may pass and may form a corresponding tab 4995. Portions of the tensioner 4912 may be coupled to the platform 4950 using any suitable method such as an adhesive (e.g., a pressure sensitive adhesive). The tab 4995 may include an opening to form a loop 4987 configured to be grasped by a user. A plurality of tabs 4995 may be provided each extending from two or more corresponding openings. It is envisioned that one or more of these plurality of tabs may share one or more of the openings.

Figure 50:
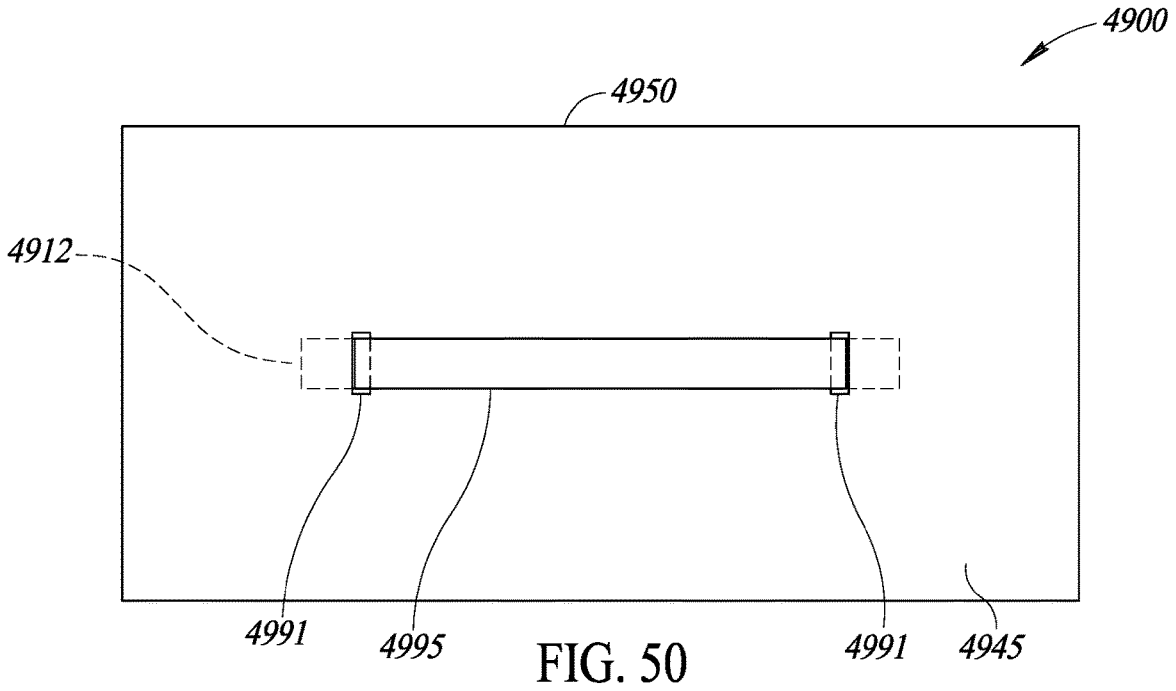
FIG. 50 is a diagram illustrating a bottom view of a portion of the example platform assembly of the present invention.

FIG. 50 is a diagram illustrating a bottom view of a portion of the example platform assembly 4900 of the present invention. Each of the plurality of openings 4991 may be situated apart from each other by a desired amount. Portions of the tensioner 4912 may extend from corresponding openings 4991 to and may form the tab 4995. The loop 4987 may be configured to be grasped by a user.

Figure 51:
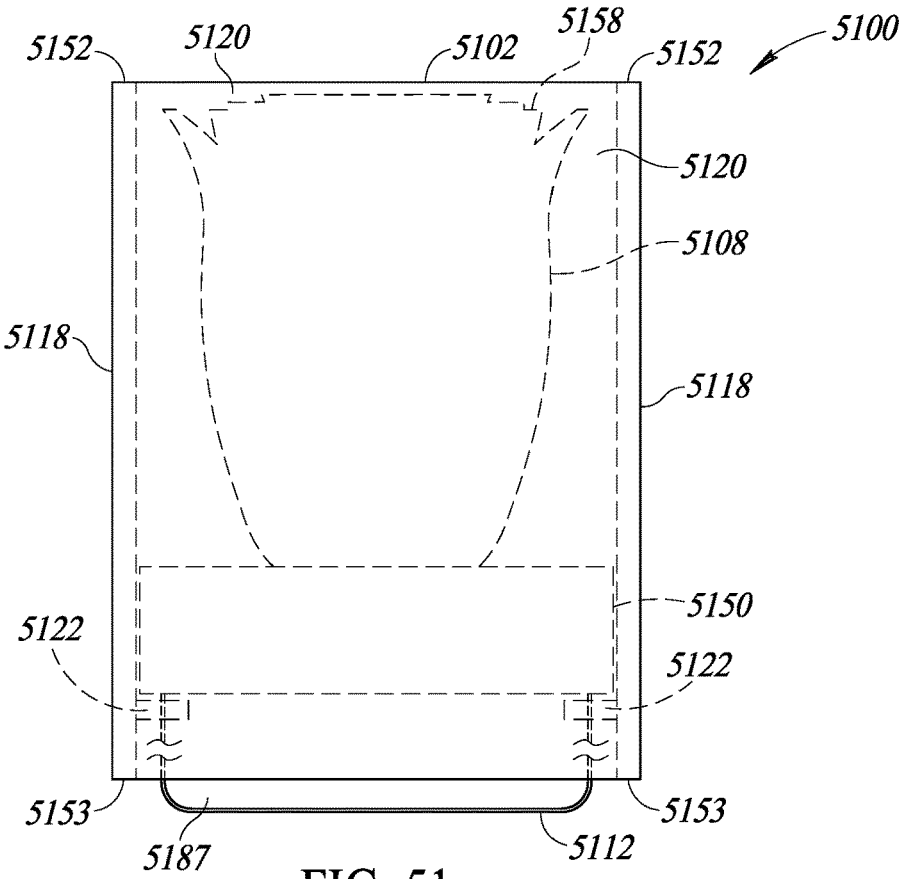
FIG. 51 is a diagram illustrating a side view of a portion of an example flower container system of the present invention according to a fourteenth embodiment.

FIG. 51 is a diagram illustrating a side view of a portion of an example flower container system (hereinafter system 5100 for the sake of clarity) of the present invention according to a fourteenth embodiment. The system 5100 may include one or more of a body 5102, a flower 5108, a platform 5150, a tensioner 5112, and a cover.

The body 5102 may include one or more walls such as side walls 5118, end walls 5120, and a bottom wall 5122 which may define at least a portion of a cavity 5158 configured to receive the platform 5150 and flower 5108 attached thereto. One or more of the side walls 5118 and end walls 5120 may define at least a portion of a top wall 5152 and at least a portion of a bottom wall 5153. The body 5102 may form a substantially square shape when viewed from the top (e.g., into the cavity 5158) and it may be assumed that the side walls 5118 and end walls 5120 may be similarly shaped and sized for the sake of clarity.

Figure 52:
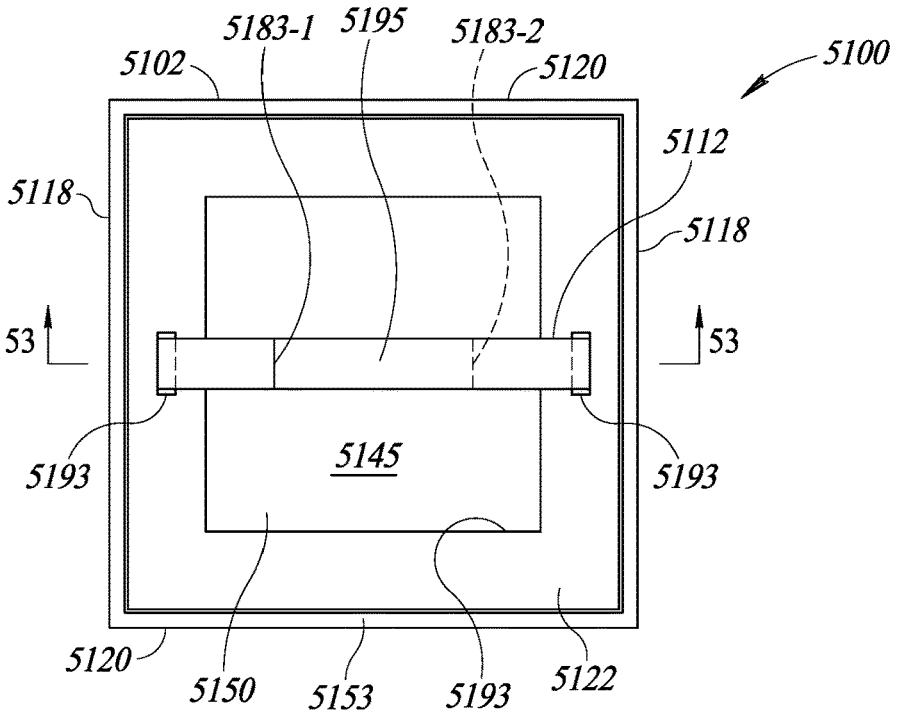
FIG. 52 is a diagram illustrating a bottom view of a portion of the system of the present invention.

FIG. 52 is a diagram illustrating a bottom view of a portion of the system 5100 of the present invention. The bottom wall 5122 may include a plurality of openings such as an opening 5193 and one or more notches or openings such as openings 5193 situated apart from each other and through which portions of the tensioner 5112 may pass and form tab 5195. A cap 5145 may be coupled to the platform 5150 and the tensioner 5112. The platform 5150 is assumed to be in a fully recessed position and portions of the tensioner 5112 may be optionally folded at one or more folds such as folds 5183-1 and 5183-2. The openings 5193 may be aligned with the openings of the cap.

Figure 53:
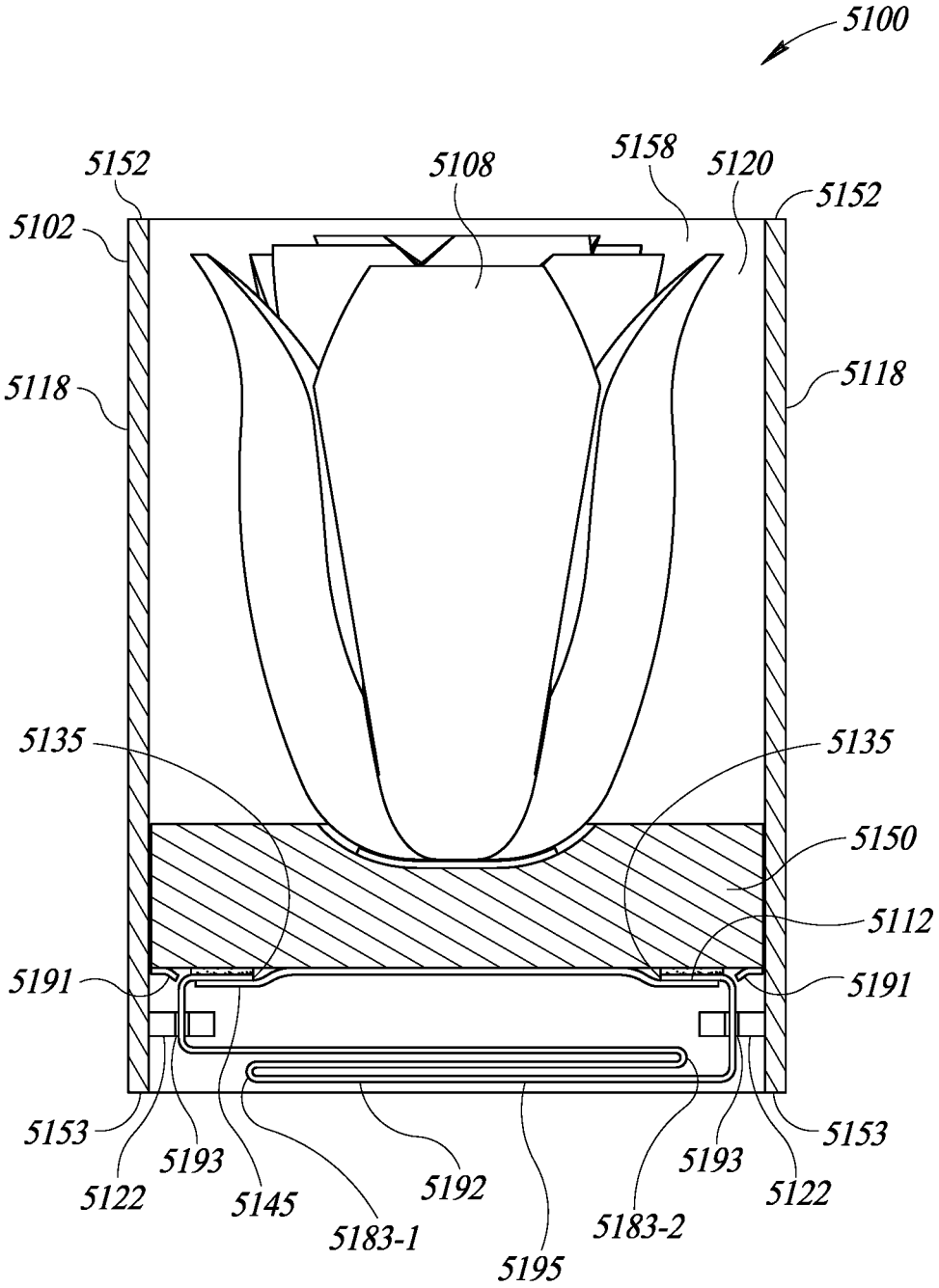
FIG. 53 is a diagram illustrating a cross-sectional view of a portion of the system of the present invention taken along lines 53-53 of FIG. 52.

FIG. 53 is a diagram illustrating a cross-sectional view of a portion of the system 5100 of the present invention taken along lines 53-53 of FIG. 52. The bottom wall 5122 may be configured to provide space for of portions of the tensioner 5112 when the platform 5150 is in the recessed position so that the portions of the tensioner 5112 may be located between the bottom wall 5122 and the bottom wall 5153 without interfering with the body 5102 when the body 5102 is placed on a flat surface. Accordingly, the bottom wall 5122 may be positioned slightly away from the bottom wall 5153 to form at least a portion of a cavity configured to receive portions of the tensioning member 5112 during storage and/or use. The bottom wall 5122 may be continuous or discontinuous and may include notches or openings 5193 configured to slidably receive corresponding portions of the tensioner 5112. Accordingly, portions of the tensioner 5112 may slidably pass through the corresponding openings 5193 when the platform 5190 is moved relative to the body 5102. The platform 5150 is shown in the fully recessed position with the tensioner 5150 folded at one or more folds such as at folds 5183-1 and 5183-2 for storage. The openings 5193 may be aligned with the openings of the cap 5191. In some embodiments, ends 5135 of the tensioner 5112 may optionally extend through opposed openings in the one or more of the side walls 5118.

Figure 54:
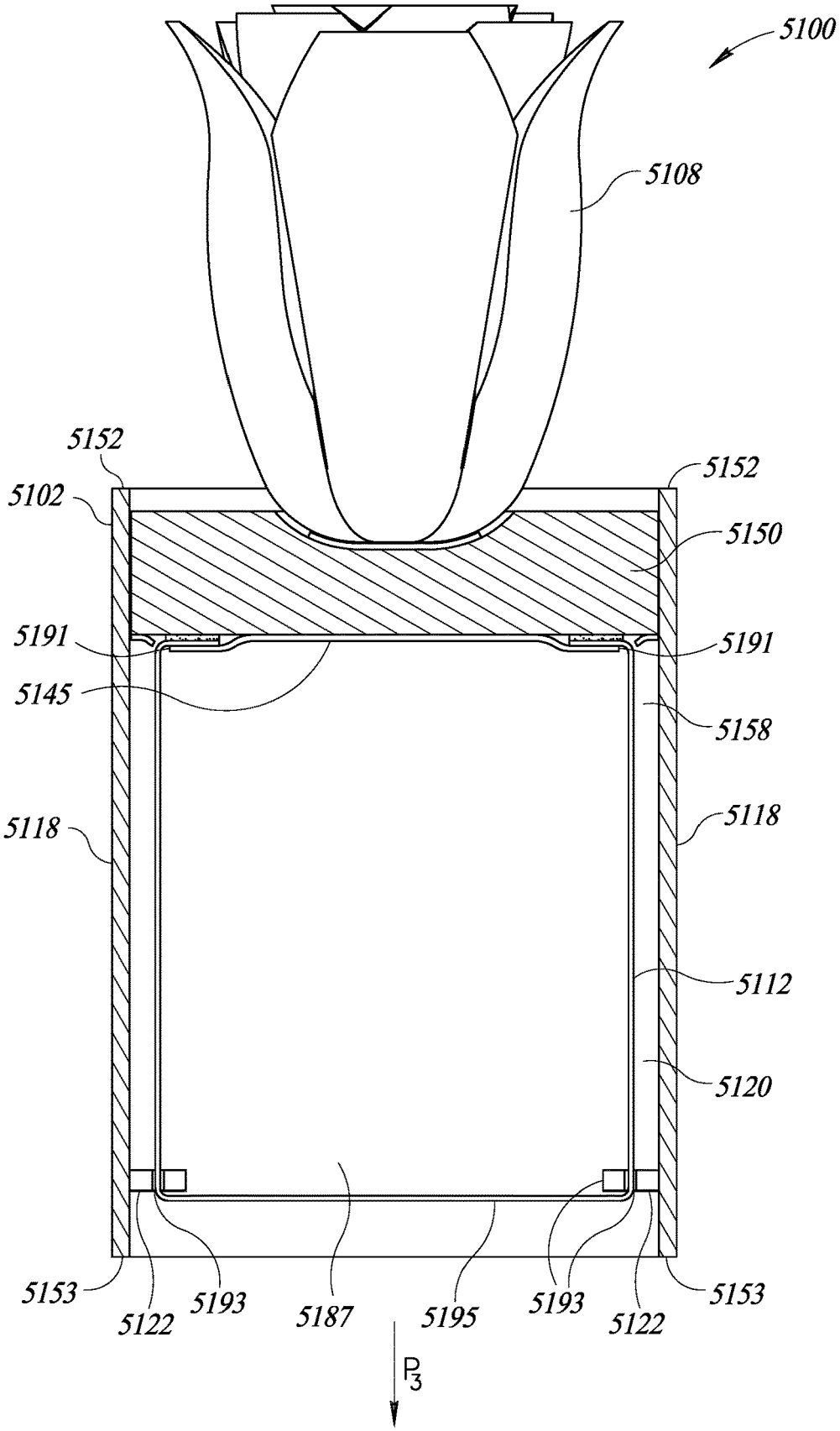
FIG. 54 is a diagram illustrating a cross-sectional view of a portion of the system of the present invention with the platform in the fully raised position.

FIG. 54 is a diagram illustrating a cross-sectional view of a portion of the system 5100 of the present invention with the platform 5150 in the fully raised position. The tensioner 5112 may configured to limit travel of the platform 5150 when fully raised (thus acting as a limiter) and form a loop 5197 including the tab 5195. Accordingly, a length of the tensioner 5112 may be set such that when the platform 5150 is fully raised, travel of the platform 5150 may be limited by the tensioner 5112. To move the platform 5150 to the fully recessed position (e.g., as shown in FIG. 53), a user may grasp the tab 5195 portion of the tensioner 5112 and pull it away from the platform 5150 in the direction of arrow P3 as shown. Although a single tensioner 5112 is shown, a plurality of tensioners may be employed.

Figure 55:
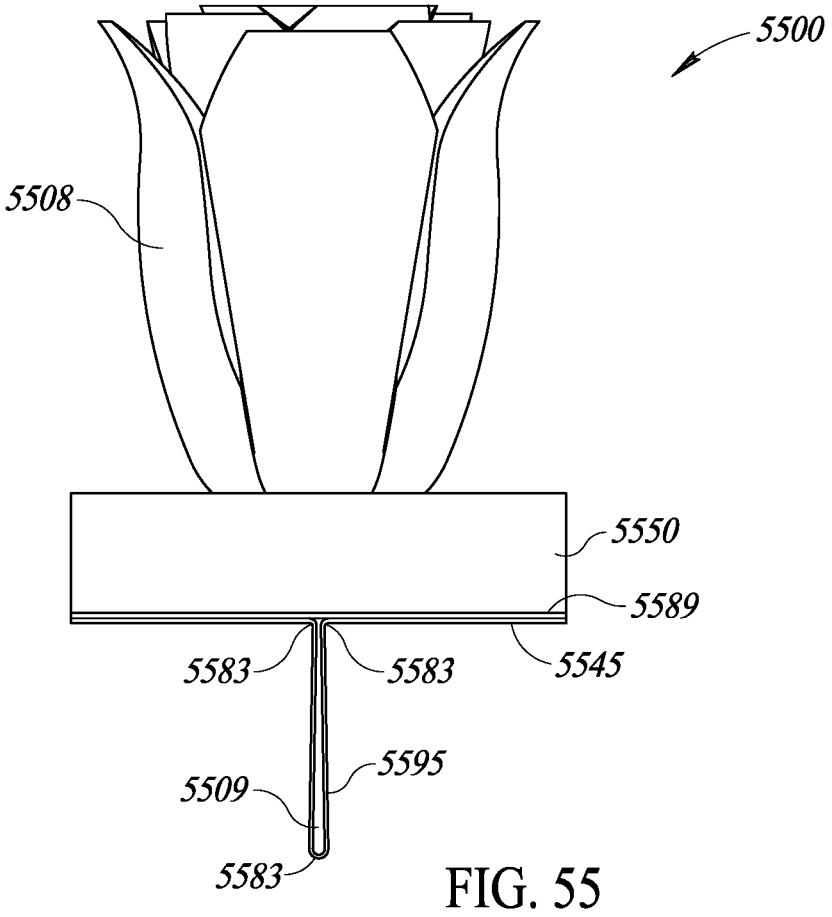
FIG. 55 is a diagram illustrating a side view of a portion of an example platform assembly of the present invention.

In some embodiments, at least a portion of a tab may be formed integrally with the cap coupled to the platform. For example, FIG. 55 is a diagram illustrating a side view of a portion of an example platform assembly 5500 of the present invention. The platform assembly 5500 may include one or more of a platform 5550, a cap 5545, an adhesive layer 5509, a tab 5595, and at least one flower 5508. The cap 5545 may be formed from a film having opposed surfaces to which the adhesive layer 5509 may be applied to one surface thereof prior to folding and/or cutting. The adhesive layer 5509 may include any suitable adhesive such as a pressure sensitive adhesive or the like. The at least one flower 5508 may be coupled to the platform 5550 using any suitable method(s) such as an adhesive. The cap 5545 may be folded at folds 5583 with adjacent portions coupled to each other by adjacent portions of the adhesive layer 5509 to form at least a portion of the tab 5595. The tab 5595 is shown extended.

Figure 56:
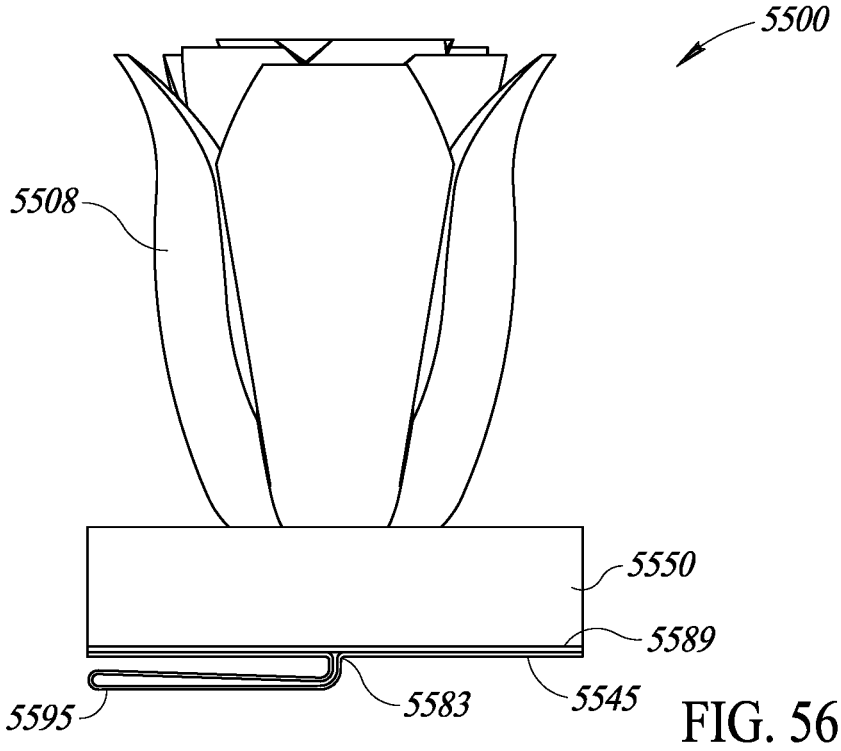
FIG. 56 is a diagram illustrating a side view of a portion of an example platform assembly of the present invention with the tab folded.

FIG. 56 is a diagram illustrating a side view of a portion of an example platform assembly 5500 of the present invention with the tab 5595 folded. The tab 5595 may be folded for storage such as when the platform is in a fully recessed position. The tab 5595 may be releasably coupled to an adjacent portion of the cap 5545 using a releasable adhesive if desired.

Figure 57:
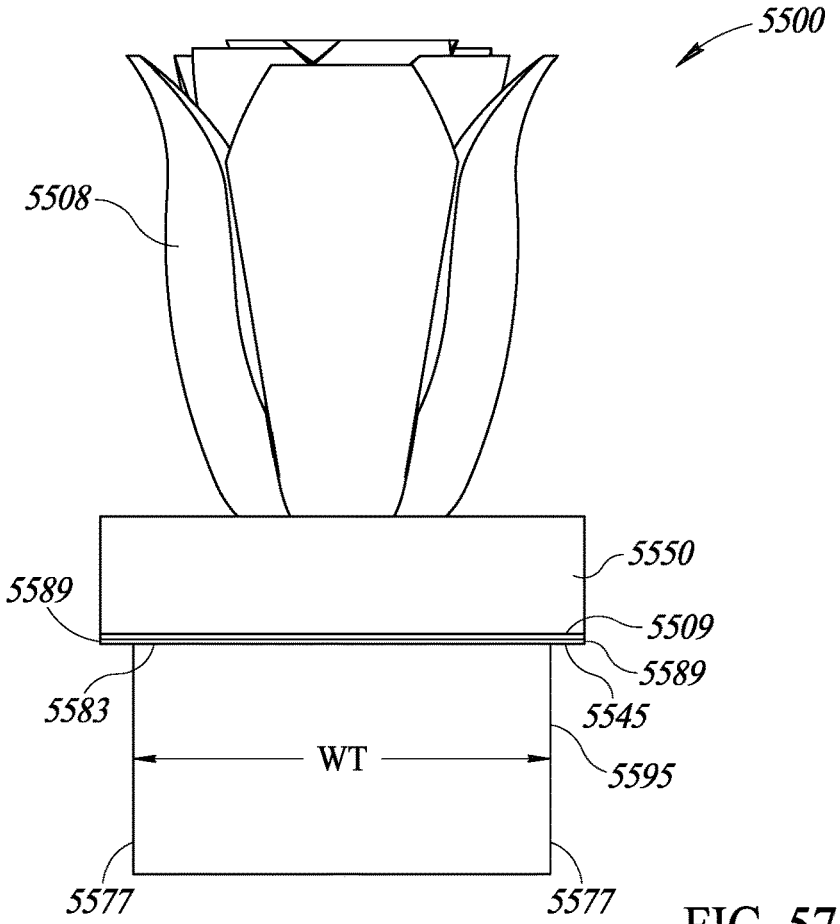
FIG. 57 is a diagram illustrating an end view of a portion of an example platform assembly of the present invention with the tab extended.

FIG. 57 is a diagram illustrating an end view of a portion of an example platform assembly 5500 of the present invention with the tab 5595 extended. The tab 5595 may be folded for storage such as when the platform is in a fully recessed position. Portions of the tab 5595 adjacent to a periphery 5589 of the platform 5550 may be removed or folded to narrow the tab 5595 to a desired width (WT) which may avoid interference with a bottom wall of a container at the second opening during use.

Figure 58:
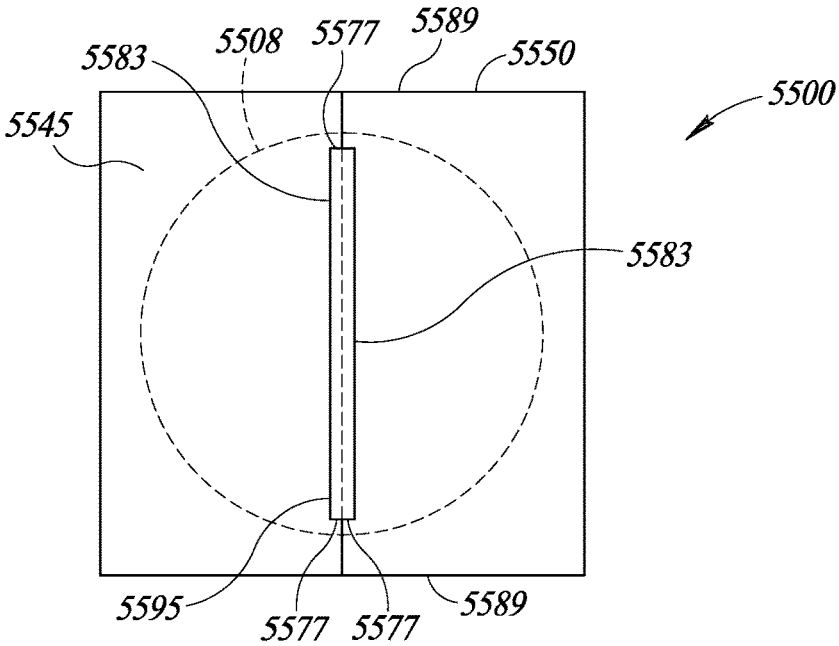
FIG. 58 is a diagram illustrating a bottom view of a portion of an example platform assembly of the present invention with the tab extended.

FIG. 58 is a diagram illustrating a bottom view of a portion of an example platform assembly 5500 of the present invention with the tab 5595 extended.

Figure 59:
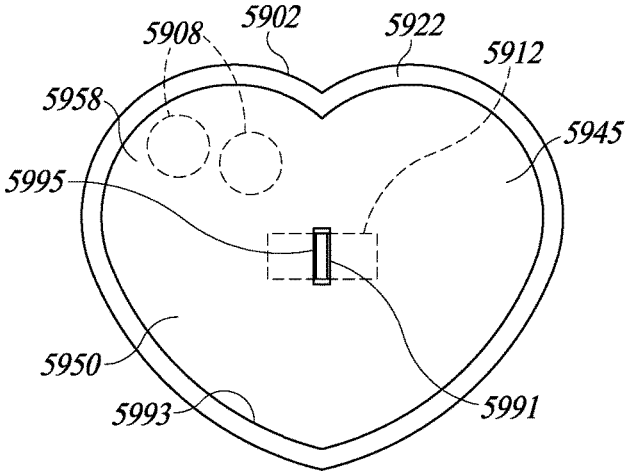
FIG. 59 is a diagram illustrating a bottom view of a portion of an example flower container system of the present invention according to a fifteenth embodiment.

FIG. 59 is a diagram illustrating a bottom view of a portion of an example flower container system 5900 (hereinafter the system 5900 for the sake of clarity) of the present invention according to a fifteenth embodiment.

The system 5900 may include one or more of a body 5902, a platform 5950, and one or more flowers 5908 coupled to the platform. The body 5902 may include a cavity 5958 and a bottom wall 5922 configured to limit travel of the platform 5950 within the cavity 5958. The platform 5950 may include the cap 5945 having at least one opening 5991 through which at least a portion of a tensioner 5912 extends and forms a tab 5995 suitable for grasping by a user. The body 5902 may have a heart shape when viewed from the bottom (or top). The bottom wall 5922 may be shaped similarly to the body 5902 and may include an opening 5993. The top view may be similar to the FIG. 25.

Figure 60:
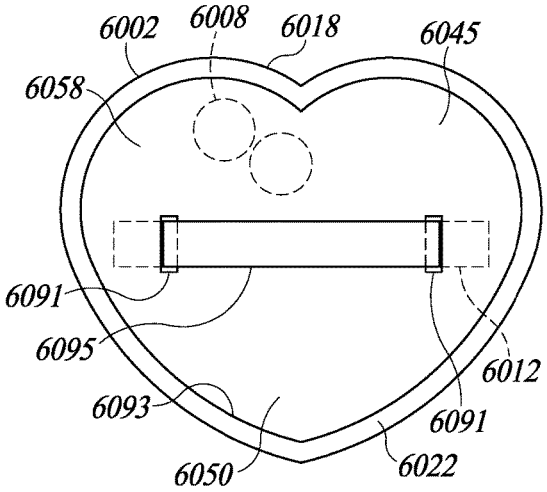
FIG. 60 is a diagram illustrating a bottom view of a portion of an example flower container system of the present invention according to a sixteenth embodiment.

FIG. 60 is a diagram illustrating a bottom view of a portion of an example flower container system 6000 (hereinafter the system 6000 for the sake of clarity) of the present invention according to a sixteenth embodiment. The system 6000 may include one or more of a body 6002, a platform 6050, and one or more flowers 6008 coupled to the platform 6050. The body 6002 may include a cavity 6058 and a bottom wall 6022 configured to limit travel of the platform 6050 within the cavity 6058. The platform 6050 may include the cap 6045 having at least one opening 6091 through which at least a portion of a tensioner 6012 may extend and form a tab 6095 suitable for grasping by a user. The body 6002 may have a heart shape when viewed from the bottom (or top). The bottom wall 6022 may be shaped similarly to the body 6002 and may include an opening 6093. The top view may be similar to the FIG. 25.

Figure 61:
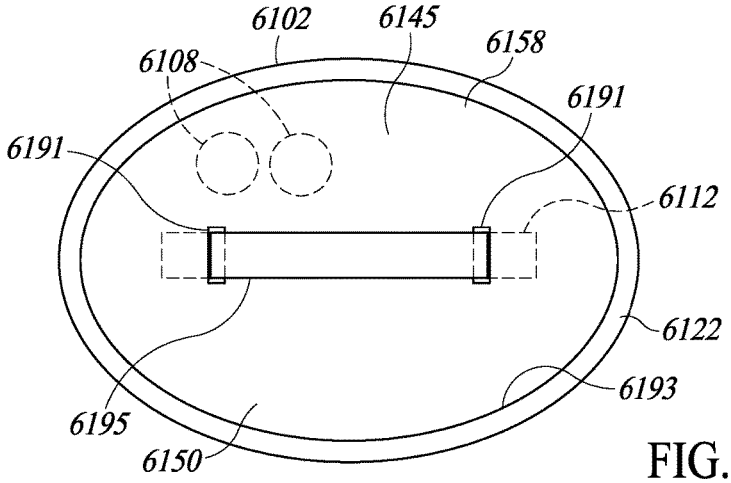
FIG. 61 is a diagram illustrating a bottom view of a portion of an example flower container system of the present invention according to a seventeenth embodiment.

FIG. 61 is a diagram illustrating a bottom view of a portion of an example flower container system 6100 (hereinafter the system 6100 for the sake of clarity) of the present invention according to a seventeenth embodiment. The system 6100 may include one or more of a body 6102, a platform 6150, and one or more flowers 6108 coupled to the platform 6150. The body 6102 may include a cavity 6158 and a bottom wall 6122 configured to limit travel of the platform 6150 within the cavity 6158. The platform 6150 may include the cap 6145 having at least one opening 6191 through which at least a portion of a tensioner 6112 may extend and form a tab 6195 suitable for grasping by a user. The body 6102 may have an oval shape when viewed from the bottom (or top). The bottom wall 6122 may be shaped similarly to the body 6102 and may include an opening 6193. The top view may be similar to the FIG. 24.

Figure 62:
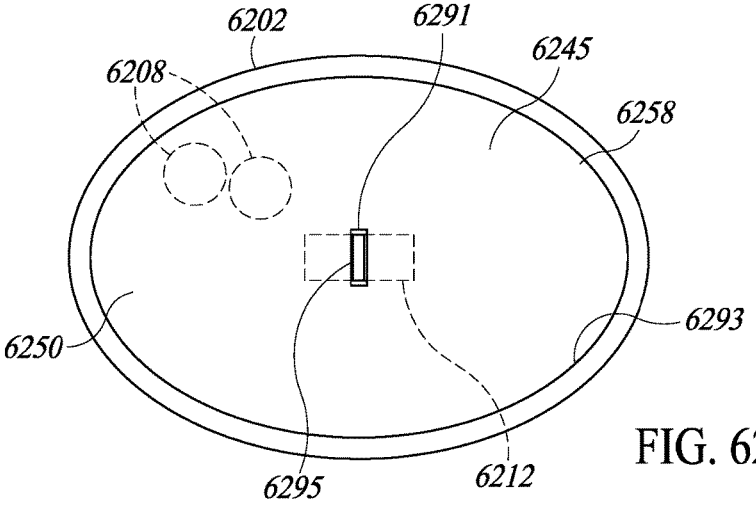
FIG. 62 is a diagram illustrating a bottom view of a portion of an example flower container system of the present invention according to an eighteenth embodiment.

FIG. 62 is a diagram illustrating a bottom view of a portion of an example flower container system 6200 (hereinafter the system 6200 for the sake of clarity) of the present invention according to an eighteenth embodiment. The system 6200 may include one or more of a body 6202, a platform 6250, and one or more flowers 6208 coupled to the platform 6250. The body 6202 may include a cavity 6258 and a bottom wall 6222 configured to limit travel of the platform 6250 within the cavity 6258. The platform 6250 may include the cap 6245 having at least one opening 6291 through which at least a portion of a tensioner 6212 may extend and form a tab 6295 suitable for grasping by a user. The body 6202 may have an oval shape when viewed from the bottom (or top). The bottom wall 6222 may be shaped similarly to the body 6202 and may include an opening 6293. The top view may be similar to the FIG. 24.

Any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermediary components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In the claims, any reference signs placed between parentheses shall not be construed as limiting the claim. The use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first," "second," etc. are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. As numerous modifications and changes will readily occur to those skilled in the art, it is intended that the invention not be limited to the limited number of embodiments described herein. Accordingly, it will be appreciated that all suitable variations, modifications and equivalents may be resorted to, falling within the spirit and scope of the present invention. The embodiments were chosen and described in order to best explain the principles of the invention and the practical application, and to enable others of ordinary skill in the art to understand the invention for various embodiments with various modifications as are suited to the particular use contemplated.

What is claimed is:

1. A container, comprising:

a platform configured to be coupled to at least one flower;

a body having at least one wall extending between a top edge and a bottom edge and defining at least a portion of a cavity configured to receive the platform, the top edge defining a first opening leading to the cavity;

a bottom wall at or near the bottom edge of the body and defining a second opening leading to the cavity; and at least one tensioner coupled to the platform and forming a tab configured to be grasped by a user to urge at least a portion of the platform from the cavity towards the second opening when the tab is pulled.

2. The container according to claim 1, wherein the tab is configured to be grasped by a user through the second opening when the platform is in a fully or substantially raised position.

3. The container according to claim 2, wherein the platform is configured to receive a force from the second opening to urge the platform towards or through the first opening.

4. The container according to claim 1, wherein the tab is configured to urge the platform towards the second opening when pulled from the cavity towards or through the second opening.

5. The container according to claim 4, wherein the bottom wall is configured to limit travel of the platform when the platform is urged towards the second opening.

6. The container according to claim 1, wherein the second opening is smaller in area than the first opening.

7. The container according to claim 1, wherein the bottom wall is configured to limit travel of the platform when the platform is urged from the cavity towards the second opening.

8. The container according to claim 1, further comprising at least one limiter coupled to the at least one wall at the first opening and configured to limit travel of the platform towards or through the first opening.

9. The container according to claim 1, further comprising at least one opening situated in the at least one wall between the top and bottom edges.

10. The container according to claim 9, wherein the at least one tensioner further extends through a corresponding one of the at least one opening such that at least a portion of the at least one tensioner is situated in the cavity and is configured to be pulled from the cavity through the corresponding one of the at least one opening to urge at least a portion of the platform from the cavity towards or through the first opening.

11. A container, comprising:

a platform configured to be coupled to at least one flower;

a body having at least one wall extending between a top edge and a bottom edge and defining at least a portion of a cavity configured to receive the platform, the top edge defining a first opening leading to the cavity;

a bottom wall at or near the bottom edge of the body and defining a second opening leading to the cavity; and at least one tensioner coupled to the platform and forming at least one tab partially extending from the platform towards the bottom wall, the at least one tab configured to be grasped by a user to urge at least a portion of the platform from the cavity towards the second opening when the at least one tab is pulled.

12. The container according to claim 11, wherein the at least one tab is configured to be grasped by a user through the second opening when the platform is in a fully or substantially raised position.

13. The container according to claim 12, wherein the at least one tab is configured to be pulled from the cavity towards or through the second opening.

14. The container according to claim 13, wherein the at least one tab is configured to urge the platform towards the second opening as the tab is pulled towards or through the second opening.

15. The container according to claim 11, further comprising a coupler to configured to releasably couple the at least one tab to at least one of the bottom wall and the at least one wall.

16. A container, comprising:

a platform configured to be coupled to at least one flower;

a body having at least one wall extending between a top edge and a bottom edge and defining at least a portion of a cavity configured to receive the platform, the top edge defining a first opening leading to the cavity;

a bottom wall at or near the bottom edge of the body and defining at least one opening opposite the first opening; and at least one tensioner coupled to the platform and configured to pass through the at least one opening of the bottom wall, the at least one tensioner forming a tab configured be grasped by a user to urge at least a portion of the platform from the cavity towards the bottom wall when the tab is pulled.

17. The container according to claim 16, wherein the tab is configured to be grasped by a user to pull at least a portion of the at least one tensioner through a corresponding one of the at least one opening of the bottom wall.

18. The container according to claim 16, wherein the bottom wall is configured to limit travel of the platform when the platform is urged towards the bottom wall.

19. The container according to claim 16, wherein the at least one tensioner is further configured to limit travel of the platform towards or through the first opening.

20. The container according to claim 16, further comprising a releasable fastener to releasably couple portions of the at least one tensioner to each other when the platform is in a fully or substantially recessed position in the cavity.

* * * * *